US011278930B2

(12) United States Patent
Pringle-Iv et al.

(10) Patent No.: US 11,278,930 B2
(45) **Date of Patent: *Mar. 22, 2022**

(54) METHODS FOR DISPENSING A BRUSHABLE SUBSTANCE ONTO A SURFACE

(71) Applicant: The Boeing Company, Chicago, IL (US)

(72) Inventors: John W. Pringle-Iv, Gardena, CA (US); Raul Tomuta, Stanton, CA (US); Angelica Davancens, Reseda, CA (US); Martin Guirguis, Long Beach, CA (US); Martin Lozano, Berkeley, CA (US); Jake B. Weinmann, Southfield, MI (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/015,292

(22) Filed: Sep. 9, 2020

(65) Prior Publication Data

US 2020/0406292 A1 Dec. 31, 2020

Related U.S. Application Data

(62) Division of application No. 15/849,781, filed on Dec. 21, 2017, now Pat. No. 10,799,910.

(51) Int. Cl.
*B05D 1/28* (2006.01)
*B05B 12/00* (2018.01)
(Continued)

(52) U.S. Cl.
CPC ..... *B05D 1/28* (2013.01); *B05B 1/3013* (2013.01); *B05B 12/008* (2013.01);
(Continued)

(58) Field of Classification Search
CPC ..... A46B 13/04; A46B 11/06; B05D 1/28; B05C 5/0216; B05C 5/0225; B25J 9/1692
See application file for complete search history.

(56) References Cited

U.S. PATENT DOCUMENTS 3,977,083 A * 8/1976 Leslie ..... A61C 17/005 433/82
4,932,094 A * 6/1990 McCowin ..... A46B 11/0017 15/29

(Continued)

FOREIGN PATENT DOCUMENTS

DE 298 12 213 10/1998
DE 20 2013005169 10/2013

(Continued)

OTHER PUBLICATIONS

Canadian Intellectual Property Office, Office Action, App. No. 3,021,289 (dated Nov. 24, 2021).

*Primary Examiner* — Nathan H Empie
(74) *Attorney, Agent, or Firm* — Walters & Wasylyna LLC

(57) ABSTRACT

A method of dispensing a brushable substance onto a surface comprises (1) with a cartridge positioned inside a sleeve between an inner tubular sleeve wall and an outer tubular sleeve wall, circumscribing the inner tubular sleeve wall, and also positioned between a twist-lock pressure cap, hermetically coupled with the cartridge, and a valve, communicatively coupled with the cartridge, linearly moving an annular plunger, received between an inner tubular cartridge wall and an outer tubular cartridge wall, circumscribing the inner tubular cartridge wall, toward the valve along a first axis to urge the brushable substance from the cartridge, through the valve, and to a brush that is communicatively (Continued)

coupled to the valve; and (2) controlling flow of the brushable substance from the valve to the brush.

20 Claims, 37 Drawing Sheets

(51) Int. Cl.

| | |
|---|---|
| ***B05B 1/30*** | (2006.01) |
| ***B05B 13/04*** | (2006.01) |
| ***B05B 12/12*** | (2006.01) |
| ***B05B 16/20*** | (2018.01) |
| ***B05C 5/02*** | (2006.01) |
| ***B05C 1/02*** | (2006.01) |
| *B05C 1/06* | (2006.01) |

(52) U.S. Cl.
CPC ..... *B05B 12/124* (2013.01); *B05B 13/0431* (2013.01); *B05B 16/20* (2018.02); *B05C 1/027* (2013.01); *B05C 5/0216* (2013.01); *B05C 5/0225* (2013.01); *B05C 1/06* (2013.01)

(56) References Cited

U.S. PATENT DOCUMENTS

| | | | | |
|---|---|---|---|---|
| 6,589,209 | B1 * | 7/2003 | Dysarz | A61M 5/3232 604/110 |
| 2002/0071772 | A1 * | 6/2002 | Isogai | B05C 11/1021 417/292 |
| 2006/0225293 | A1 * | 10/2006 | Godwin | B60D 1/36 33/264 |
| 2007/0228076 | A1 * | 10/2007 | Horner | B05C 17/00559 222/135 |
| 2016/0361734 | A1 | 12/2016 | Routen et al. | |
| 2017/0105516 | A1 | 4/2017 | Pringle-Iv et al. | |
| 2017/0106401 | A1 | 4/2017 | Pringle-Iv et al. | |
| 2017/0106402 | A1 | 4/2017 | Pringle-Iv et al. | |
| 2018/0271484 | A1 | 9/2018 | Whisler | |
| 2018/0272372 | A1 | 9/2018 | Pringle-Iv et al. | |
| 2018/0273273 | A1 | 9/2018 | Pringle-Iv et al. | |

FOREIGN PATENT DOCUMENTS

| | | | | |
|---|---|---|---|---|
| EP | 1 941 823 | | 7/2008 | |
| EP | 3 257 419 | | 12/2017 | |
| FR | 2501080 | A1 * | 9/1982 | B01F 5/0672 |
| WO | WO 2017/106900 | | 6/2017 | |

* cited by examiner (CONTINUED TO FIG.1B)

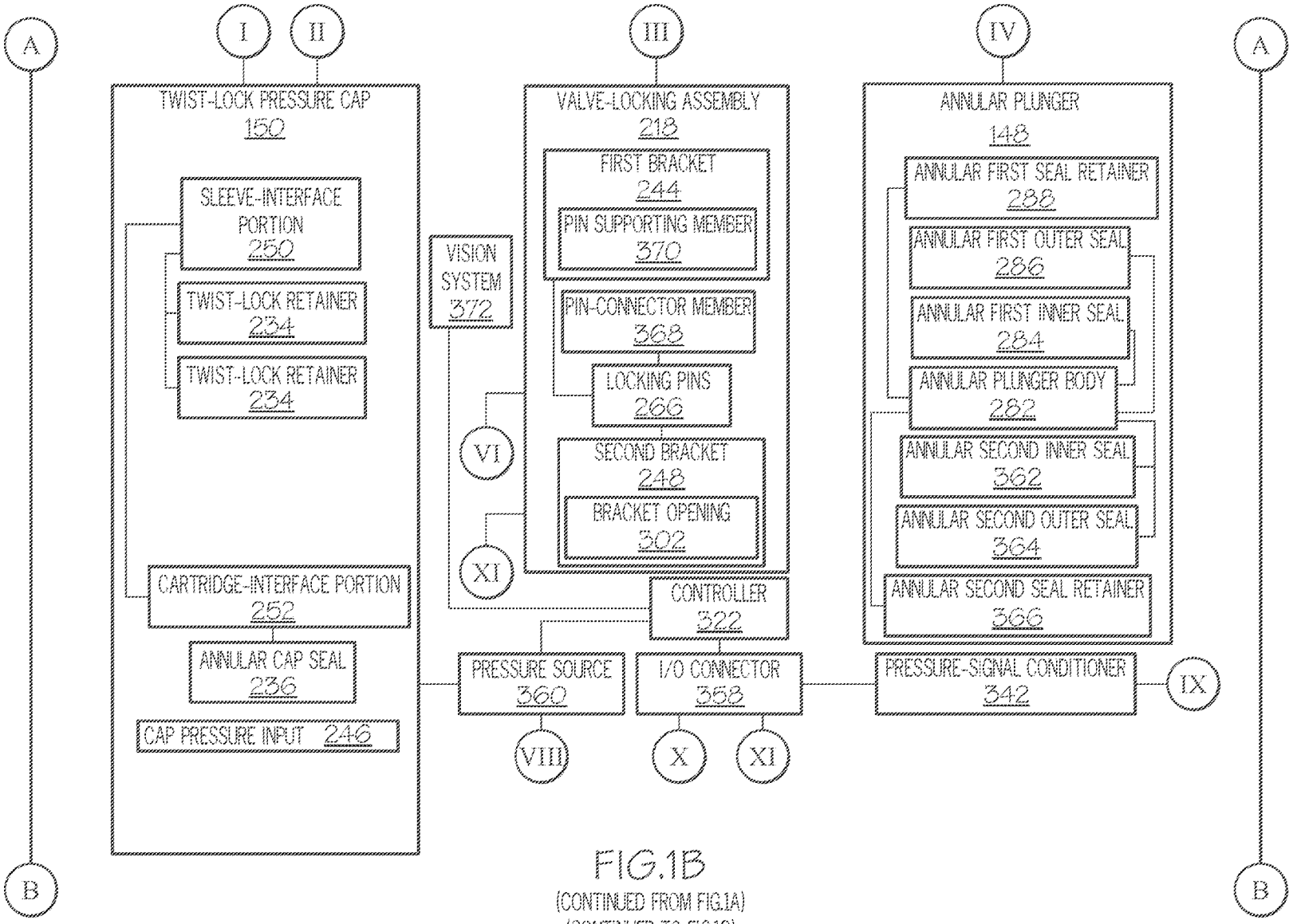
FIG.1B
(CONTINUED FROM FIG.1A)
(CONTINUED TO FIG.1C)

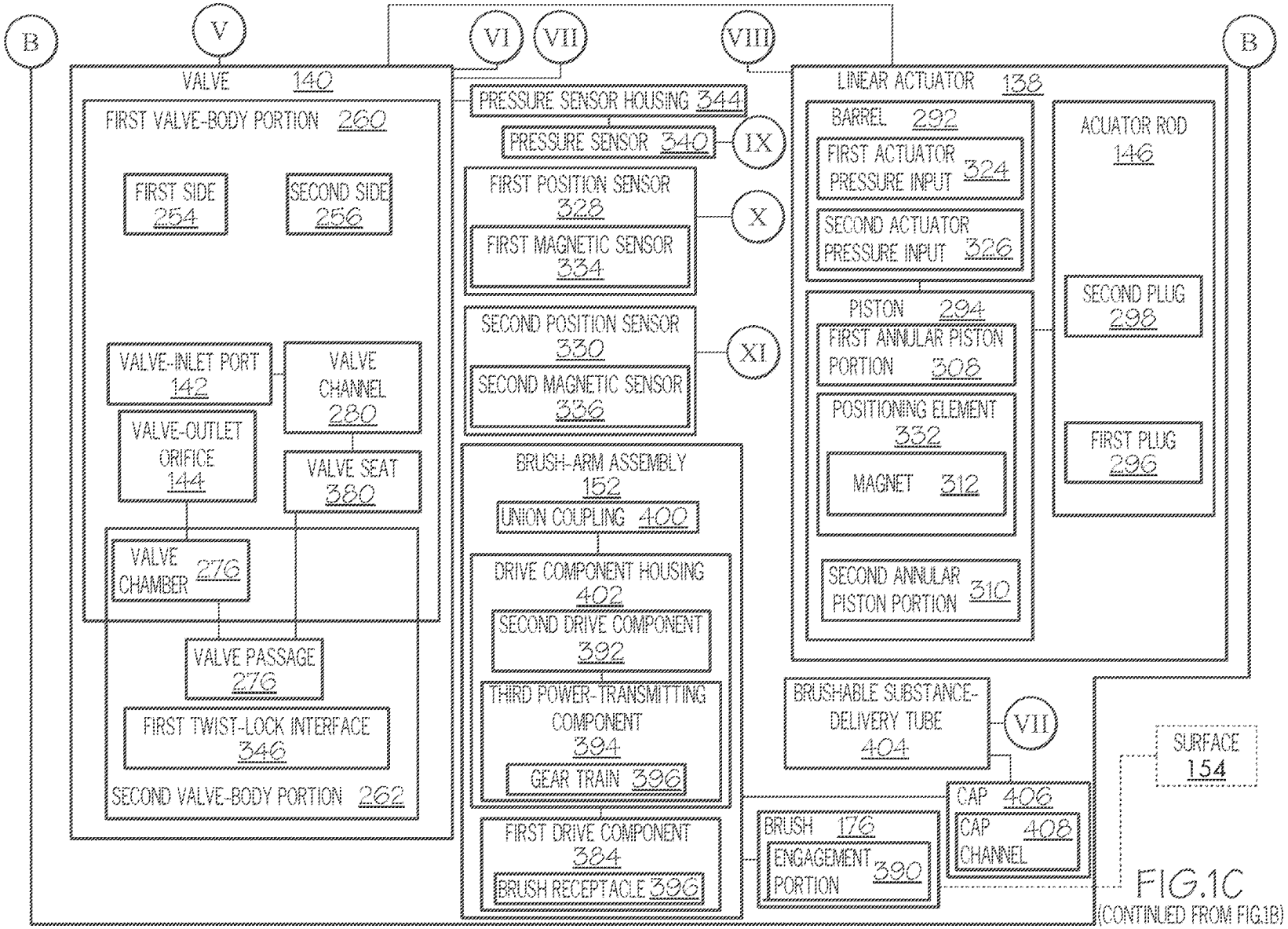
FIG.1C
(CONTINUED FROM FIG.1B)

METHODS FOR DISPENSING A BRUSHABLE SUBSTANCE ONTO A SURFACE

PRIORITY

This application is a divisional of U.S. Ser. No. 15/849,781 filed on Dec. 21, 2017.

TECHNICAL FIELD

The present disclosure relates to apparatuses and methods for dispensing a brushable substance onto a surface.

BACKGROUND

During assembly of a structure, such as an aircraft or a component thereof, a brushable substance must often be dispensed onto a surface of the structure. It is desirable to fully automate such application of the brushable substance to reduce cost and manufacturing lead time. However, space constraints, in many instances imposed by the geometry of the structure, make automating the dispensing of brushable substances difficult. For example, a robot may need to dispense the brushable substance onto a surface, located in a confined space within the structure, such as inside an airplane wing box that, at the tip, is only several inches high. Automated dispensing of brushable substances is further complicated by the fact that the robot must often enter the confined space through a small access port and must navigate around obstacles while manipulating an end effector to dispense the brushable substance onto desired locations along the surface of the structure.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter according to the invention relates to an apparatus for dispensing a brushable substance onto a surface. The apparatus comprises a bracket, configured to be removably coupled with a robot. The apparatus further comprises a sleeve, comprising an inner tubular sleeve wall and an outer tubular sleeve wall, circumscribing the inner tubular sleeve wall. The sleeve is coupled to the bracket and is rotatable relative to the bracket about a first axis. The apparatus also comprises a cartridge, comprising an inner tubular cartridge wall and an outer tubular cartridge wall, circumscribing the inner tubular cartridge wall. The apparatus additionally comprises a valve, configured to be communicatively coupled with the cartridge. The apparatus further comprises a brush-arm assembly, coupled to the sleeve. The apparatus also comprises a linear actuator to control flow of the brushable substance from the valve. The apparatus additionally comprises an annular plunger, positioned between the inner tubular cartridge wall and the outer tubular cartridge wall and movable along the first axis. The apparatus further comprises a twist-lock pressure cap, configured to be hermetically coupled with the cartridge. The cartridge is configured to be positioned between the inner tubular sleeve wall and the outer tubular sleeve wall. The cartridge is also configured to be positioned between the twist-lock pressure cap and the valve.

The apparatus provides for dispensing the brushable substance, from the cartridge, through the brush-arm assembly, onto the surface of a workpiece, for example, located in a confined space. The configuration of the sleeve and the cartridge reduces the size requirements for storage of the brushable substance and enables the linear actuator and a portion of the valve to be located, or housed, within the sleeve. The twist-lock pressure cap enables pressurization of an interior volume located within the cartridge, which drives the annular plunger. Rotation of the sleeve controls an angular orientation of the brush-arm assembly relative to the bracket and the surface during dispensing of the brushable substance. The valve being communicatively coupled directly to cartridge enables a reduction of the brushable substance wasted, for example, during replacement of the cartridge and/or a purging operation.

Another example of the subject matter according to the invention relates to a method of dispensing a brushable substance onto a surface. The method comprises, (1) with a cartridge positioned inside a sleeve between an inner tubular sleeve wall and an outer tubular sleeve wall, circumscribing the inner tubular sleeve wall, and also positioned between a twist-lock pressure cap, hermetically coupled with the cartridge, and a valve, communicatively coupled with the cartridge, linearly moving an annular plunger, received between an inner tubular cartridge wall and an outer tubular cartridge wall, circumscribing the inner tubular cartridge wall, toward the valve along a first axis to urge the brushable substance from the cartridge, through the valve, and to a brush that is communicatively coupled to the valve and (2) controlling flow of the brushable substance from the valve to the brush.

The method provides for dispensing the brushable substance, from the cartridge, through the brush-arm assembly, to the surface of a workpiece, for example, located in a confined space. The configuration of the sleeve and the cartridge reduces the size requirements for storage of the brushable substance and allows the linear actuator and a portion of the valve to be located within the sleeve. The twist-lock pressure cap enables pressurization of an internal volume located within the cartridge, which drives the annular plunger. Rotation of the sleeve controls an angular orientation of the brush-arm assembly relative to the bracket and the surface. The valve being communicatively coupled directly to cartridge enables a reduction of the brushable substance wasted, for example, during replacement of the cartridge and/or a purging operation.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

Figure 1A:
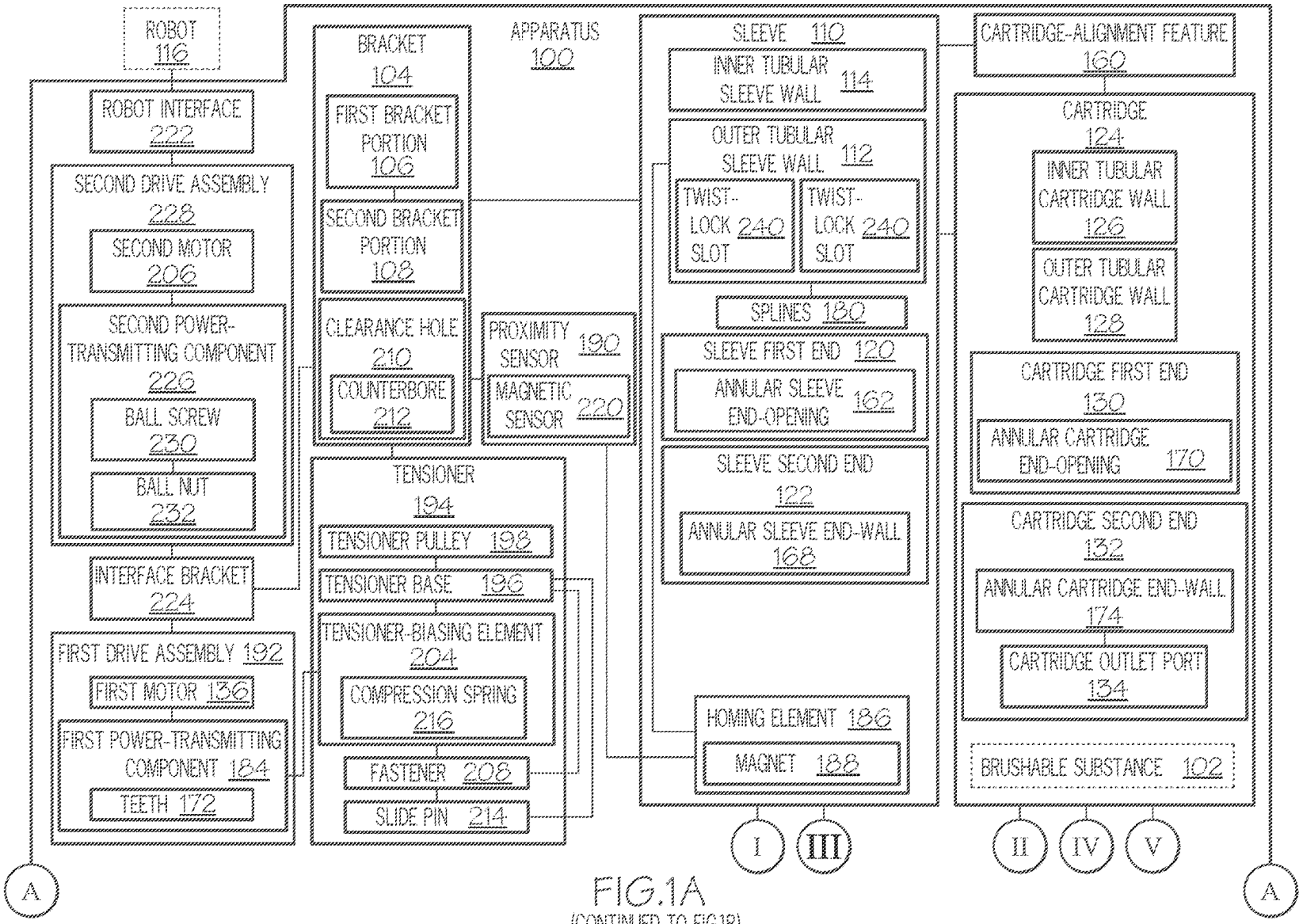
Figure 2:
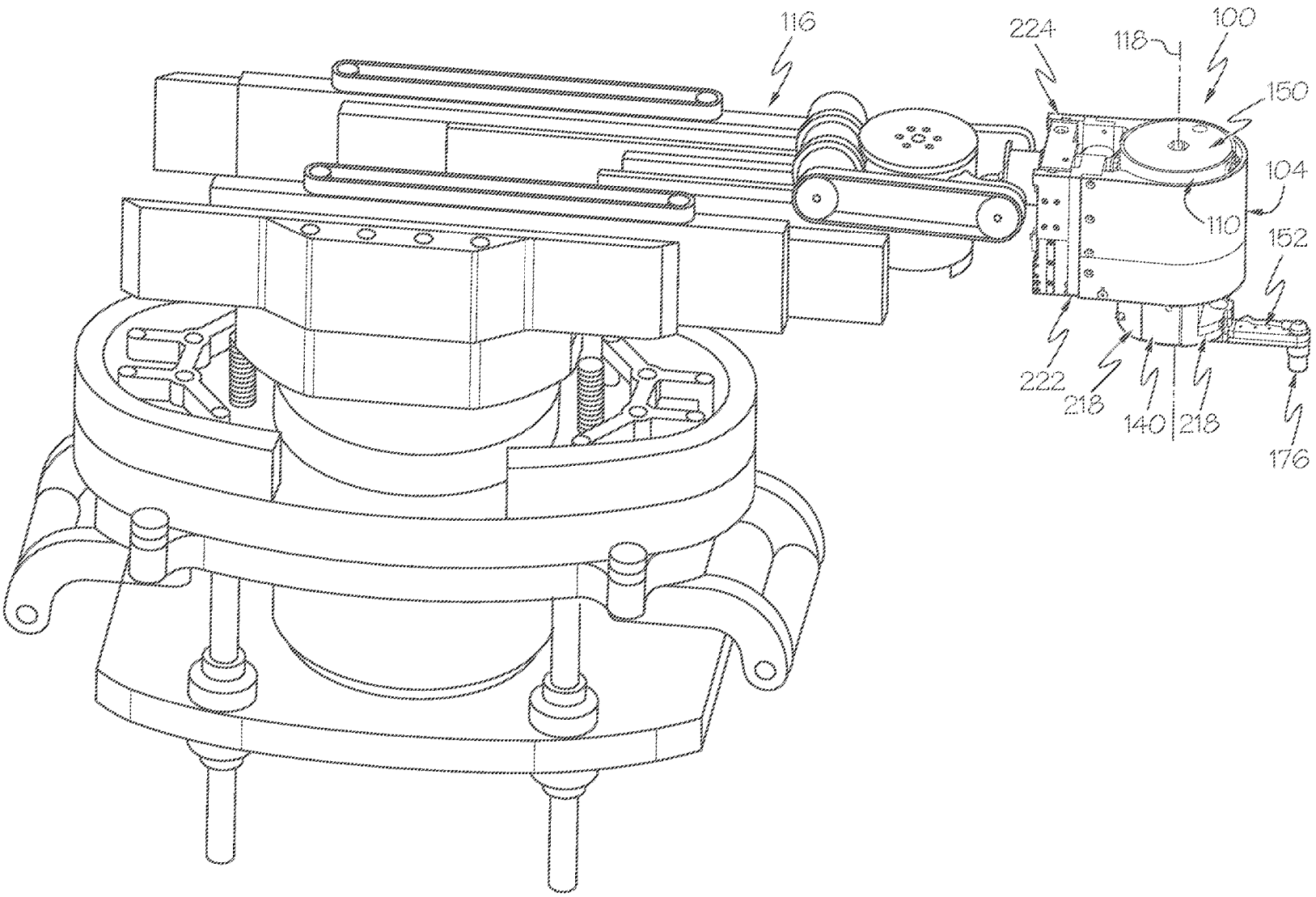
Figure 3:
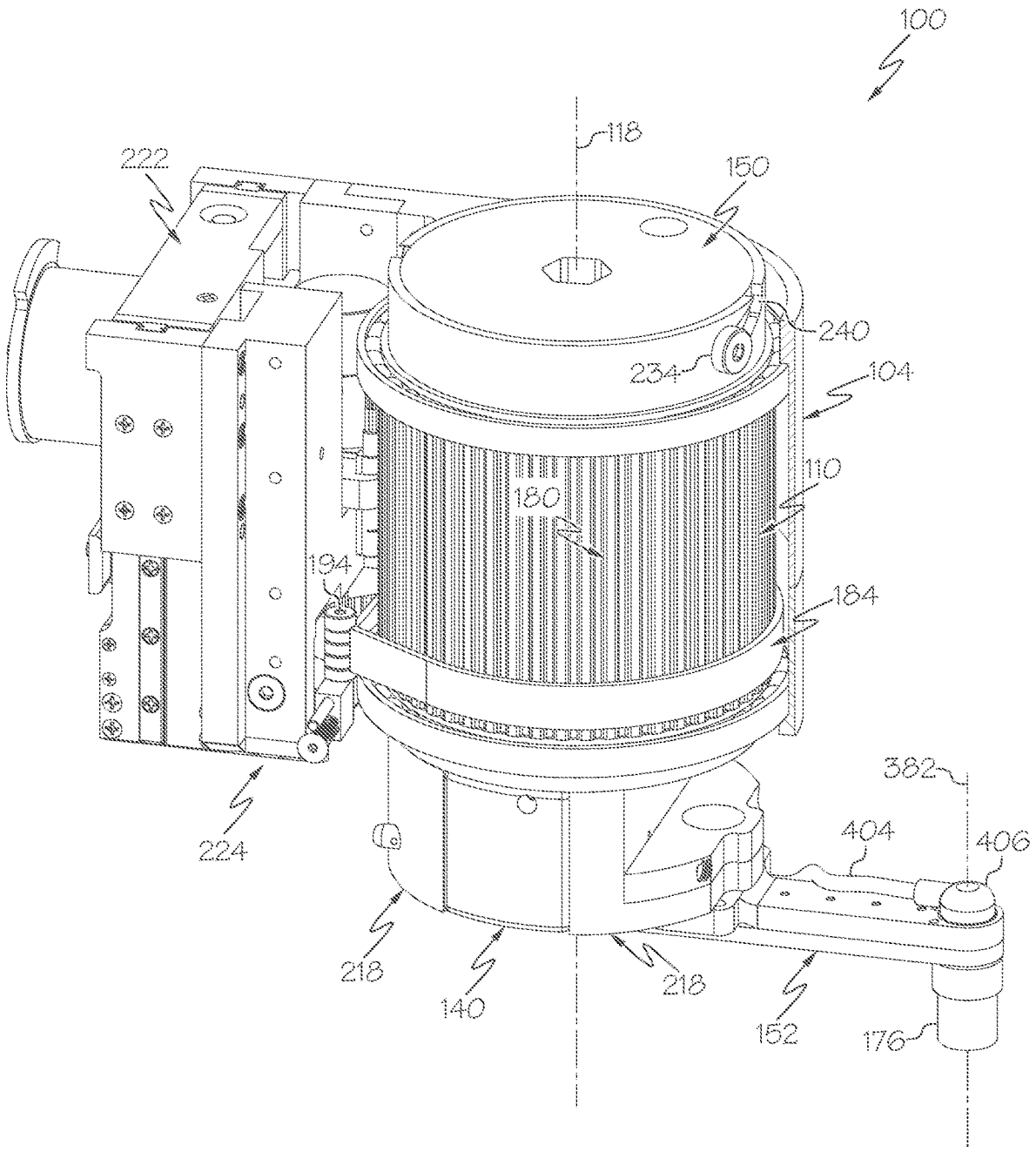
Figure 4:
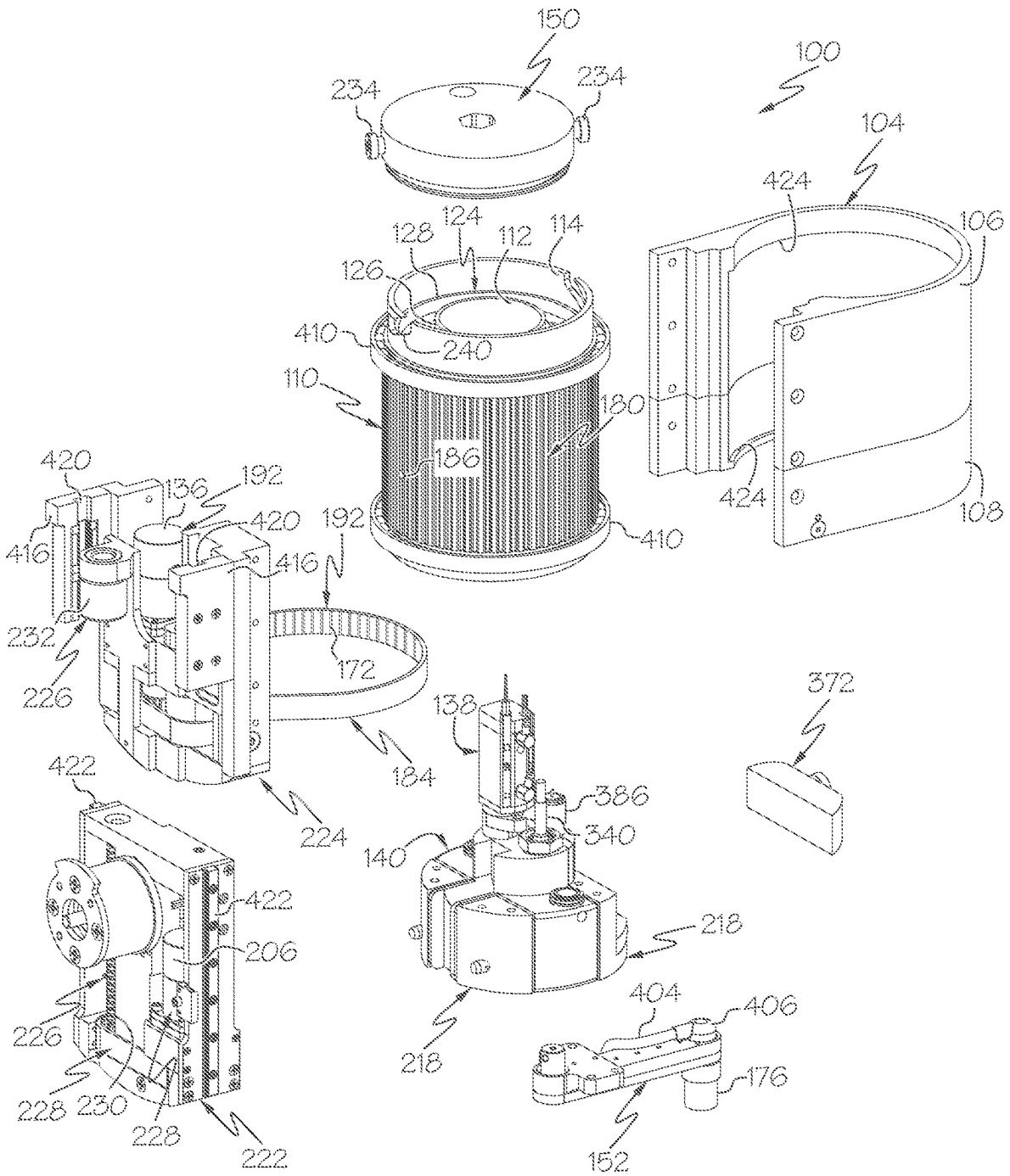
Figure 5:
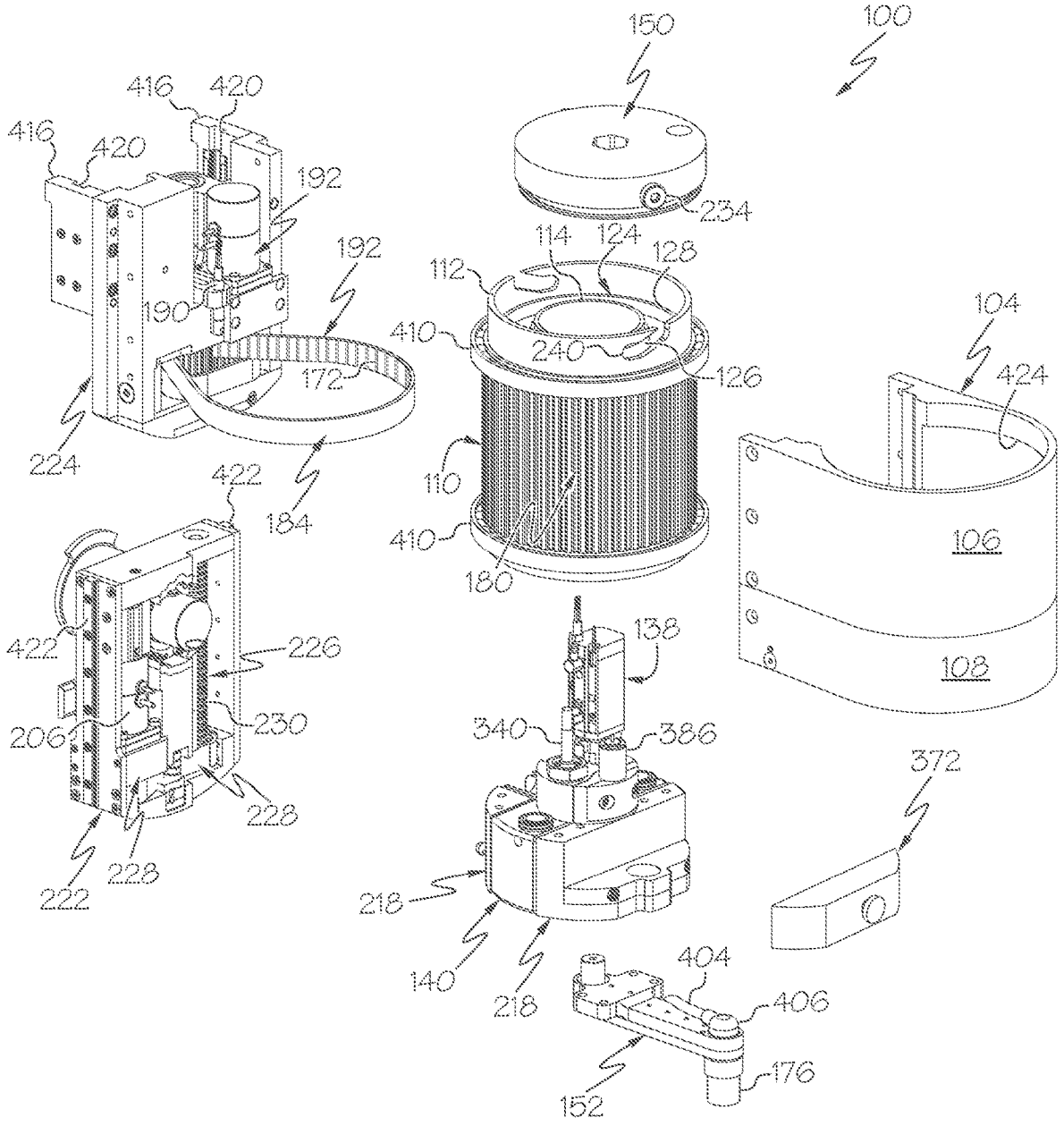
Figure 6:
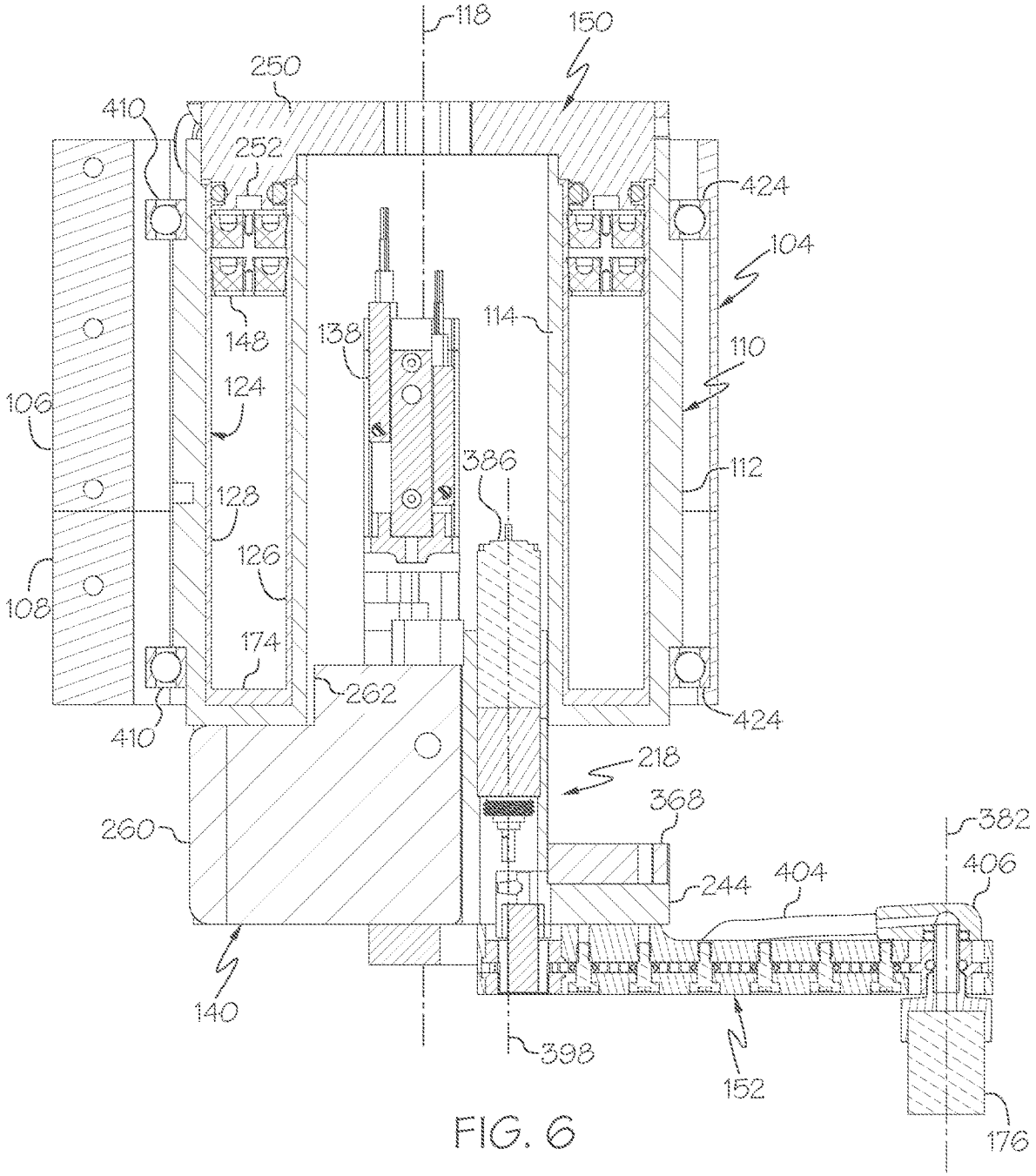
Figure 7:
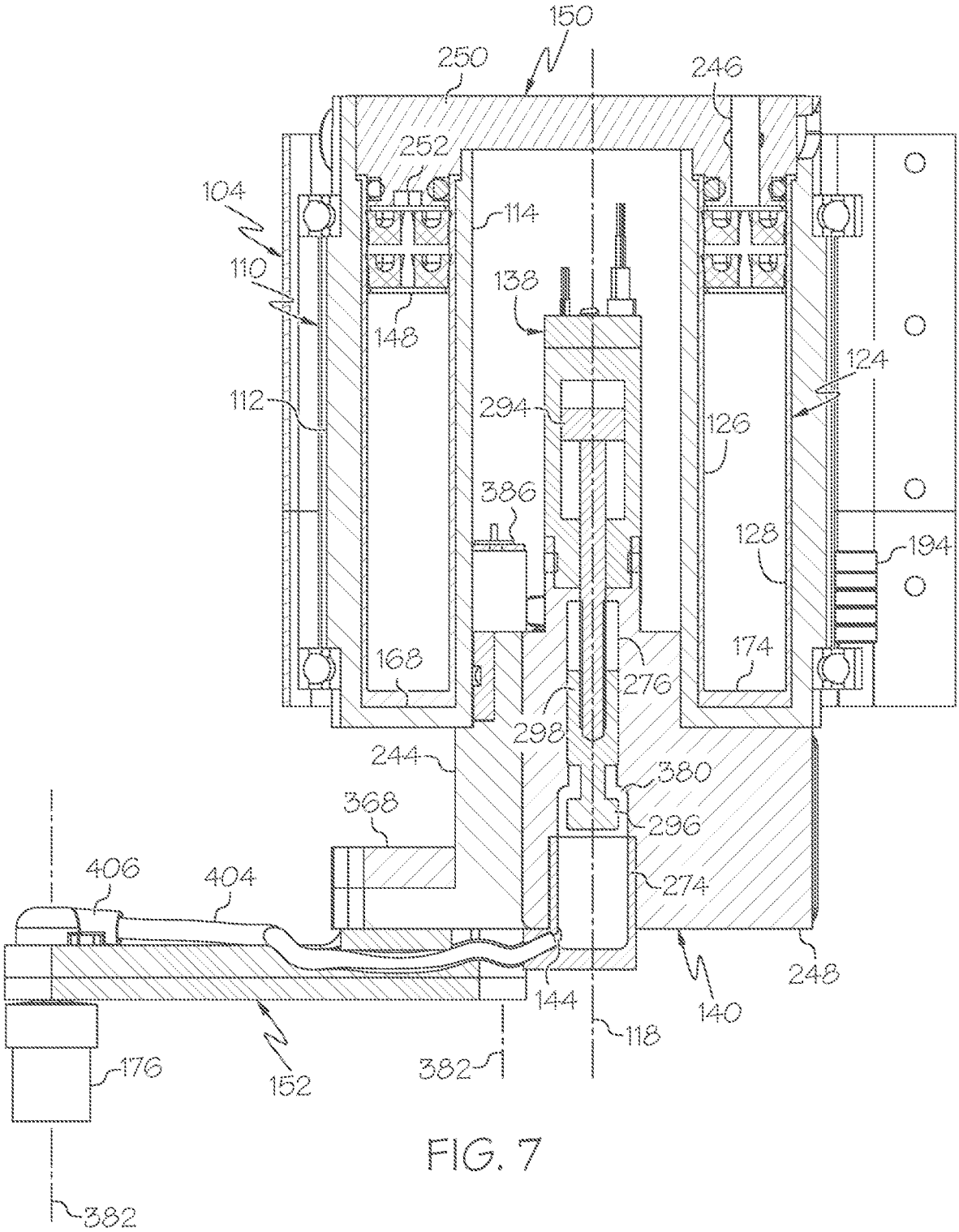
Figure 8:
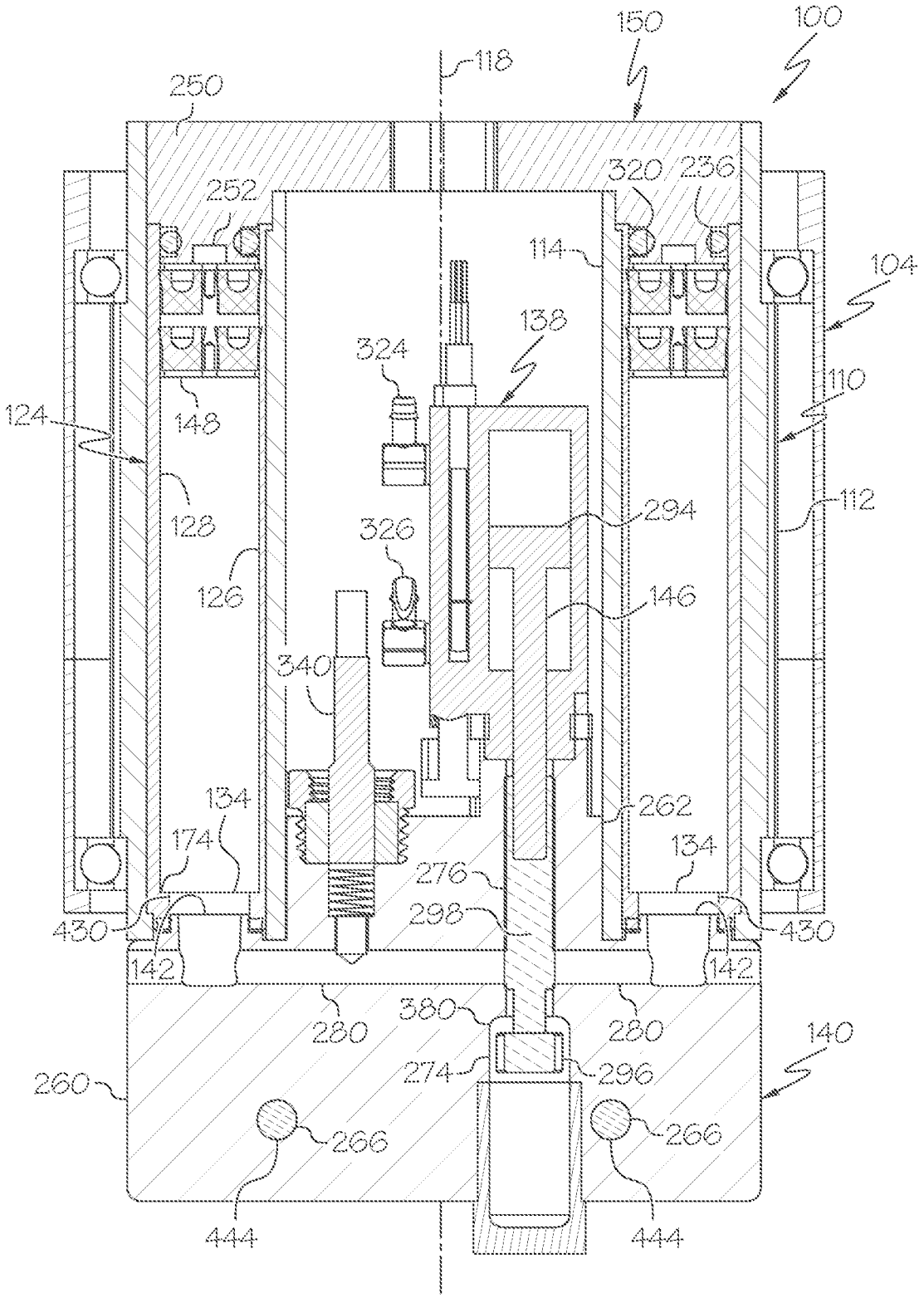
Figure 9:
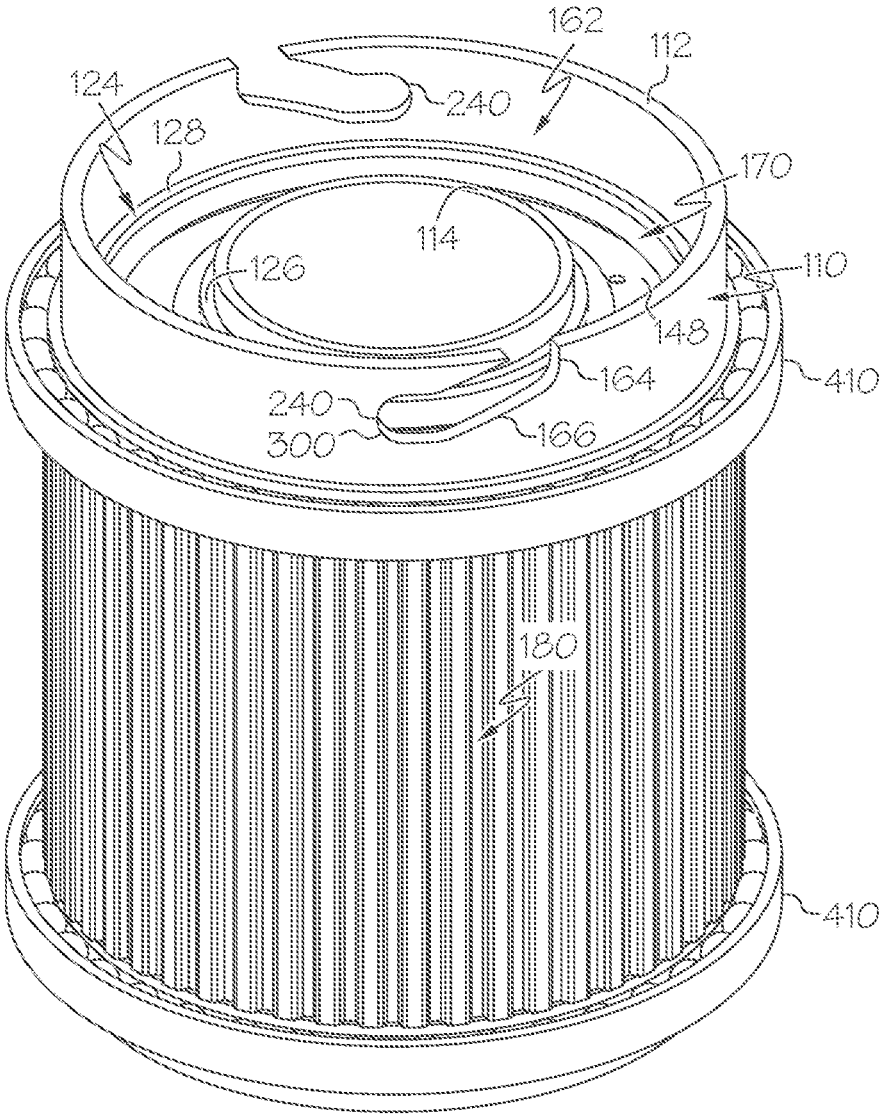
Figure 10:
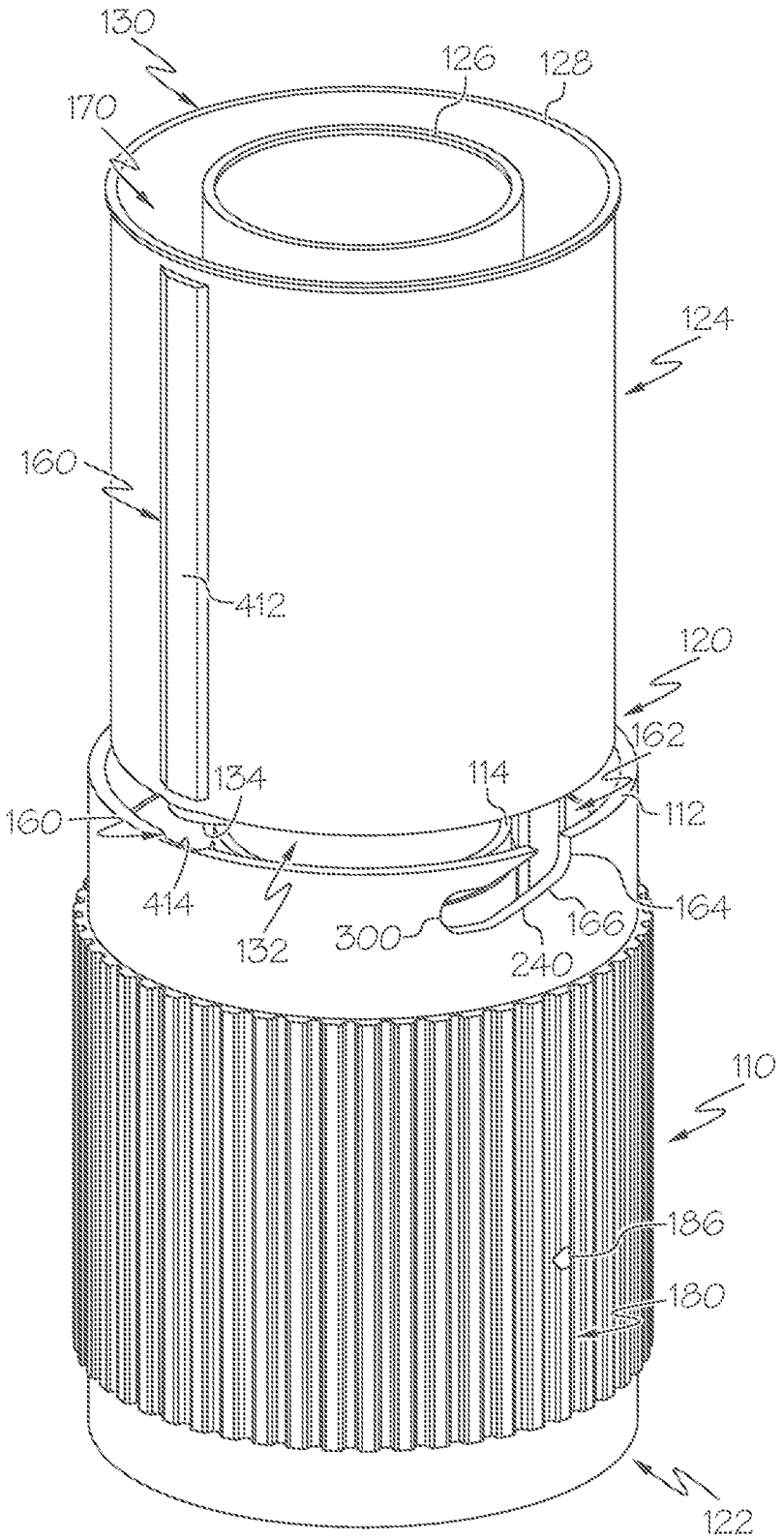
Figure 11:
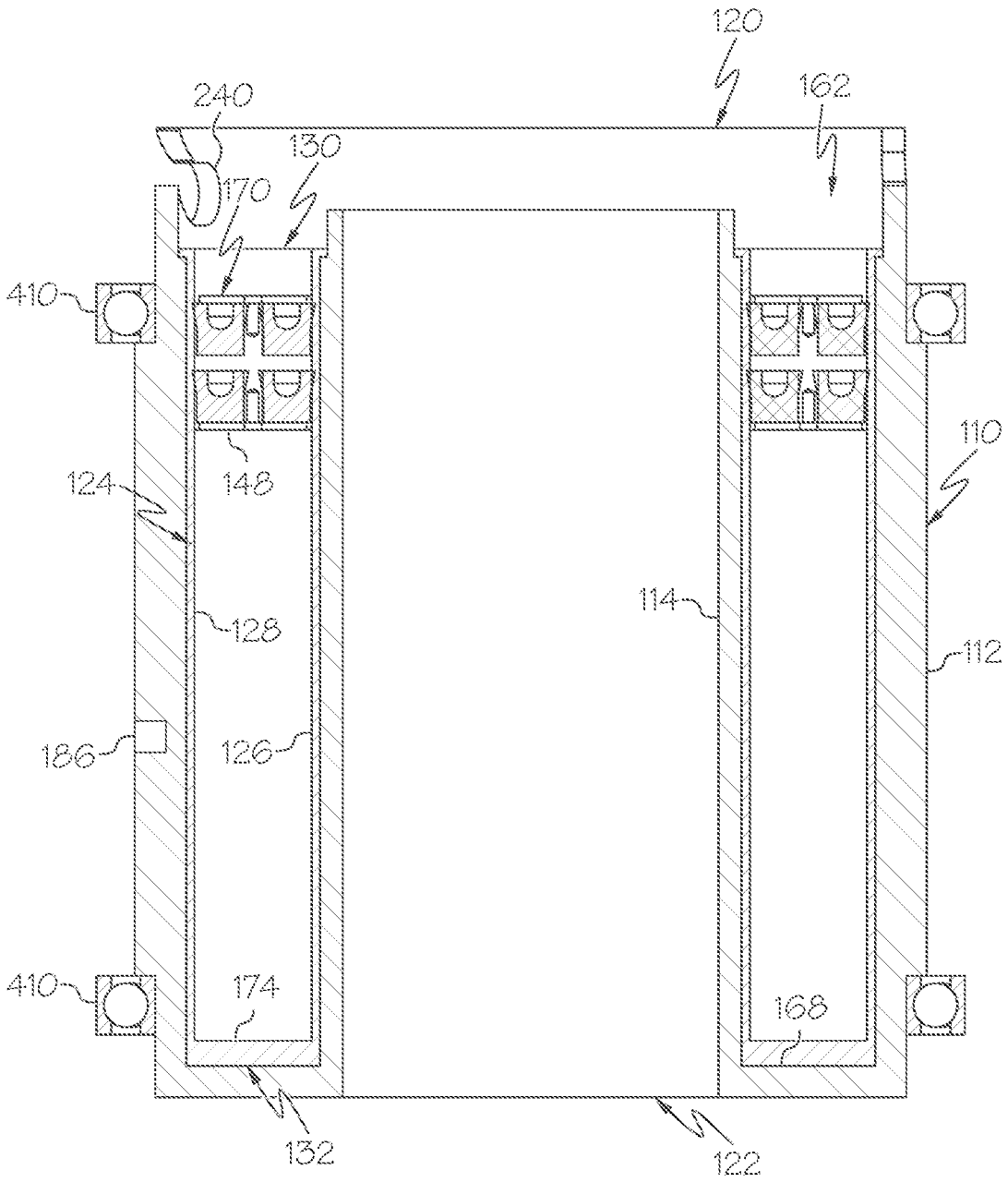
Figure 12:
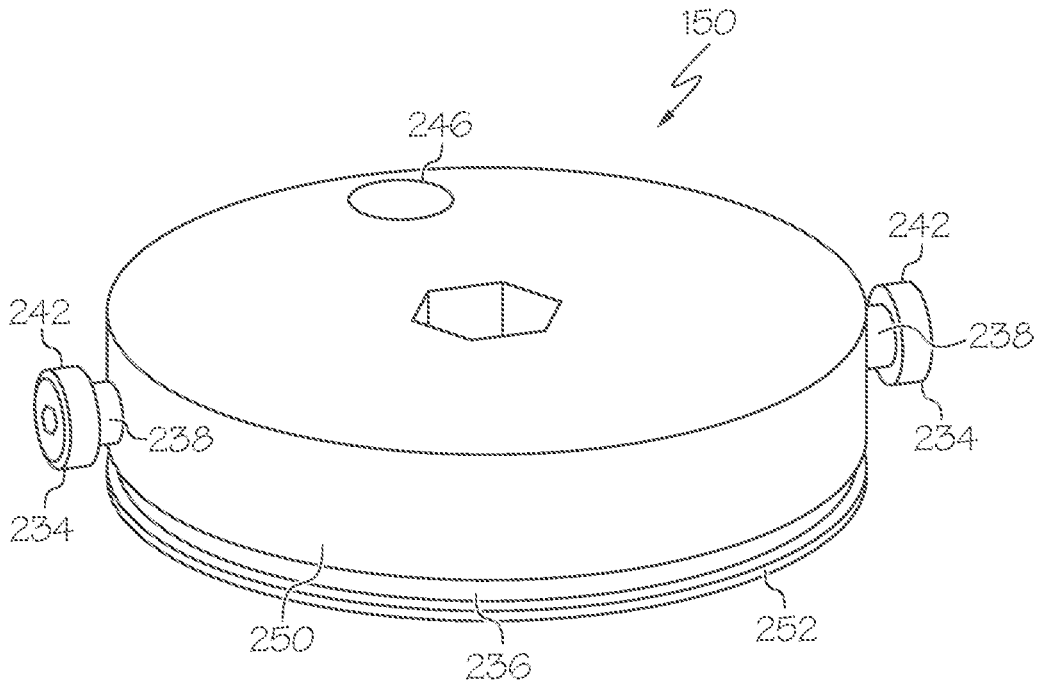
Figure 13:
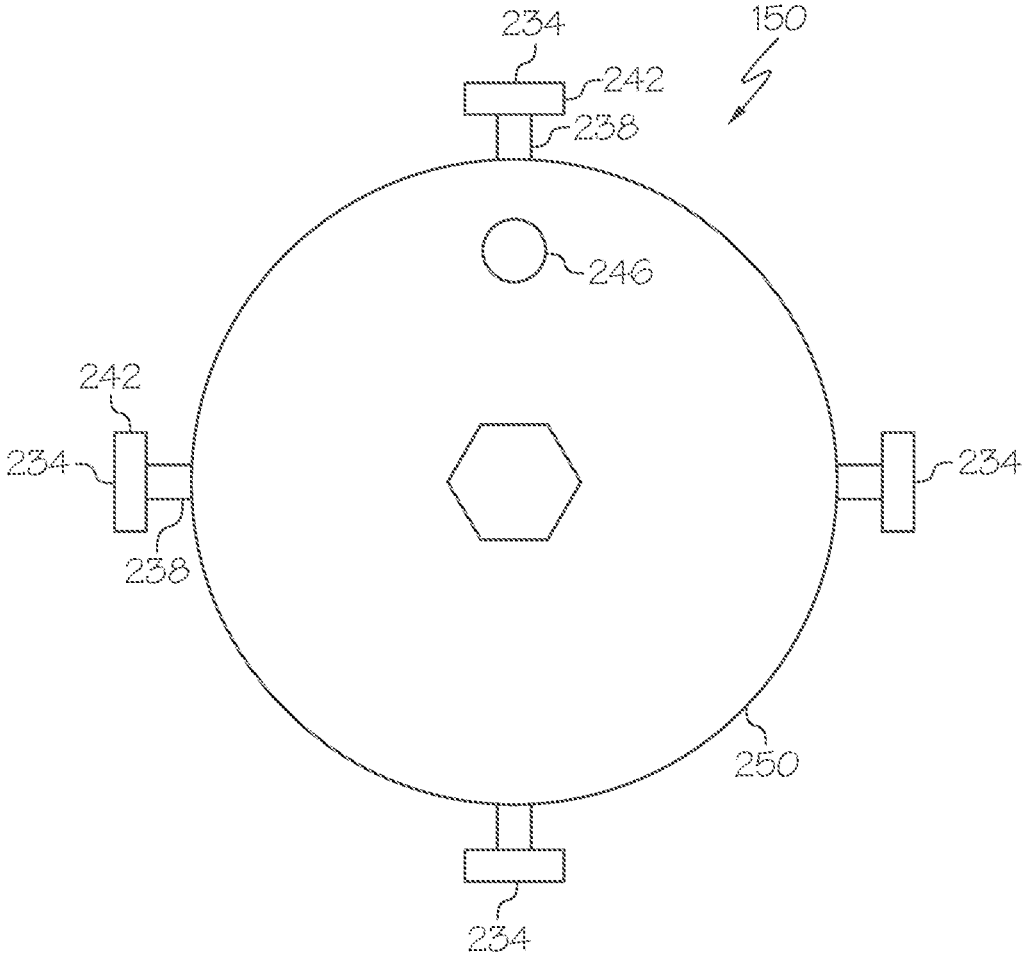
Figure 14:
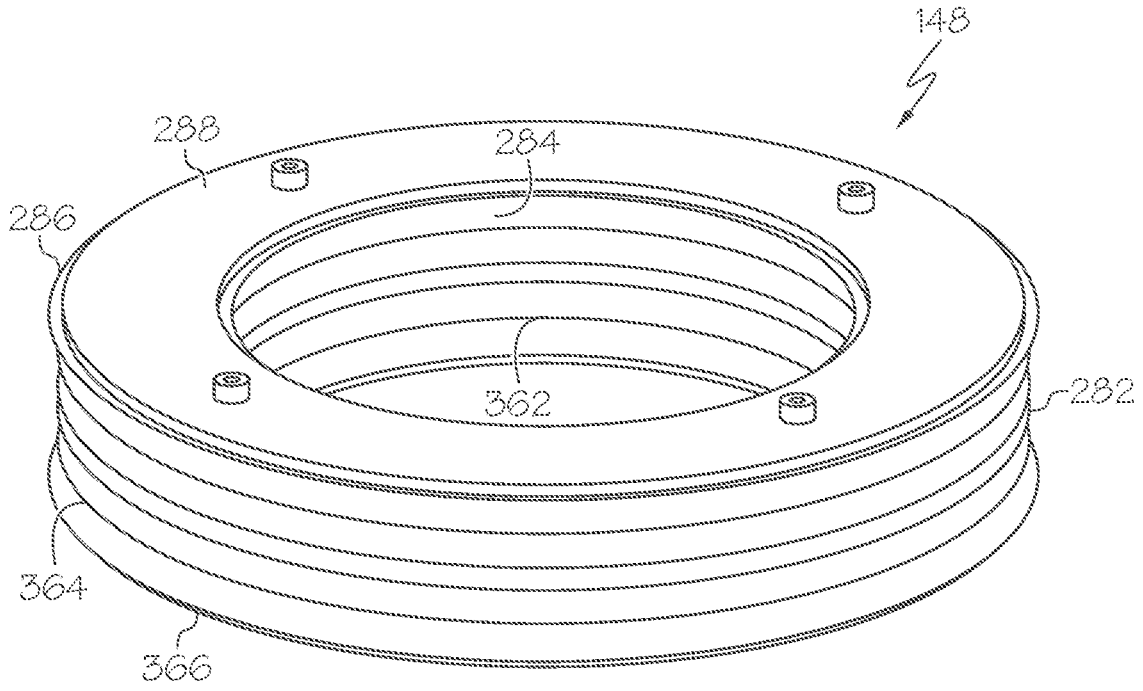
Figure 15:
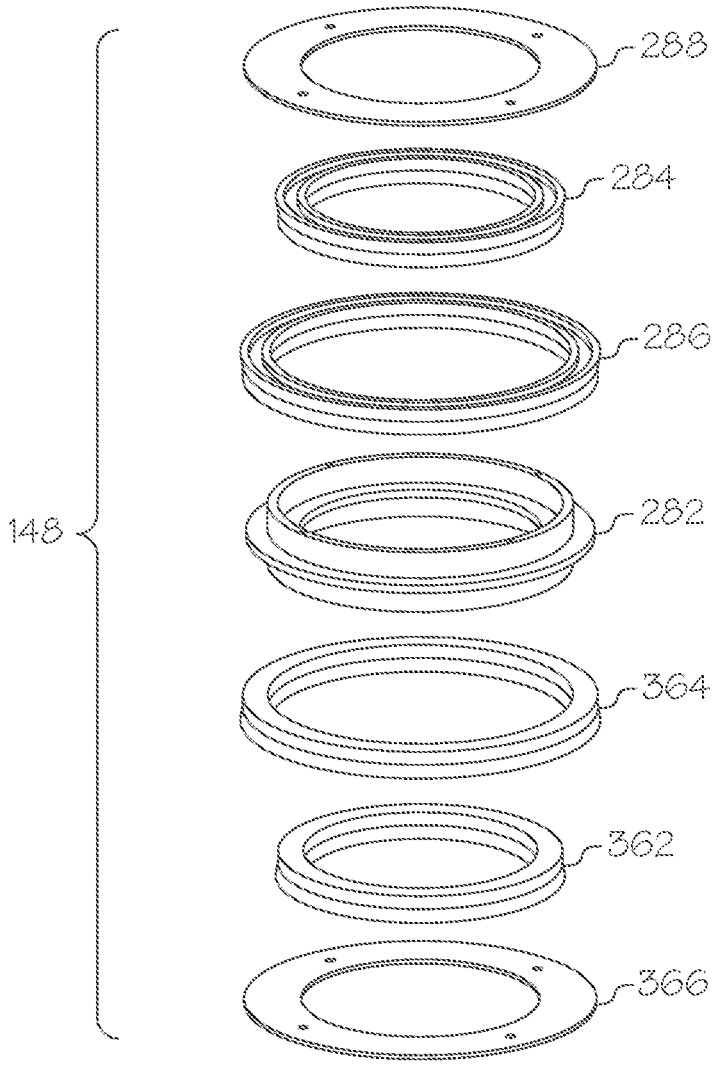
Figure 16:
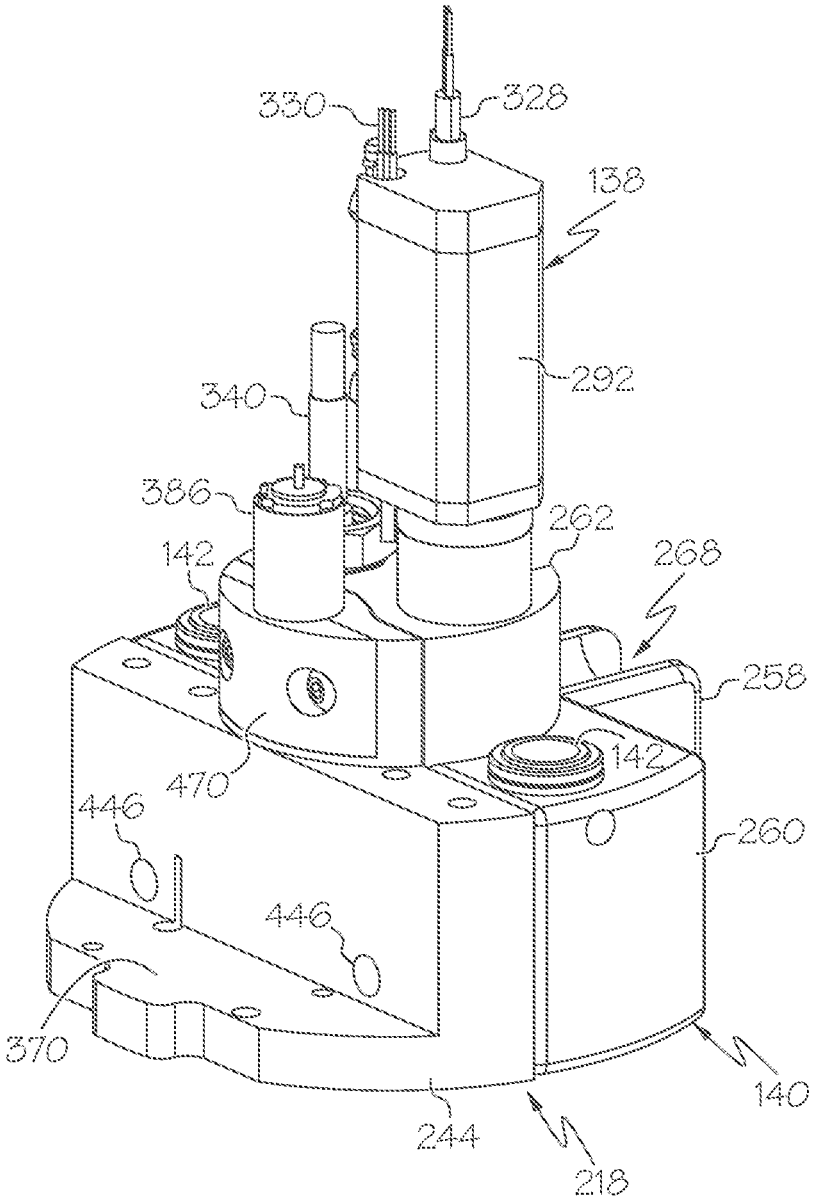
Figure 17:
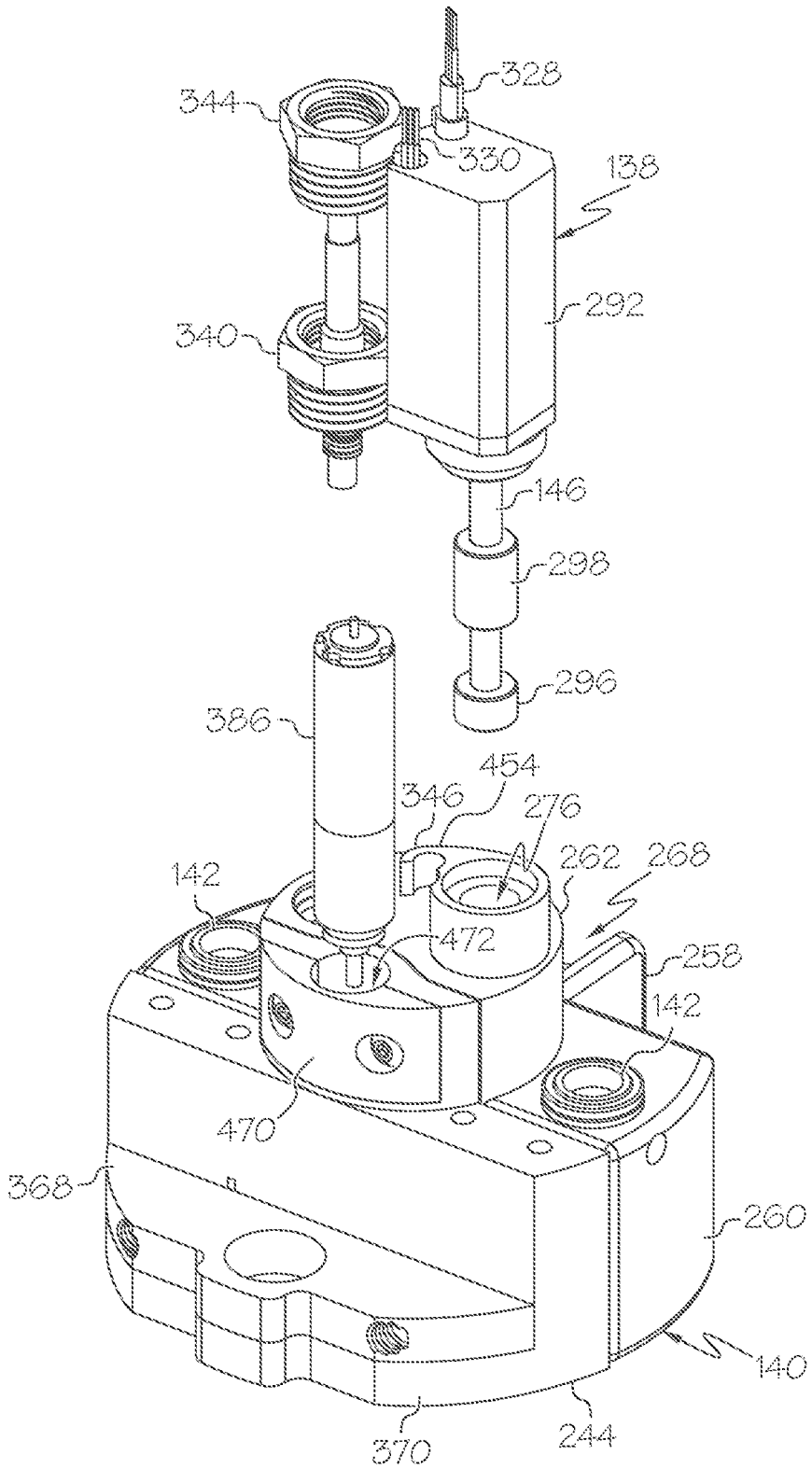
Figure 18:
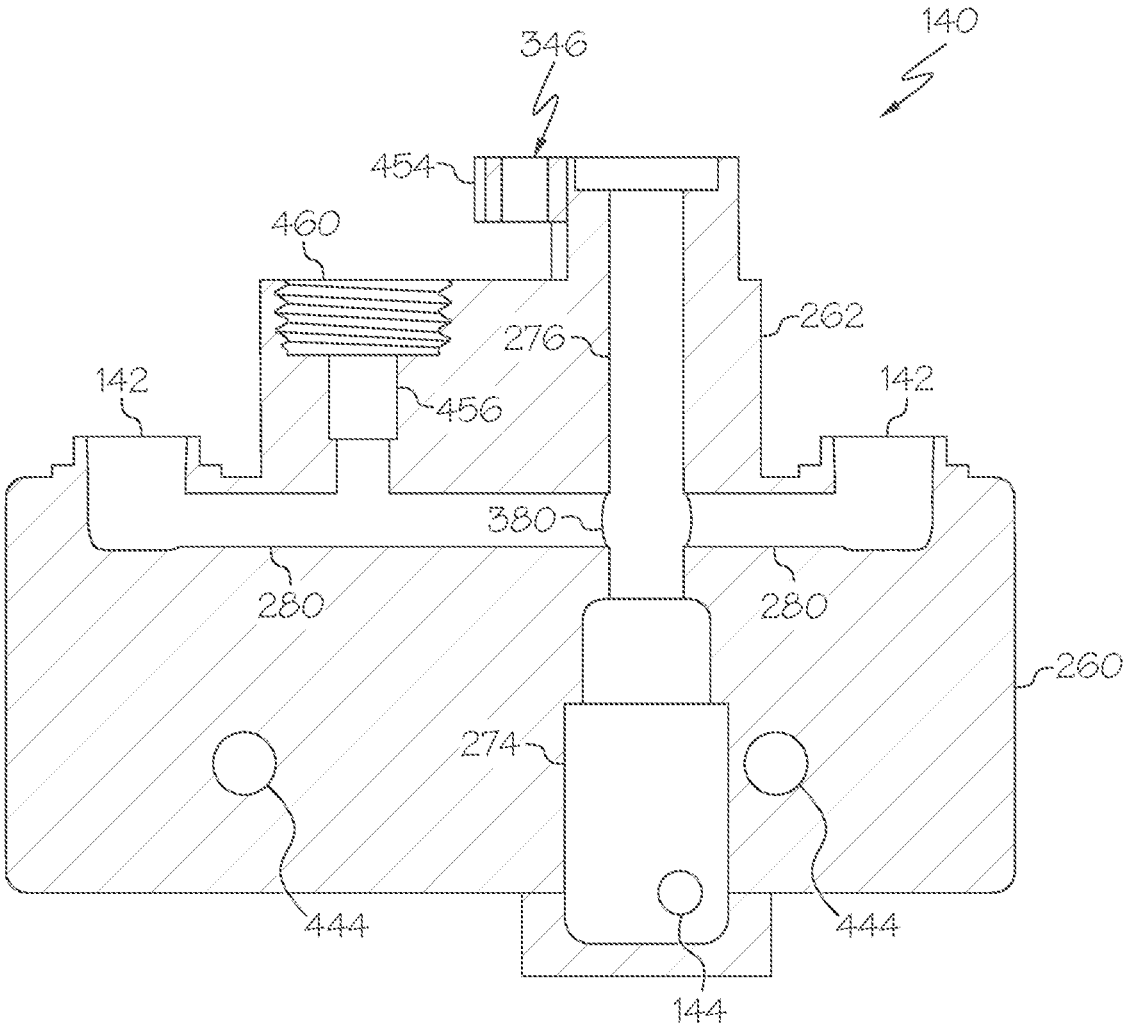
Figure 19:
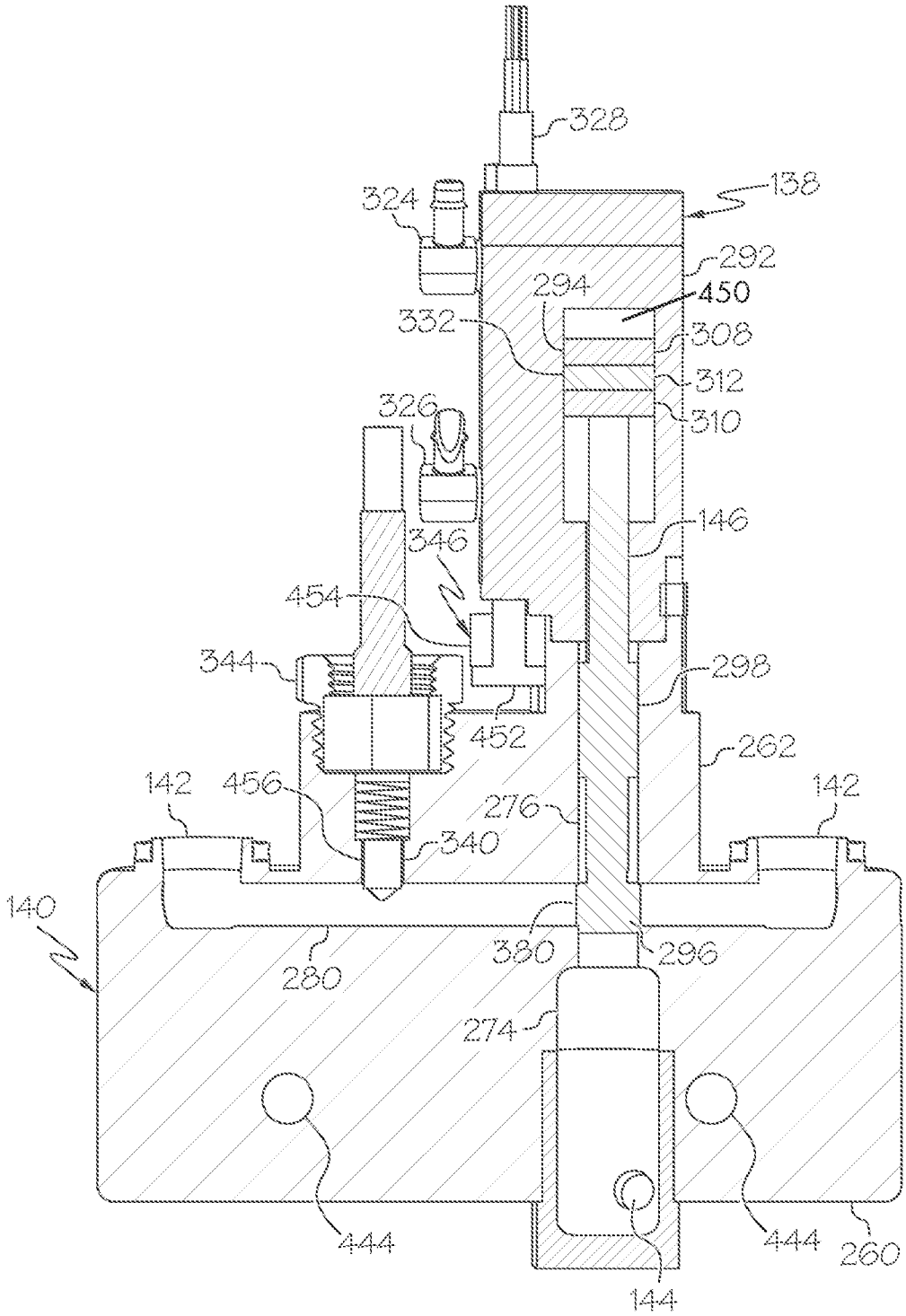
Figure 20:
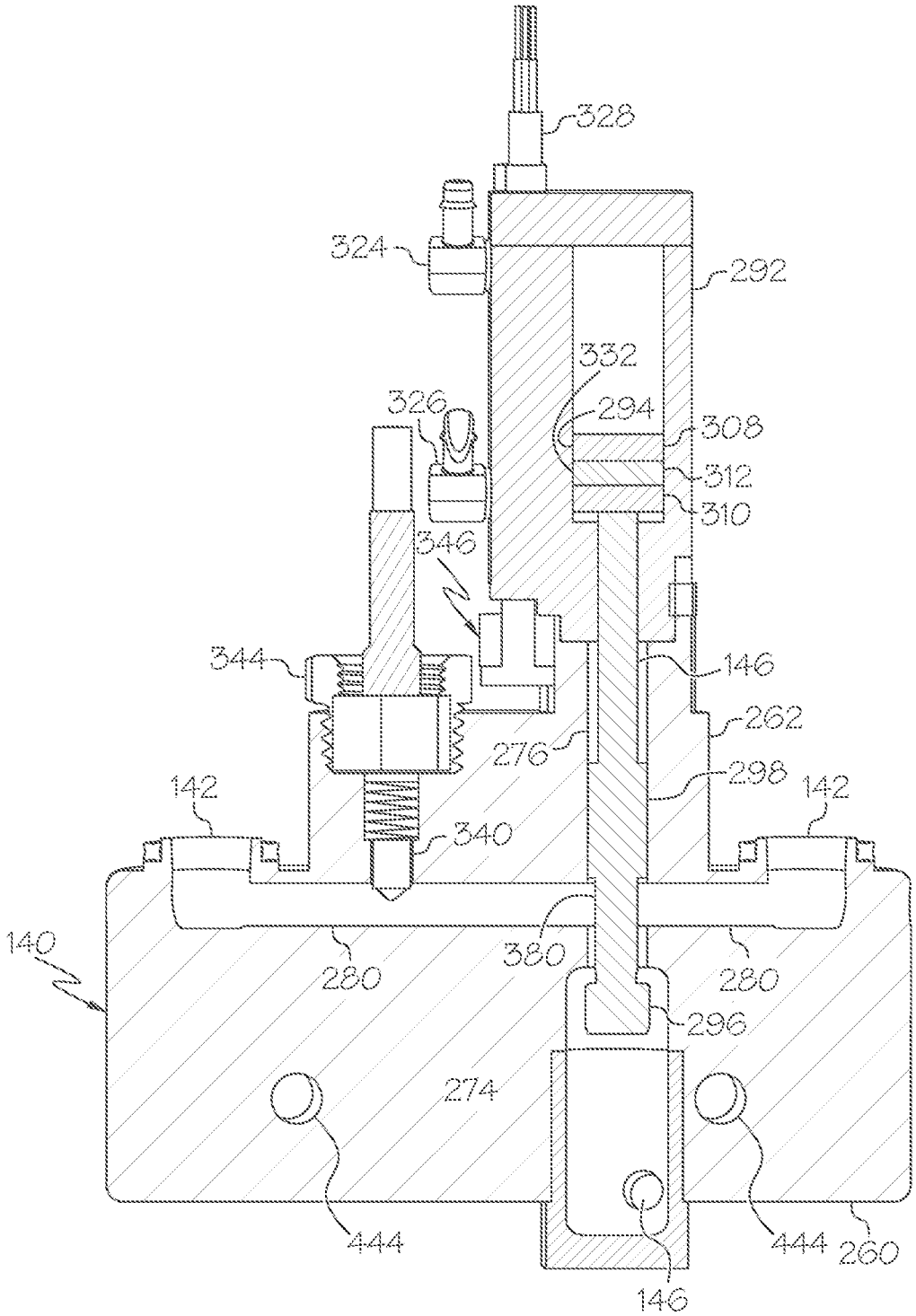
Figure 21:
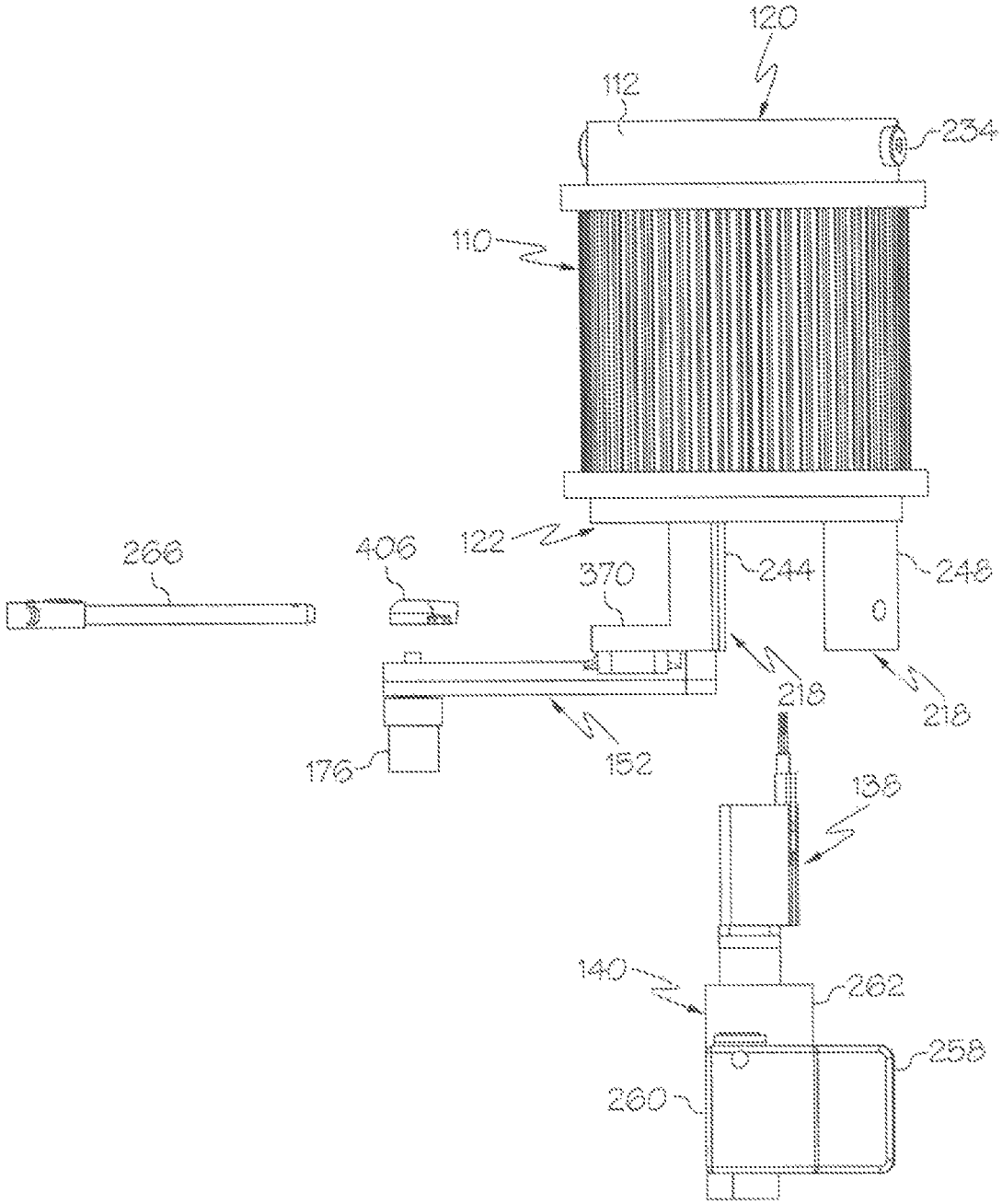
Figure 22:
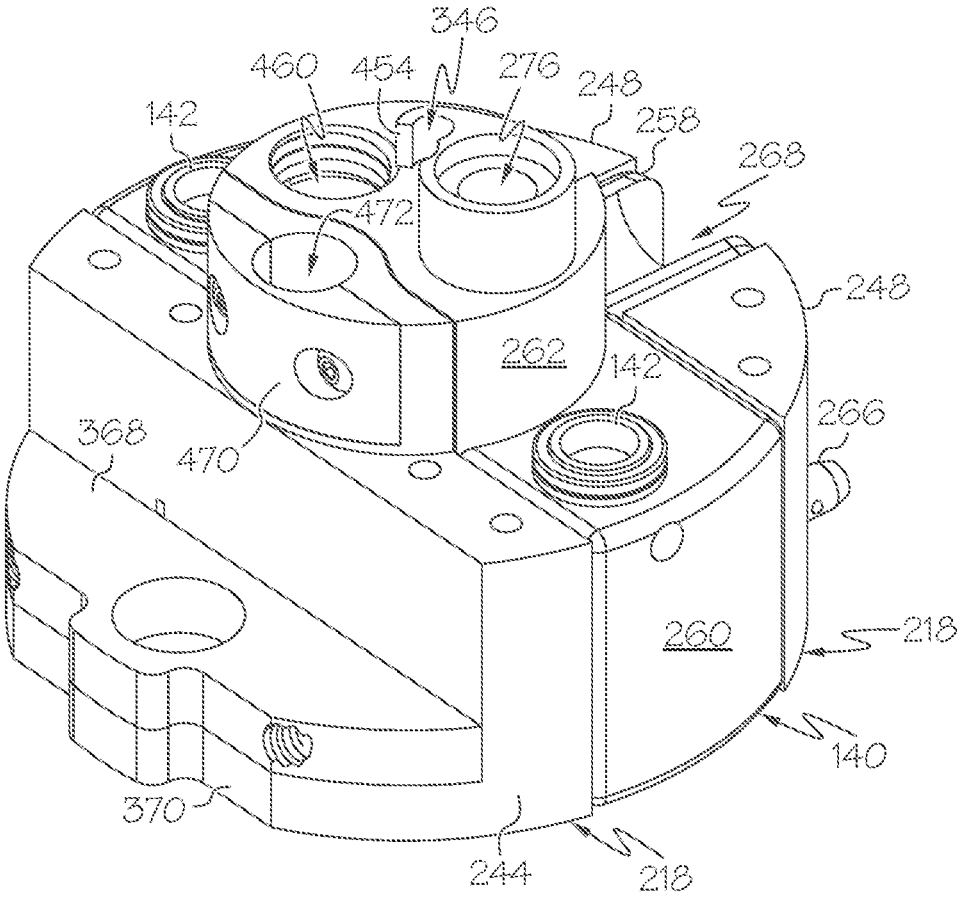
Figure 23:
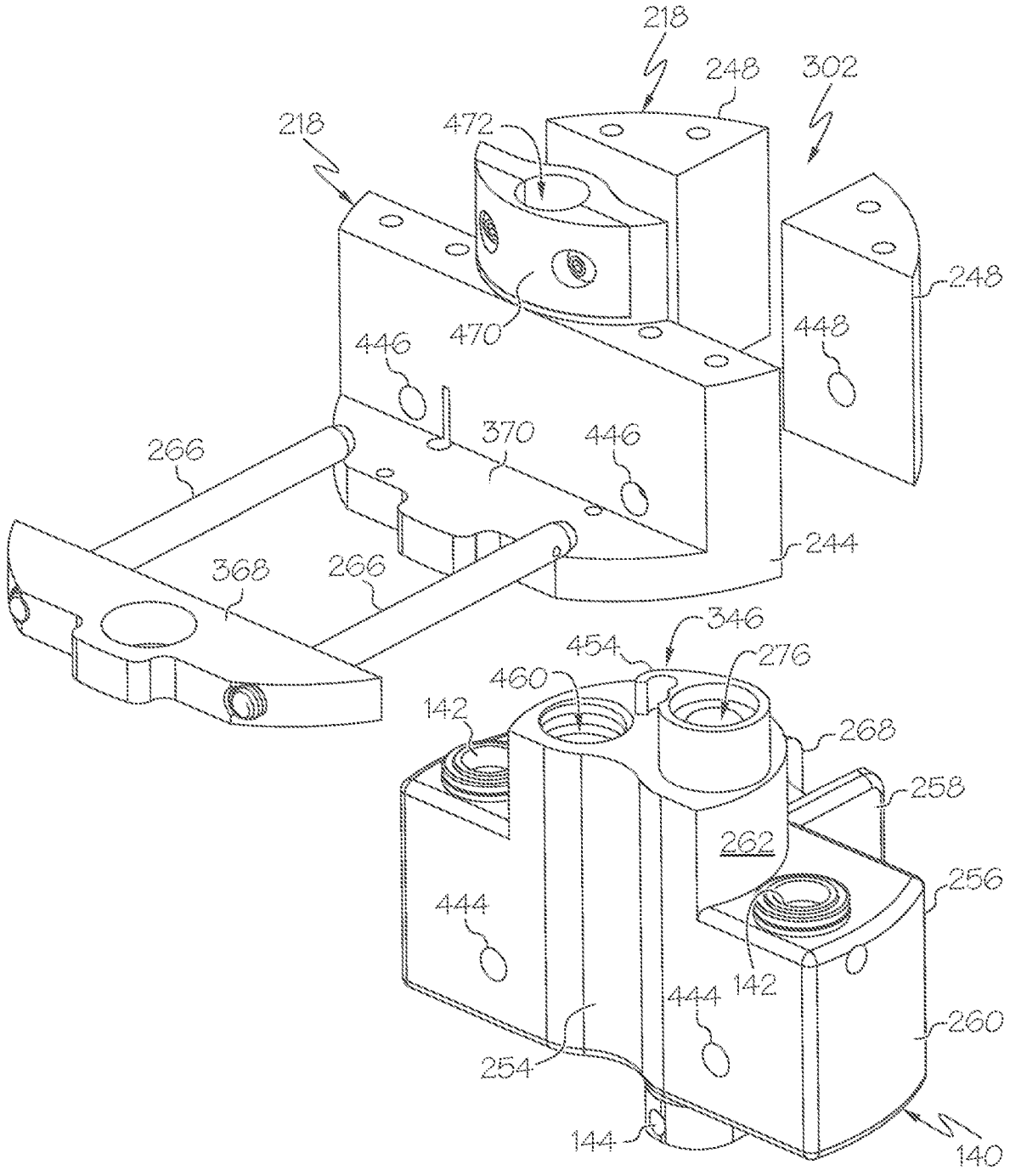
Figure 24:
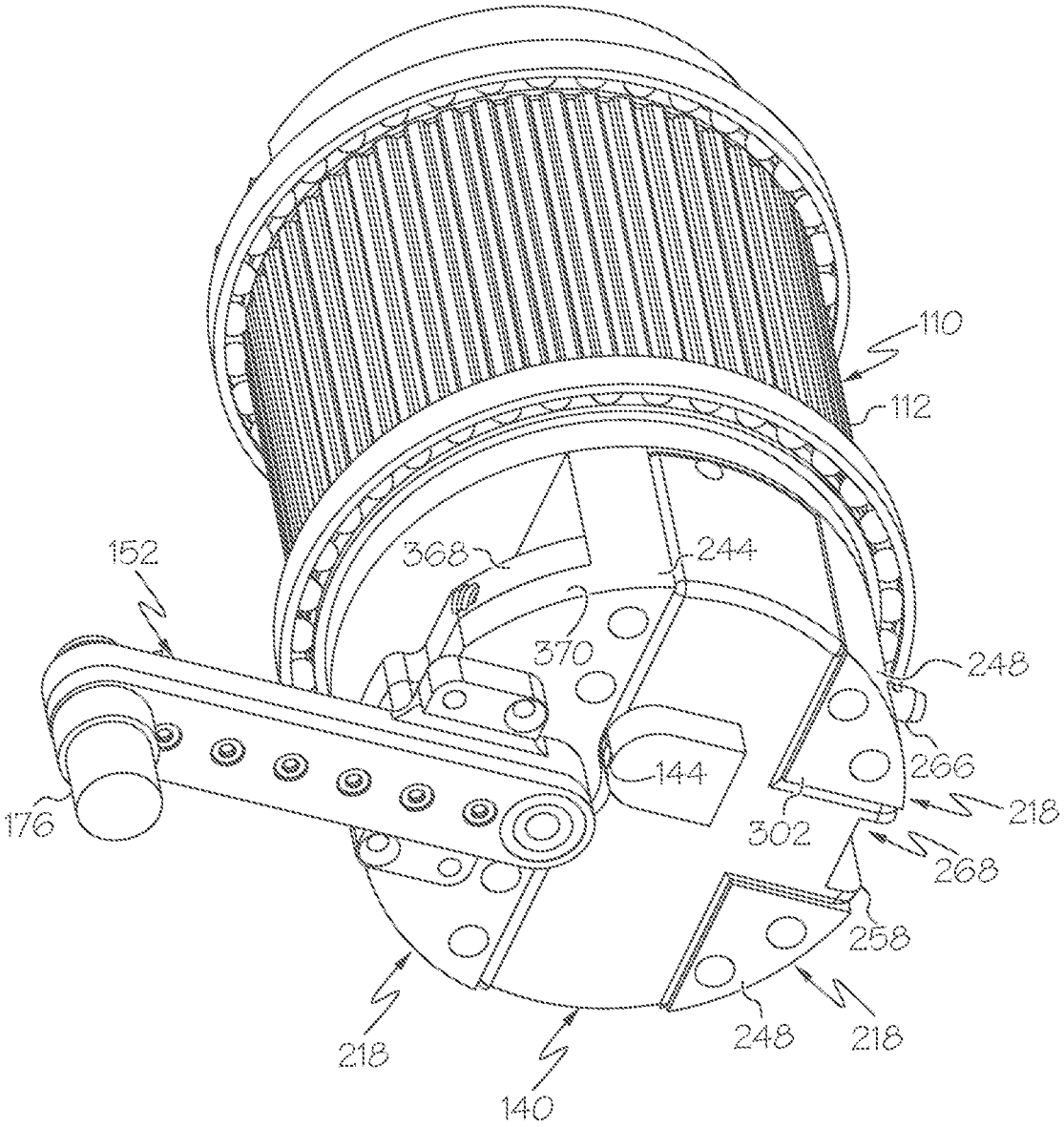
Figure 25:
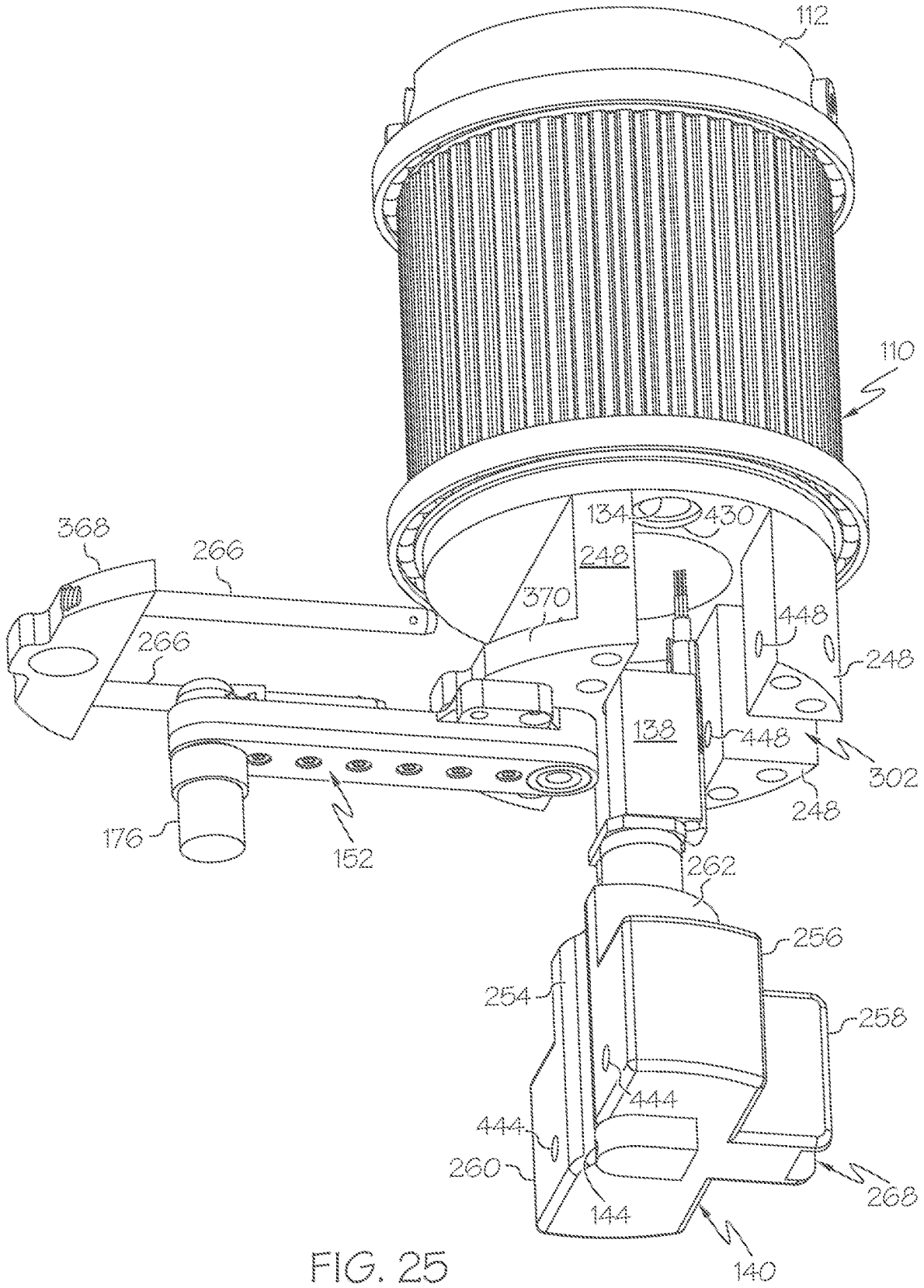
Figure 26:
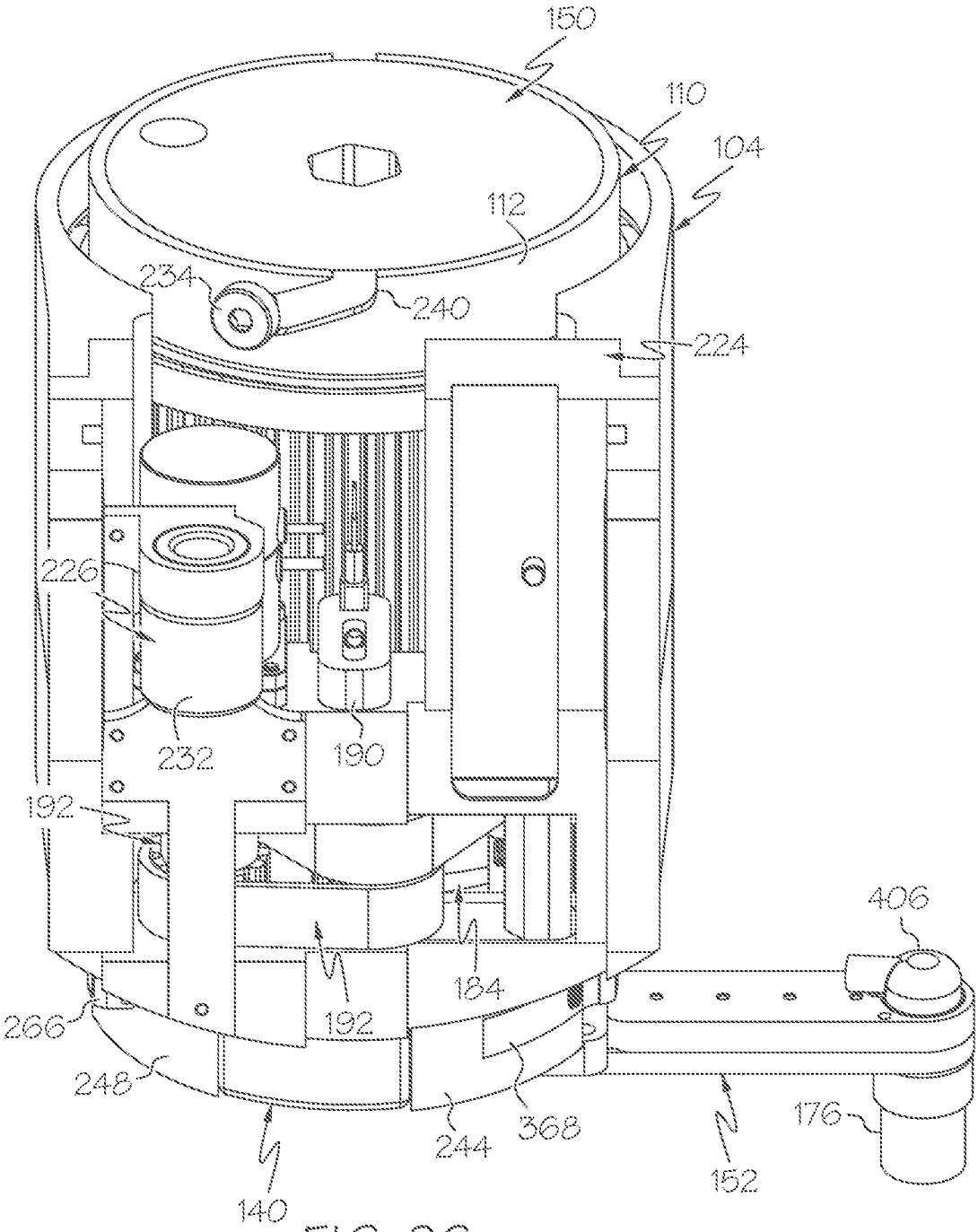
Figure 27:
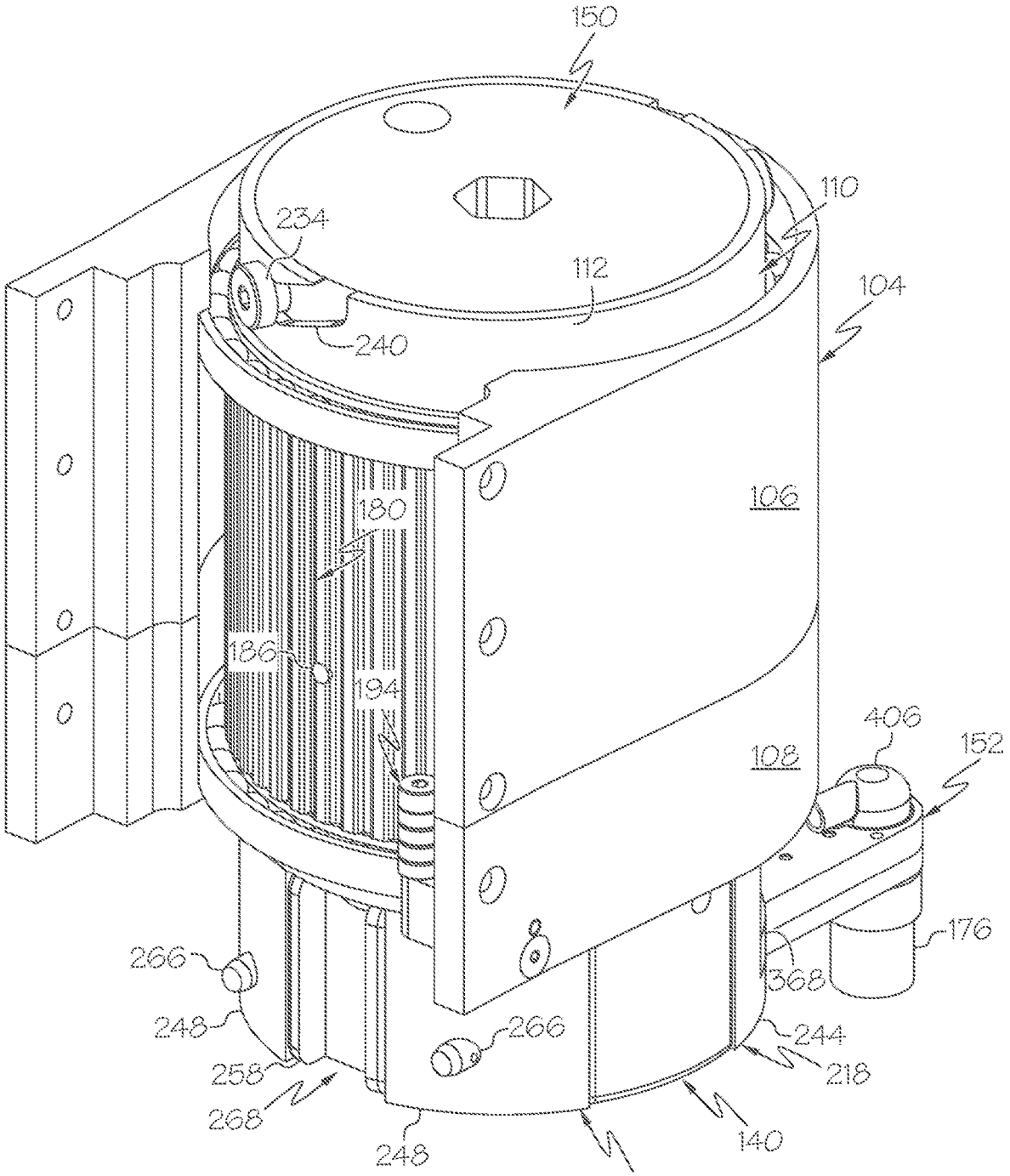
Figure 28:
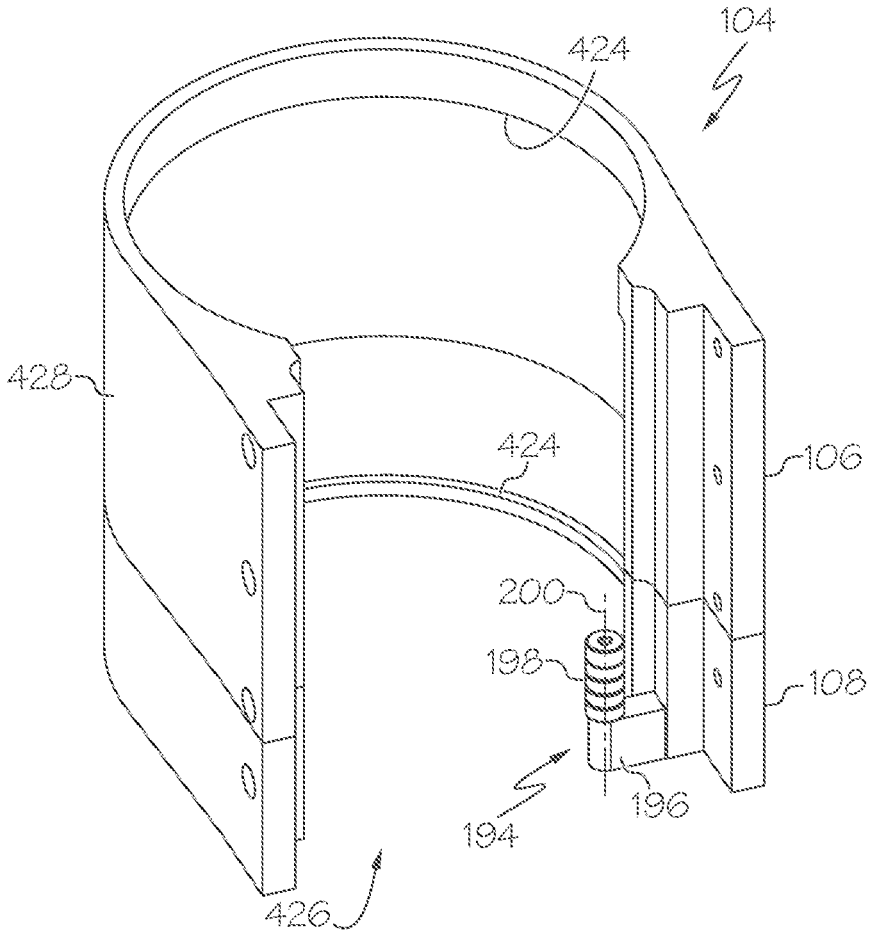
Figure 29:
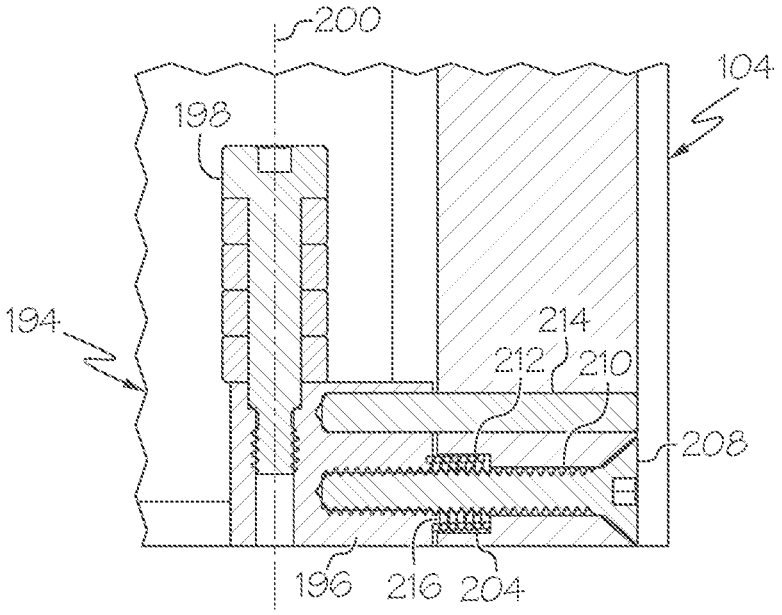
Figure 30:
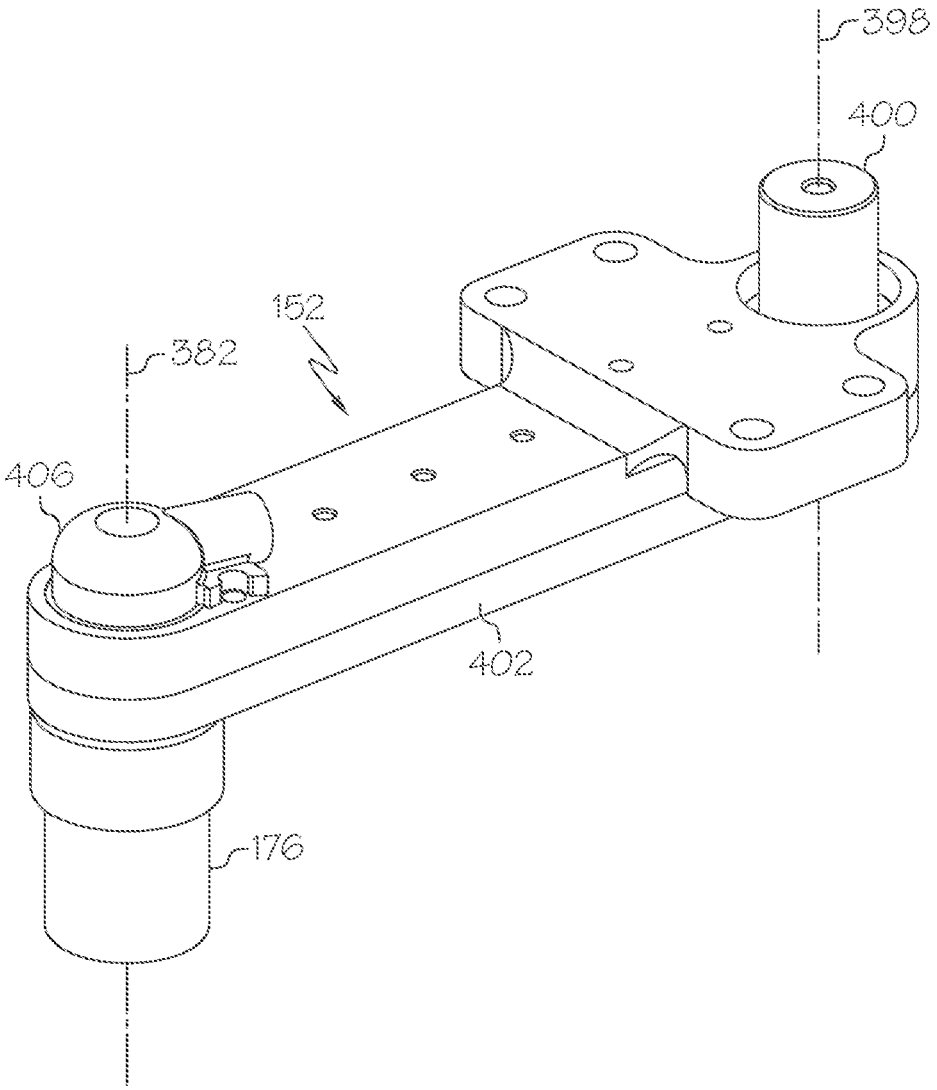
Figure 31:
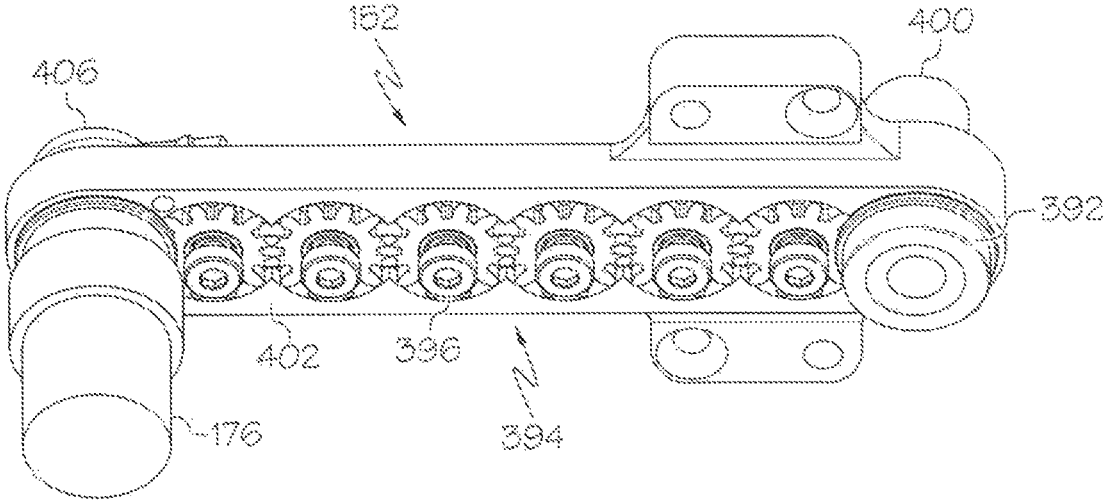
Figure 32:
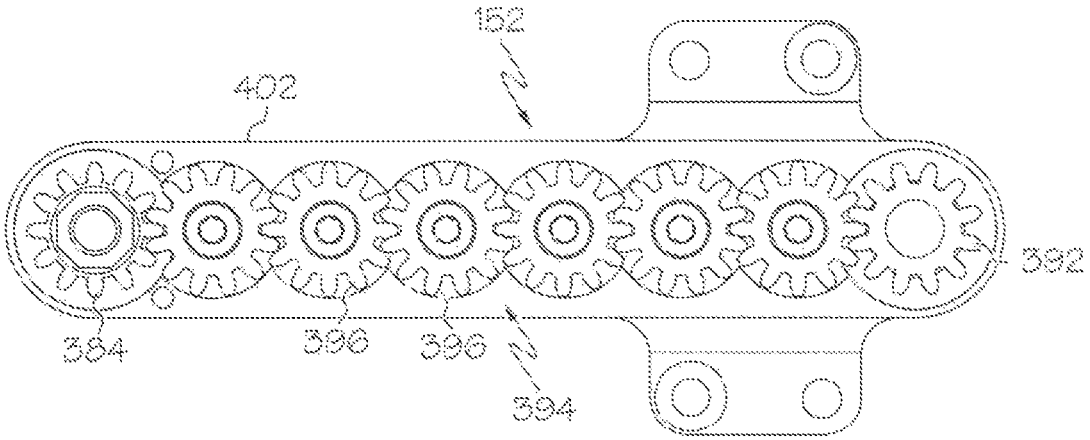
Figure 33:
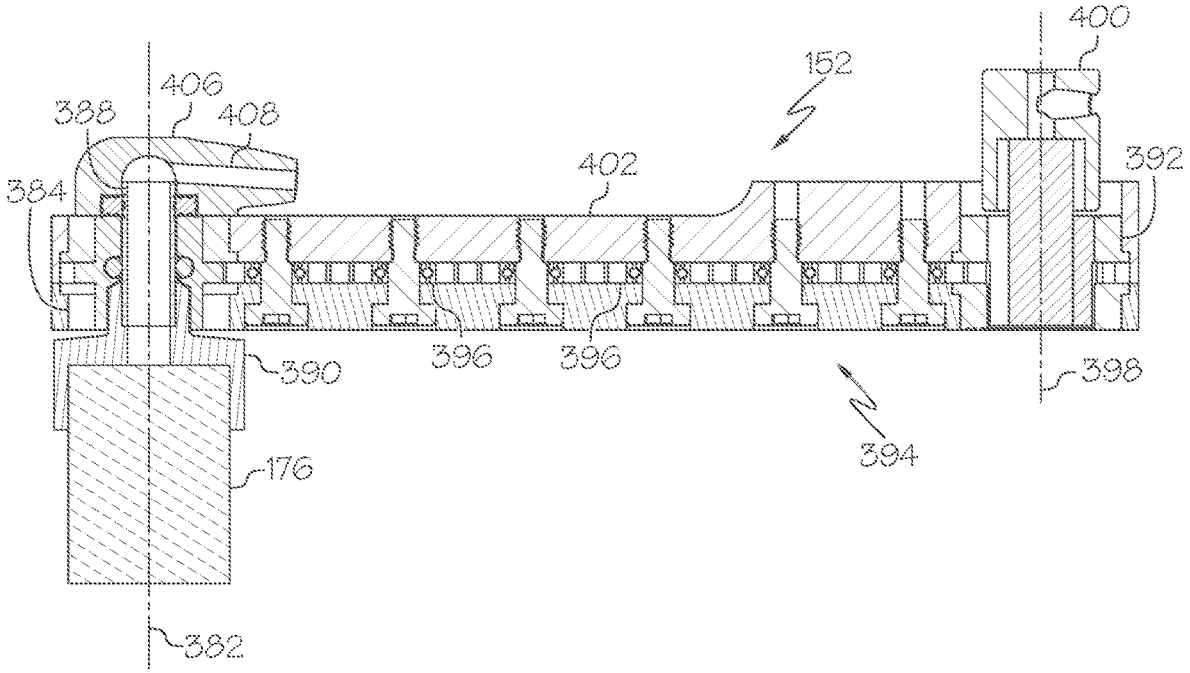
Figure 34A:
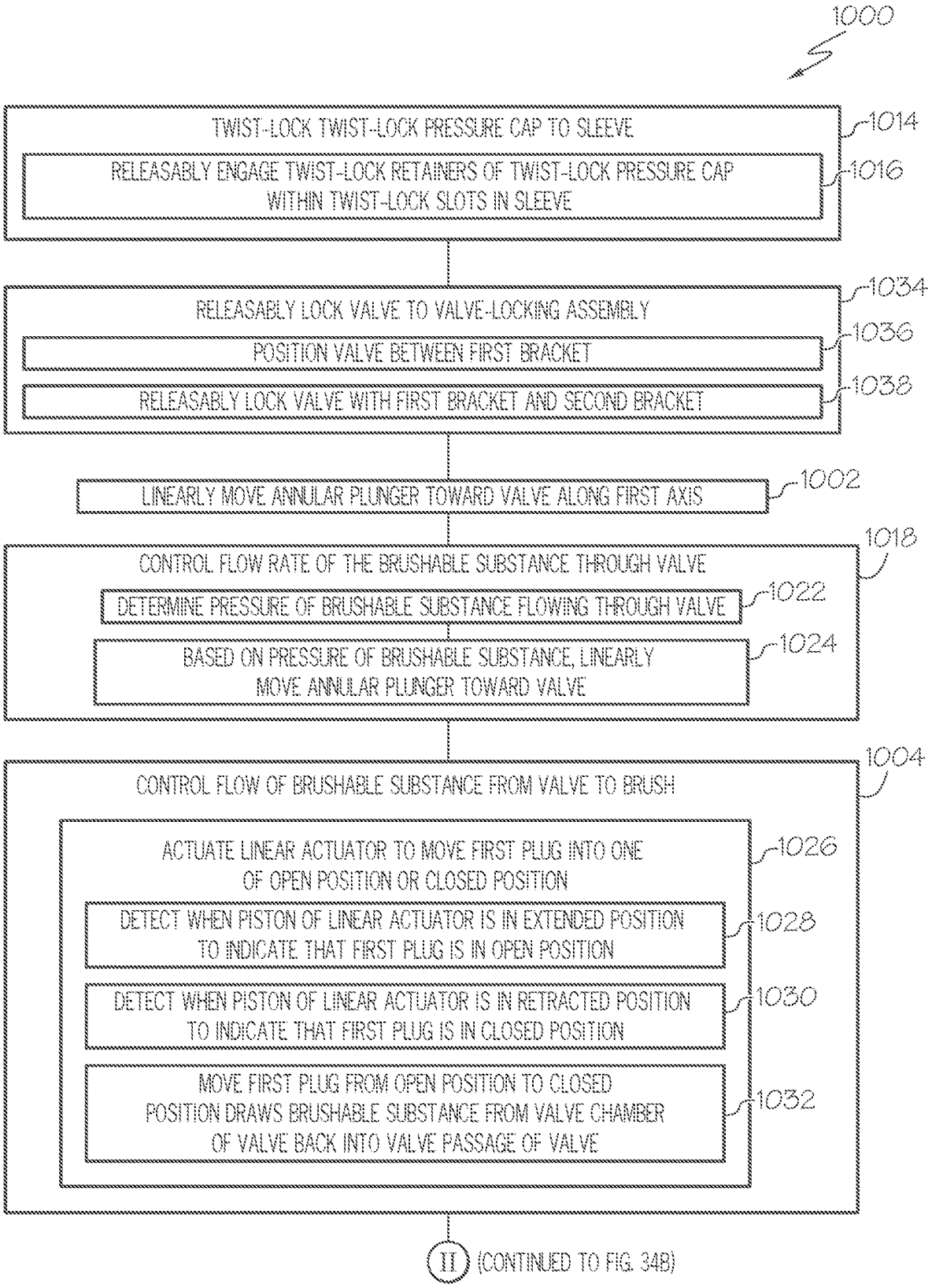
Figure 34B:
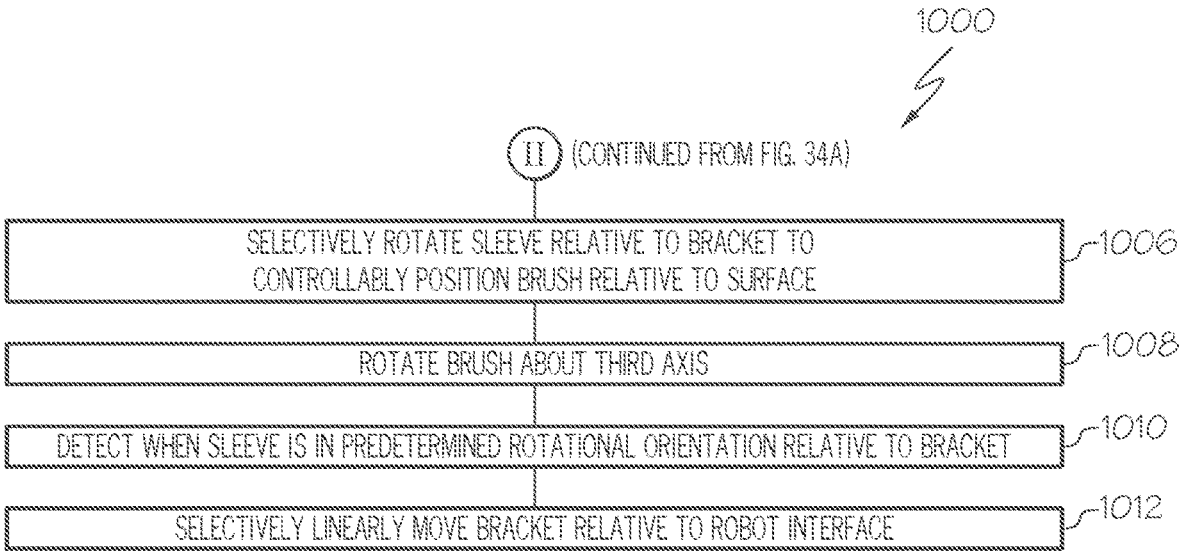
Figure 35:
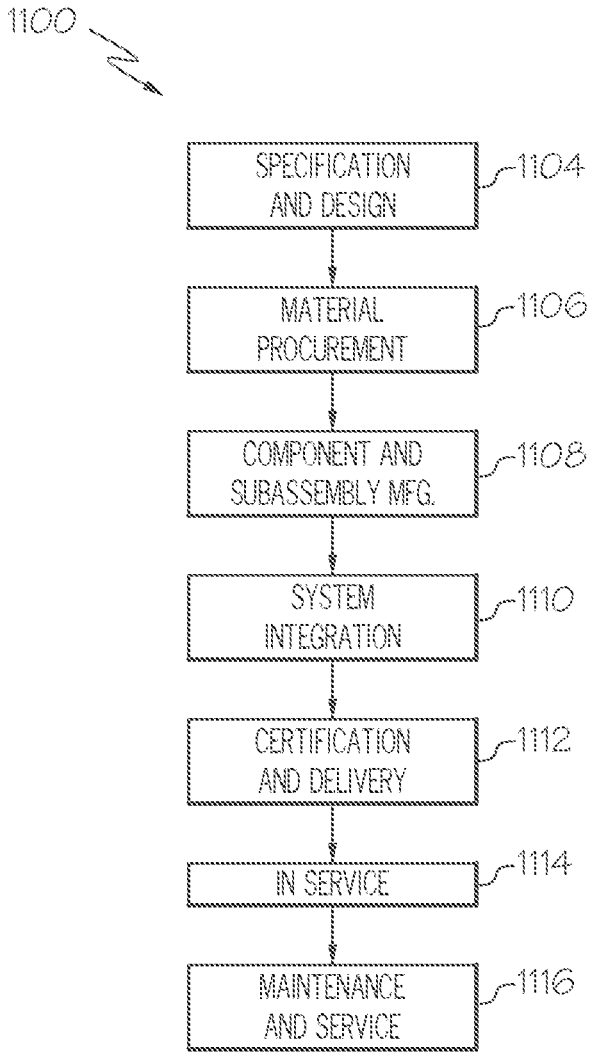
Figure 36:
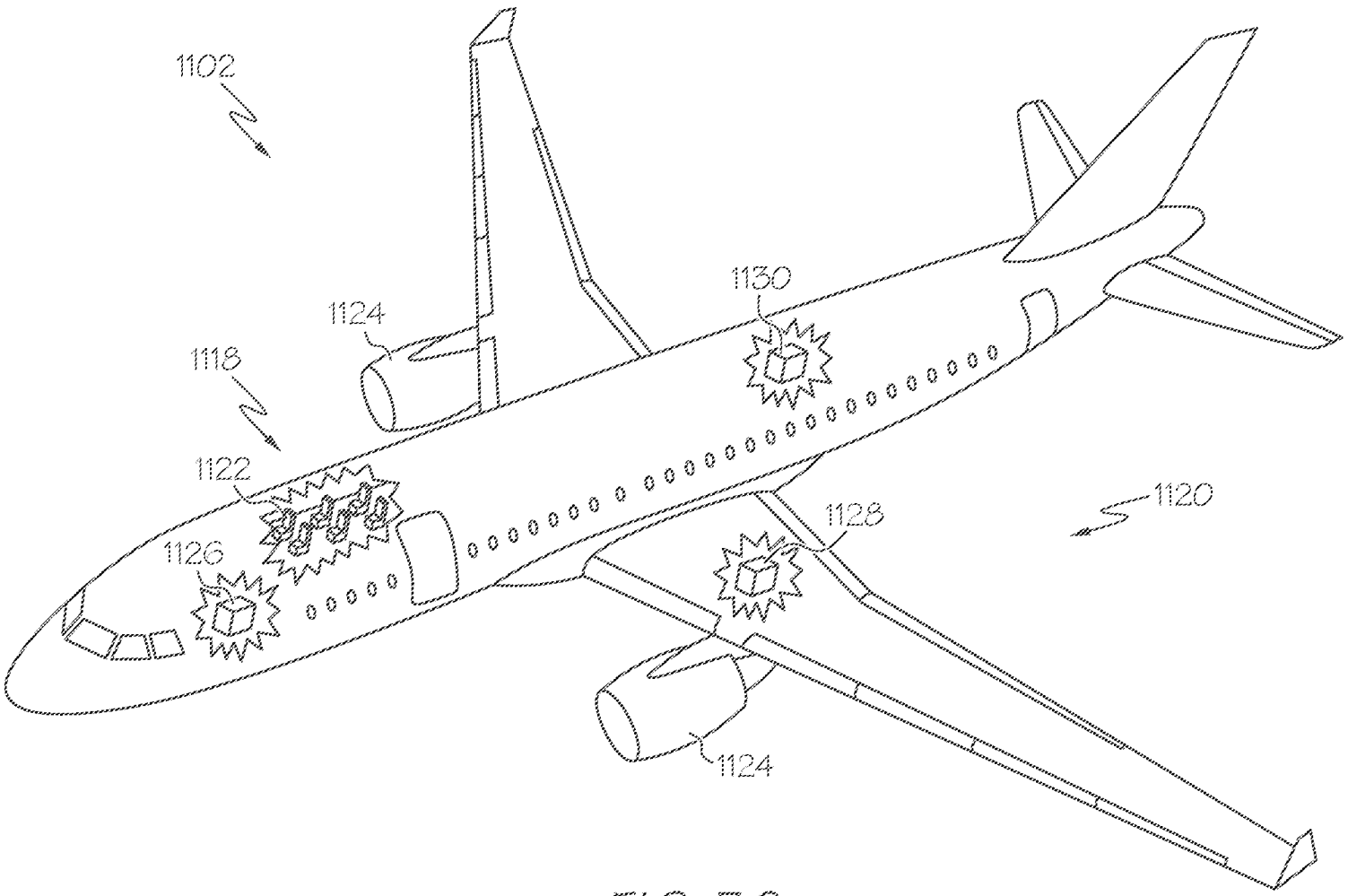

FIGS. 1A, 1B, and 1C collectively are a block diagram of an apparatus for dispensing a brushable substance, according to one or more examples of the present disclosure;

FIG. 2 is a schematic, perspective view of the apparatus of FIGS. 1A, 1B, and 1C, attached to a robot, according to one or more examples of the present disclosure;

FIG. 3 is a schematic, perspective, partial cut-away view of the apparatus of FIGS. 1A, 1B, and 1C, according to one or more examples of the present disclosure;

FIG. 4 is a schematic, perspective, exploded view of the apparatus of FIGS. 1A, 1B, and 1C, according to one or more examples of the present disclosure;

FIG. 5 is a schematic, perspective, exploded view of the apparatus of FIGS. 1A, 1B, and 1C, according to one or more examples of the present disclosure;

FIG. 6 is a schematic, elevation, sectional view of a sub-assembly of the apparatus of FIGS. 1A, 1B, and 1C, according to one or more examples of the present disclosure;

FIG. 7 is a schematic, elevation, sectional view of a sub-assembly of the apparatus of FIGS. 1A, 1B, and 1C, according to one or more examples of the present disclosure;

FIG. 8 is a schematic, elevation, sectional view of a sub-assembly of the apparatus of FIGS. 1A, 1B, and 1C, according to one or more examples of the present disclosure;

FIG. 9 is a schematic, perspective view of a sleeve and a cartridge of the apparatus of FIGS. 1A, 1B, and 1C, according to one or more examples of the present disclosure;

FIG. 10 is a schematic, perspective, exploded view of the sleeve and the cartridge of FIG. 9, according to one or more examples of the present disclosure;

FIG. 11 is a schematic, elevation, sectional view of a sleeve, a cartridge and an annular plunger of the apparatus of FIGS. 1A, 1B, and 1C, according to one or more examples of the present disclosure;

FIG. 12 is a schematic, perspective view of a twist-lock pressure cap of the apparatus of FIGS. 1A, 1B, and 1C, according to one or more examples of the present disclosure;

FIG. 13 is a schematic, top view of the twist-lock pressure cap of FIG. 12, according to one or more examples of the present disclosure;

FIG. 14 is a schematic, perspective view of an annular plunger of the apparatus of FIGS. 1A, 1B, and 1C, according to one or more examples of the present disclosure;

FIG. 15 is a schematic, perspective, exploded view of the annular plunger of FIG. 14, according to one or more examples of the present disclosure;

FIG. 16 is a schematic, perspective view of a linear actuator, a valve, and a portion of a valve-locking assembly of the apparatus of FIGS. 1A, 1B, and 1C, according to one or more examples of the present disclosure;

FIG. 17 is a schematic, perspective, partially exploded view of the linear actuator, the valve, and the portion of a valve-locking assembly of FIG. 16, according to one or more examples of the present disclosure;

FIG. 18 is a schematic, elevation, sectional view of a valve of the apparatus of FIGS. 1A, 1B, and 1C, according to one or more examples of the present disclosure;

FIG. 19 is a schematic, elevation, sectional view of a linear actuator and a valve of the apparatus of FIGS. 1A, 1B, and 1C, according to one or more examples of the present disclosure;

FIG. 20 is a schematic, elevation, sectional view of a linear actuator and a valve of the apparatus of FIGS. 1A, 1B, and 1C, according to one or more examples of the present disclosure;

FIG. 21 is a schematic, elevation, partially exploded view of a sleeve, a linear actuator, a valve, a valve-locking assembly, and a brush-arm assembly of the apparatus of FIGS. 1A, 1B, and 1C, according to one or more examples of the present disclosure;

FIG. 22 is a schematic, perspective view of a valve and a valve-locking assembly of the apparatus of FIGS. 1A, 1B, and 1C, according to one or more examples of the present disclosure;

FIG. 23 is a schematic, perspective, exploded view of the valve and the valve locking assembly of the apparatus of FIG. 22, according to one or more examples of the present disclosure;

FIG. 24 is a schematic, perspective view of a sleeve, a valve, a valve-locking assembly, and a brush-arm assembly of the apparatus of FIGS. 1A, 1B, and 1C, according to one or more examples of the present disclosure;

FIG. 25 is a schematic, perspective, partially exploded view of a sleeve, a linear actuator, a valve, a valve-locking assembly, and a brush-arm assembly of the apparatus of FIGS. 1A, 1B, and 1C, according to one or more examples of the present disclosure;

FIG. 26 is a schematic, perspective view of a sub-assembly of the apparatus of FIGS. 1A, 1B, and 1C, according to one or more examples of the present disclosure;

FIG. 27 is a schematic, perspective view of a sub-assembly of the apparatus of FIGS. 1A, 1B, and 1C, according to one or more examples of the present disclosure;

FIG. 28 is a schematic, perspective view of a bracket of the apparatus of FIGS. 1A, 1B, and 1C, according to one or more examples of the present disclosure;

FIG. 29 is a schematic, elevation, sectional view of a tensioner of the apparatus of FIGS. 1A, 1B, and 1C, according to one or more examples of the present disclosure;

FIG. 30 is a schematic, perspective view of a brush-arm assembly of the apparatus of FIGS. 1A, 1B, and 1C, according to one or more examples of the present disclosure;

FIG. 31 is a schematic, perspective view of a brush-arm assembly of the apparatus of FIGS. 1A, 1B, and 1C, according to one or more examples of the present disclosure;

FIG. 32 is a schematic, bottom view of a brush-arm assembly of the apparatus of FIGS. 1A, 1B, and 1C, according to one or more examples of the present disclosure;

FIG. 33 is a schematic, elevation, sectional view of a brush-arm assembly of the apparatus of FIGS. 1A, 1B, and 1C, according to one or more examples of the present disclosure;

FIGS. 34A and 34B collectively are a block diagram of a method of dispensing a brushable substance onto a surface utilizing the apparatus of FIGS. 1A, 1B, and 1C, according to one or more examples of the present disclosure;

FIG. 35 is a block diagram of aircraft production and service methodology; and FIG. 36 is a schematic illustration of an aircraft.

DETAILED DESCRIPTION

In FIGS. 1A, 1B, and 1C, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIGS. 1A, 1B, and 1C may be combined in various ways without the need to include other features described in FIGS. 1A, 1B, and 1C, other drawing figures, and/or the accompanying disclosure, even though such combination or combinations are not explicitly illustrated herein. Similarly, additional features not limited to the examples presented, may be combined with some or all of the features shown and described herein.

In FIGS. 34A, 34B, and 35, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 34A, 34B, and 35 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIGS. 1A, 1B, and 1C and particularly to, e.g., FIGS. 2-8, apparatus 100 for dispensing brushable substance 102 onto surface 154 is disclosed. Apparatus 100 comprises bracket 104, configured to be removably coupled with robot 116. Apparatus 100 further comprises sleeve 110, comprising inner tubular sleeve wall 114 and outer tubular sleeve wall 112, circumscribing inner tubular sleeve wall 114. Sleeve 110 is coupled to bracket 104 and is rotatable relative to bracket 104 about first axis 118. Apparatus 100 also comprises cartridge 124, comprising inner tubular cartridge wall 126 and outer tubular cartridge wall 128, circumscribing inner tubular cartridge wall 126. Apparatus 100 additionally comprises valve 140, configured to be communicatively coupled with cartridge 124. Apparatus 100 further comprises brush-arm assembly 152, coupled to sleeve 110. Apparatus 100 also comprises linear actuator 138 to control flow of brushable substance 102 from valve 140. Apparatus 100 additionally comprises annular plunger 148, positioned between inner tubular cartridge wall 126 and outer tubular cartridge wall 128 and movable along first axis 118. Apparatus 100 further comprises twist-lock pressure cap 150, configured to be hermetically coupled with cartridge 124. Cartridge 124 is configured to be positioned between inner tubular sleeve wall 114 and outer tubular sleeve wall 112. Cartridge 124 is also configured to be positioned between twist-lock pressure cap 150 and valve 140. The preceding subject matter of this paragraph characterizes example 1 of the present disclosure.

Apparatus 100 provides for dispensing brushable substance 102, from cartridge 124, through brush-arm assembly 152, onto surface 154 of a workpiece, for example, located in a confined space. The configuration of sleeve 110 and cartridge 124 reduces the size requirements for storage of brushable substance 102 and enables linear actuator 138 and a portion of valve 140 to be located, or housed, within sleeve 110. Twist-lock pressure cap 150 enables pressurization of an interior volume located within cartridge 124, which drives annular plunger 148. Rotation of sleeve 110 controls an angular orientation of brush-arm assembly 152 relative to bracket 104 and surface 154 during dispensing of brushable substance 102. Valve 140 being communicatively coupled directly to cartridge 124 enables a reduction of brushable substance 102 wasted, for example, during replacement of cartridge 124 and/or a purging operation.

Apparatus 100 delivers a reduction in the labor, time, and inaccuracies associated with the application of brushable substance 102 onto at least one surface 154 of the workpiece or other structure. Apparatus 100 is capable of automated application of brushable substance 102 within a confined space, such as within a wing box of an aircraft.

As used herein, brushable substance 102 refers to any substance or material that is capable of being brushed, wiped, polished or otherwise spread onto a surface, for example, using an implement having bristles. Examples of brushable substance 102 include, but are not limited to, paints, adhesives, protective coatings, polishes, and sealants. In some examples, brushable substance 102 is used for purposes of painting, surface protection, corrosion resistance, and/or fixation, among other purposes.

Generally, apparatus 100 functions as an automated end effector that is operably coupled with an end of robot 116 (FIG. 2) or other robotic arm mechanism and that is designed to interact with the environment by dispensing brushable substance 102 onto surface 154. Cartridge 124 of apparatus 100 provides for the containment of brushable substance 102. Sleeve 110 of apparatus 100 enables a secure coupling of cartridge 124 to apparatus 100. Twist-lock pressure cap 150 enables access to sleeve 110 for insertion of cartridge 124 into sleeve 110 and removal of cartridge 124 from within sleeve 110. Twist-lock pressure cap 150 also enables the application of pressure to (e.g., within) cartridge 124 for moving annular plunger 148 along first axis 118 toward valve 140. Movement of annular plunger 148 toward valve 140 urges brushable substance 102 out of cartridge 124 and into valve 140. With cartridge 124 received within sleeve 110 and twist-lock pressure cap 150 in a closed and locked position, cartridge 124 is sealingly and communicatively coupled with valve 140 to enable a sealed flow of brushable substance 102 from cartridge 124 to valve 140 via the application of pressure to annular plunger 148. Brush-arm assembly 152 dispenses brushable substance 102 from valve 140 onto surface 154. Linear actuator 138 controls a flow of brushable substance 102 from valve 140 to brush-arm assembly 152 by selectively opening and closing valve 140. In some examples, linear actuator 138 is any one of various linear actuators powered in any one of various ways, such as pneumatically, electrically, hydraulically, and the like.

With sleeve 110 coupled to bracket 104, inner tubular sleeve wall 114 of sleeve 110 circumscribes first axis 118. In some examples, each one of inner tubular sleeve wall 114 and outer tubular sleeve wall 112 of sleeve 110 has a tubular shape suitable to receive cartridge 124 and rotate relative to bracket 104. In an example, each one of inner tubular sleeve wall 114 and outer tubular sleeve wall 112 of sleeve 110 has a circular cross-sectional shape. In another example, each one of inner tubular sleeve wall 114 and outer tubular sleeve wall 112 of sleeve 110 has an elliptical cross-sectional shape. Similarly, with cartridge 124 received within sleeve 110, inner tubular cartridge wall 126 of cartridge 124 circumscribes first axis 118 and inner tubular sleeve wall 114 and outer tubular sleeve wall 112 circumscribes outer tubular cartridge wall 128. In some examples, each one of inner tubular cartridge wall 126 and outer tubular cartridge wall 128 of cartridge 124 has a tubular shape suitable to contain brushable substance 102 and fit between inner tubular sleeve wall 114 outer tubular sleeve wall 112. In an example, each one of inner tubular cartridge wall 126 and outer tubular cartridge wall 128 of cartridge 124 has a circular cross-sectional shape. In another example, each one of inner tubular cartridge wall 126 and outer tubular cartridge wall 128 of cartridge 124 has an elliptical cross-sectional shape. In some examples, first axis 118 is a central longitudinal axis of apparatus 100.

In some examples, sleeve 110 is coupled to bracket 104 in any manner suitable to enable rotation of sleeve 110 about first axis 118 relative to bracket 104. In some examples, apparatus 100 also includes one or more annular bearings 410 coupled to an exterior of outer tubular sleeve wall 112 of sleeve 110. In some examples, a first one of annular bearings 410 is located at one end of sleeve 110 and a second one of annular bearings 410 is located at the other end of sleeve 110.

Referring generally to FIGS. 1A, 1B, and 1C and particularly to, e.g., FIGS. 9-11, sleeve 110 further comprises sleeve first end 120, comprising annular sleeve end-opening 162 that separates inner tubular sleeve wall 114 and outer tubular sleeve wall 112. Sleeve 110 is configured to receive cartridge 124 through annular sleeve end-opening 162. The preceding subject matter of this paragraph characterizes example 2 of the present disclosure, wherein example 2 also includes the subject matter according to example 1, above.

Annular sleeve end-opening 162 provides an access opening into sleeve 110 and enables insertion of cartridge 124 into sleeve 110 and removal of cartridge 124 from within sleeve 110. Moreover, with twist-lock pressure cap 150 coupled to sleeve 110, at least portion of twist-lock pressure cap 150 is positioned within annular sleeve end-opening 162 to enable locking of twist-lock pressure cap 150 to sleeve 110.

Sleeve 110 further comprises sleeve second end 122, opposite sleeve first end 120, and annular sleeve end-wall 168, interconnecting inner tubular sleeve wall 114 and outer tubular sleeve wall 112 at sleeve second end 122.

Referring generally to FIGS. 1A, 1B, and 1C and particularly to, e.g., FIGS. 4, 5, and 22, apparatus 100 further comprises first drive assembly 192, configured to selectively controllably rotate sleeve 110 about first axis 118 relative to bracket 104. The preceding subject matter of this paragraph characterizes example 3 of the present disclosure, wherein example 3 also includes the subject matter according to example 1 or 2, above.

First drive assembly 192 enables automated, precise rotation of sleeve 110 about first axis 118 relative to bracket 104. Controlled selective rotary motion of sleeve 110 relative to bracket 104 enables selective adjustment of a rotational orientation of sleeve 110 about first axis 118 relative to bracket 104 and selective adjustment of an angular orientation of brush-arm assembly 152 relative to bracket 104 and relative to surface 154. Selective adjustability of the angular orientation of brush-arm assembly 152 relative to bracket 104 enables brush-arm assembly 152 to be positioned in any one of numerous angular orientations about first axis 118 relative to bracket 104 and surface 154. Rotational movement of brush-arm assembly 152 relative to surface 154 provides for dispensing of brushable substance 102 onto various areas of surface 154 without having to change the position of apparatus 100, for example, via robot 116.

Referring generally to FIGS. 1A, 1B, and 1C and particularly to, e.g., FIGS. 4, 5, and 26, first drive assembly 192 comprises first motor 136 and first power-transmitting component 184, operatively coupled with first motor 136 and sleeve 110. Sleeve 110 further comprises splines 180, projecting outwardly from outer tubular sleeve wall 112. First power-transmitting component 184 comprises teeth 172, configured to mate with splines 180 of sleeve 110. The preceding subject matter of this paragraph characterizes example 4 of the present disclosure, wherein example 4 also includes the subject matter according to example 3, above.

First motor 136 being operatively coupled with first power-transmitting component 184 and sleeve 110 being operatively coupleable with first power-transmitting component 184 enables first motor 136 to controllably selectively rotate sleeve 110. Teeth 172 of first power-transmitting component 184 and splines 180 of sleeve 110 enable an interference fit between first power-transmitting component 184 and sleeve 110. Mating engagement of teeth 172 of first power-transmitting component 184 with splines 180 of sleeve 110 enables co-rotation of first power-transmitting component 184 and sleeve 110. Controlled selective rotation of first power-transmitting component 184 by first motor 136 enables rotational tracking of sleeve 110 relative to bracket 104.

In some examples, first motor 136 includes an output shaft that is rotatable by first motor 136 to produce a rotary force or torque when first motor 136 is operated. In some examples, first motor 136 is any one of various rotational motors, such as an electric motor, a hydraulic motor, a pneumatic motor, an electromagnetic motor, and the like. In some examples, first motor 136 is coupled to interface bracket 224.

First power-transmitting component 184 provides an efficient and reliable mechanism to transmit power from first motor 136 to sleeve 110, such as when first axis 118 is not co-axial with a rotational axis of first motor 136. In an example, first power-transmitting component 184 is a belt operatively coupled with the output shaft of first motor 136. In other examples, first power-transmitting component 184 is any one of a chain, a gear, a gear train, and the like. Advantageously, the belt is lighter and cleaner than other implementations of first power-transmitting component 184, for example, the belt does not require lubrication for effective operation.

In some examples, first drive assembly 192 also includes one or more other transmission components, configured to operatively couple first motor 136 with first power-transmitting component 184 including, but not limited to, gears, belts, sprockets, and the like.

In some examples, splines 180 project radially outwardly from the exterior of outer tubular sleeve wall 112 and are located circumferentially around outer tubular sleeve wall 112. In some examples, with sleeve 110 coupled to bracket 104, splines 180 are oriented parallel with first axis 118. In some examples, splines 180 extend from proximate to sleeve first end 120 of sleeve 110 to proximate to sleeve second end 122 of sleeve 110. In some examples, splines 180 extend between annular bearings 410, coupled to outer tubular sleeve wall 112. In some examples, splines 180 are located on only a circumferential portion of outer tubular sleeve wall 112 that is engaged by first power-transmitting component 184. Throughout the present disclosure, the term "parallel" refers to an orientation between items extending in approximately the same direction.

Referring generally to FIGS. 1A, 1B, and 1C and particularly to, e.g., FIGS. 27-29, bracket 104 comprises tensioner 194, configured to tension first power-transmitting component 184 with respect to first motor 136 and sleeve 110. The preceding subject matter of this paragraph characterizes example 5 of the present disclosure, wherein example 5 also includes the subject matter according to example 4, above.

Tensioner 194 applies adjustable tension to first power-transmitting component 184. With tensioner 194 engaged with and applying tension to first power-transmitting component 184, first power-transmitting component 184 maintains contact with a portion of outer tubular sleeve wall 112 so that teeth 172 of first power-transmitting component 184 remain are mated with splines 180 of sleeve 110.

Referring generally to FIGS. 1A, 1B, and 1C and particularly to, e.g., FIGS. 28 and 29, tensioner 194 comprises tensioner base 196, coupled to bracket 104, and tensioner pulley 198, coupled to tensioner base 196 and rotatable relative to tensioner base 196 about second axis 200, parallel to first axis 118. Tensioner pulley 198 is configured to engage first power-transmitting component 184. The preceding subject matter of this paragraph characterizes example 6 of the present disclosure, wherein example 6 also includes the subject matter according to example 5, above.

Tensioner base 196 sets a position of tensioner pulley 198 relative to bracket 104 and in tension with first power-transmitting component 184. Rotation of tensioner pulley 198 about second axis 200 enables free rotational movement of first power-transmitting component 184.

Referring generally to FIGS. 1A, 1B, and 1C and particularly to, e.g., FIGS. 28 and 29, tensioner base 196 is linearly moveable relative to bracket 104. The preceding subject matter of this paragraph characterizes example 7 of the present disclosure, wherein example 7 also includes the subject matter according to example 6, above.

Linear movement of tensioner base 196 enables adjustment of a position of tensioner base 196 relative to bracket 104 and adjustment of a tension applied to first power-transmitting component 184 by tensioner pulley 198.

In some examples, tensioner base 196 is configured to move linearly away from bracket 104 and toward bracket 104. In some examples, bracket 104 includes bracket wall 428. Tensioner base 196 is coupled to an interior of bracket wall 428 and is linearly movable relative to bracket wall 428. In some examples, bracket wall 428 defines bracket opening 426. Bracket opening 426 provides access to sleeve 110 for first power-transmitting component 184, which passes through bracket opening 426. In some examples, tensioner 194 is located within bracket opening 426.

Referring generally to FIGS. 1A, 1B, and 1C and particularly to, e.g., FIGS. 28 and 29, tensioner base 196 is not rotatable relative to bracket 104. The preceding subject matter of this paragraph characterizes example 8 of the present disclosure, wherein example 8 also includes the subject matter according to example 7, above.

Fixing a rotational orientation of tensioner base 196 relative to bracket 104 fixes second axis 200 of tensioner pulley 198 parallel to first axis 118 and enables tensioner pulley 198 to maintain positive contact with first power-transmitting component 184.

Referring generally to FIGS. 1A, 1B, and 1C and particularly to, e.g., FIG. 29, tensioner 194 further comprises tensioner-biasing element 204, configured to bias tensioner pulley 198 against first power-transmitting component 184. The preceding subject matter of this paragraph characterizes example 9 of the present disclosure, wherein example 9 also includes the subject matter according to example 8, above.

Tensioner-biasing element 204 enables tensioner pulley 198 to remain engaged with first power-transmitting component 184. Engagement of tensioner pulley 198 with first power-transmitting component 184 applies constant tension on first power-transmitting component 184 during rotation of first power-transmitting component 184.

Referring generally to FIGS. 1A, 1B, and 1C and particularly to, e.g., FIG. 29, bracket 104 further comprises clearance hole 210 and counterbore 212, coaxial with clearance hole 210. Tensioner 194 further comprises fastener 208, passing through clearance hole 210 and through counterbore 212. Fastener 208 is threaded into tensioner base 196. The preceding subject matter of this paragraph characterizes example 10 of the present disclosure, wherein example 10 also includes the subject matter according to example 9, above.

Fastener 208 couples tensioner 194 to bracket 104. Fastener 208 also enables linear movement of tensioner base 196 relative to bracket 104. In some examples, fastener 208 is configured to control a position of tensioner base 196 relative to bracket 104. Linear movement of tensioner base 196 relative to bracket 104 adjusts the position of tensioner pulley 198 relative to first power-transmitting component 184, for example, to reduce or increase the tension applied to first power-transmitting component 184 by tensioner pulley 198.

Referring generally to FIGS. 1A, 1B, and 1C and particularly to, e.g., FIG. 29, tensioner 194 further comprises slide pin 214, fixed relative to one of bracket 104 or tensioner base 196, and movable relative to other one of bracket 104 or tensioner base 196. The preceding subject matter of this paragraph characterizes example 11 of the present disclosure, wherein example 11 also includes the subject matter according to example 10, above.

Slide pin 214 enables linear movement of tensioner base 196 relative to bracket 104 and prohibits rotational movement of tensioner base 196 about fastener 208 relative to bracket 104. Linear movement of tensioner base 196 adjusts the position of tensioner pulley 198 relative to first power-transmitting component 184. Non-rotation of tensioner pulley 198 maintains an orientation of first power-transmitting component 184 during co-rotation of first power-transmitting component 184 and sleeve 110.

Referring generally to FIGS. 1A, 1B, and 1C and particularly to, e.g., FIG. 29, tensioner-biasing element 204 comprises compression spring 216, positioned between bracket 104 and tensioner base 196. Compression spring 216 is located in counterbore 212. The preceding subject matter of this paragraph characterizes example 12 of the present disclosure, wherein example 12 also includes the subject matter according to example 10 or 11, above.

Compression spring 216 enables tensioner base 196 to be pushed, or biased, away from bracket 104 to position tensioner pulley 198 in tension with first power-transmitting component 184. In some examples, compression spring 216 is a helical, or coil, compression spring located around fastener 208 with one end engaged with tensioner base 196 and the other end engaged with an interior surface of counterbore 212.

Referring generally to FIGS. 1A, 1B, and 1C and particularly to, e.g., FIGS. 2 and 3, bracket 104 is linearly moveable along first axis 118 relative to robot 116. The preceding subject matter of this paragraph characterizes example 13 of the present disclosure, wherein example 13 also includes the subject matter according to any one of examples 3 to 12, above.

Linear movement of bracket 104 relative to robot 116 enables linear movement of brush-arm assembly 152 relative to robot 116 and to surface 154. Linear movement of brush-arm assembly 152 relative to surface 154 enables dispensing of brushable substance 102 on surface 154 having an irregular shape or on multiple other surfaces of the workpiece, for example, without having to change the position of apparatus 100 via robot 116.

Referring generally to FIGS. 1A, 1B, and 1C and particularly to, e.g., FIGS. 2-5, apparatus 100 further comprises robot interface 222, configured to be coupled to robot 116, and interface bracket 224, configured to be coupled to robot interface 222 and linearly moveable relative to robot interface 222. Bracket 104 is coupled to interface bracket 224. The preceding subject matter of this paragraph characterizes example 14 of the present disclosure, wherein example 14 also includes the subject matter according to example 13, above.

Robot interface 222 enables quick coupling of apparatus 100 with robot 116 and quick releasing of apparatus 100 from robot 116. Interface bracket 224 enables movable coupling of bracket 104 to robot interface 222. Linear movement of interface bracket 224 relative to robot interface 222 enables linear movement of bracket 104 relative to robot 116.

In some examples, robot interface 222 provides quick coupling of communication lines between apparatus 100 and robot 116. In some examples, robot interface 222 enables automated coupling of apparatus 100 with robot 116 and automated releasing of apparatus 100 from robot 116. In some examples, robot interface 222 is a tool-side portion of a pneumatic quick-change mechanism and robot 116 includes a tool interface of the pneumatic quick-change mechanism.

In some examples, interface bracket 224 includes a pair of bracket arms 416. Bracket arms 416 engage interface bracket 224 with robot interface 222 and guide linear motion of interface bracket 224 relative to robot interface 222. In some examples, each one of bracket arms 416 includes guide channel 420 and robot interface 222 includes a pair of guide rails 422. Guide channel 420 of bracket arms 416 is configured to receive and move along an associated one of guide rails 422.

Referring generally to FIGS. 1A, 1B, and 1C and particularly to, e.g., FIGS. 4, 5, and 22, apparatus 100 further comprises proximity sensor 190, coupled to interface bracket 224 and configured to detect when sleeve 110 is in predetermined rotational orientation relative to bracket 104. Apparatus 100 further comprises homing element 186, coupled to sleeve 110 and configured to actuate proximity sensor 190 when sleeve 110 is rotated about first axis 118 to predetermined rotational orientation. The preceding subject matter of this paragraph characterizes example 15 of the present disclosure, wherein example 15 also includes the subject matter according to example 14, above.

Homing element 186 enables actuation of proximity sensor 190 when sleeve 110 is rotated to the predetermined rotational orientation relative to bracket 104 to indicate that sleeve 110 is in a home position. Use of homing element 186 and proximity sensor 190 to indicate the home position also enables use of an incremental position encoder, which is capable of determining the rotational orientation of sleeve 110 relative to bracket 104 following a power interruption, rather than an absolute position encoder, which would be unable to determine the rotational orientation of sleeve 110 relative to bracket 104 in case of a power interruption.

Referring generally to FIGS. 1A, 1B, and 1C, homing element 186 comprises magnet 188 on outer tubular sleeve wall 112. Proximity sensor 190 comprises magnetic sensor 220. The preceding subject matter of this paragraph characterizes example 16 of the present disclosure, wherein example 16 also includes the subject matter according to example 15, above.

Magnet 188 enables non-contact actuation of magnetic sensor 220 when sleeve 110 is rotated to the predetermined rotational orientation relative to bracket 104 to indicate that sleeve 110 is in the home position.

Referring generally to FIGS. 1A, 1B, and 1C and particularly to, e.g., FIGS. 2 and 3, interface bracket 224 is selectively linearly movable along first axis 118 relative to robot interface 222. The preceding subject matter of this paragraph characterizes example 17 of the present disclosure, wherein example 17 also includes the subject matter according to any one of examples 14 to 16, above.

Selective linear movement of interface bracket 224 along first axis 118 relative to robot interface 222 enables controlled, selective adjustment of the linear position of bracket 104 relative to robot 116 and controlled, selective adjustment of the linear position of brush-arm assembly 152 relative to surface 154. Controlled, selective linear movement of brush-arm assembly 152 relative to surface 154 dispenses brushable substance 102 on surface 154 having an irregular shape or on multiple other surfaces of the workpiece.

Referring generally to FIGS. 1A, 1B, and 1C and particularly to, e.g., FIGS. 4 and 5, apparatus 100 further comprises second drive assembly 228, configured to selectively controllably translate interface bracket 224 along first axis 118 relative to robot interface 222. The preceding subject matter of this paragraph characterizes example 18 of the present disclosure, wherein example 18 also includes the subject matter according to example 17, above.

Second drive assembly 228 enables automated, precise linear translation of interface bracket 224 along first axis 118 relative to robot interface 222. Controlled selective linear movement of interface bracket 224 relative to robot interface 222 controls selective adjustment of a linear position of bracket 104 along first axis 118 relative to robot interface 222 and controlled selective adjustment of a linear position of brush-arm assembly 152 relative to surface 154.

Referring generally to FIGS. 1A, 1B, and 1C and particularly to, e.g., FIGS. 4 and 5, second drive assembly 228 comprises second motor 206 and second power-transmitting component 226, operatively coupled with second motor 206 and interface bracket 224. The preceding subject matter of this paragraph characterizes example 19 of the present disclosure, wherein example 19 also includes the subject matter according to example 18, above.

Second motor 206 being operatively coupled with second power-transmitting component 226 and interface bracket 224 being operatively coupled with second power-transmitting component 226 enables second motor 206 to controllably translate interface bracket 224 relative to robot interface. Second power-transmitting component 226 enables selective linear movement of interface bracket 224 along an axis parallel to first axis 118 relative to robot interface 222. With second power-transmitting component 226 operatively coupled with interface bracket 224, operation of second power-transmitting component 226 enables selective linear movement of interface bracket 224 relative to robot interface 222. Additionally, controlled selective translation of interface bracket 224 relative to robot interface 222 enables automated linear tracking of interface bracket 224 relative to robot interface 222.

In some examples, second motor 206 includes an output shaft that is rotatable by second motor 206 to produce a rotary force or torque when second motor 206 is operated. In some examples, second motor 206 is any one of various rotational motors, such as an electric motor, a hydraulic motor, a pneumatic motor, an electromagnetic motor, and the like. In some examples, second motor 206 is coupled to robot interface 222.

Second power-transmitting component 226 provides an efficient and reliable mechanism to transmit power from second motor 206 to interface bracket 224. In some examples, second power-transmitting component 226 is any one of a translation screw drive, a chain, a belt, a gear, a gear train, and the like.

In some examples, second drive assembly 228 also includes one or more other transmission components, configured to operatively couple second motor 206 with second power-transmitting component 226 including, but not limited to, gears, belts, sprockets, and the like.

Referring generally to FIGS. 1A, 1B, and 1C and particularly to, e.g., FIGS. 4 and 5, second power-transmitting component 226 of second drive assembly 228 comprises ball screw 230, rotationally coupled with robot interface 222, and ball nut 232, coupled to interface bracket 224 and operatively coupled with ball screw 230. The preceding subject matter of this paragraph characterizes example 20 of the present disclosure, wherein example 20 also includes the subject matter according to example 19, above.

Ball screw 230 and ball nut 232 enable translation of rotational motion of second motor 206, via second power-transmitting component 226, to linear motion of interface bracket 224 relative to robot interface 222. Advantageously, selection of ball screw 230 and ball nut 232 enables apparatus 100 to withstand high thrust loads and enables precise control of linear movement of interface bracket 224 relative to robot interface 222.

Referring generally to FIGS. 1A, 1B, and 1C and particularly to, e.g., FIGS. 9-11, cartridge 124 further comprises cartridge first end 130, comprising annular cartridge end-opening 170 that separates inner tubular cartridge wall 126 and outer tubular cartridge wall 128. Cartridge 124 is configured to receive brushable substance 102 through annular cartridge end-opening 170. The preceding subject matter of this paragraph characterizes example 21 of the present disclosure, wherein example 21 also includes the subject matter according to any one of examples 1 to 20, above.

Annular cartridge end-opening 170 enables access for deposition of brushable substance 102 into cartridge 124. Moreover, when twist-lock pressure cap 150 is coupled to sleeve 110, at least portion of twist-lock pressure cap 150 is positioned within annular cartridge end-opening 170 to form hermetic seal between twist-lock pressure cap 150 and cartridge 124.

Referring generally to FIGS. 1A, 1B, and 1C and particularly to, e.g., FIGS. 10 and 11, cartridge 124 further comprises cartridge second end 132, opposite cartridge first end 130, and annular cartridge end-wall 174, interconnecting inner tubular sleeve wall 114 and outer tubular sleeve wall 112 at cartridge second end 132. Cartridge 124 also comprises cartridge outlet port 134, passing through annular cartridge end-wall 174 and configured to be communicatively coupled with valve 140. The preceding subject matter of this paragraph characterizes example 22 of the present disclosure, wherein example 22 also includes the subject matter according to example 21, above.

Cartridge outlet port 134 of cartridge 124 enables transfer of brushable substance 102 from cartridge 124 to valve 140.

In some examples, cartridge 124 includes more than one cartridge outlet port 134. Each cartridge outlet port 134 is configured to be communicatively coupled with valve 140. In some examples, cartridge outlet port 134 includes a gasket, configured to form a seal between cartridge outlet port 134 and valve 140.

In some examples, sleeve 110 also includes at least one pass-through port 430 passing through annular sleeve end-wall 168. Pass-through port 430 of sleeve 110 is configured to enable cartridge outlet port 134 to be communicatively coupled with valve 140 such that brushable substance 102 can flow from cartridge 124 into valve 140.

Referring generally to FIGS. 1A, 1B, and 1C and particularly to, e.g., FIGS. 1A, 1B, AND 1C2, apparatus 100 further comprises cartridge-alignment feature 160, configured to align cartridge 124 relative to sleeve 110 and valve 140 about first axis 118. The preceding subject matter of this paragraph characterizes example 23 of the present disclosure, wherein example 23 also includes the subject matter according to any one of examples 1 to 22, above.

Cartridge-alignment feature 160 enables proper alignment of cartridge 124 relative to valve 140 such that cartridge 124 is in communication with valve 140 upon cartridge 124 being received by sleeve 110. Setting the rotational orientation of cartridge 124 relative to sleeve 110 and, thus, relative to valve 140 positions cartridge 124 in fluid communication with valve 140. Cartridge-alignment feature 160 ensures that cartridge 124 is in a proper rotational orientation relative to valve 140 in order to align and communicatively couple cartridge outlet port 134 with valve 140.

In some examples, cartridge-alignment feature 160 includes alignment protrusion 412 and alignment groove 414. Alignment and engagement of alignment protrusion 412 with alignment groove 414 sets a proper rotational orientation of cartridge 124 relative to valve 140 with cartridge 124 in fluid communication with valve 140. In some examples, alignment protrusion 412 is located on and projects outwardly from an interior surface of inner tubular cartridge wall 126 and alignment groove 414 is located on and depends inwardly from an exterior surface of inner tubular sleeve wall 114. In some examples, alignment protrusion 412 and alignment groove 414 are located on outer tubular cartridge wall 128 and outer tubular sleeve wall 112, respectively. In some examples, the location of alignment protrusion 412 and alignment groove 414 on respective ones of inner tubular cartridge wall 126, outer tubular cartridge wall 128, inner tubular sleeve wall 114, and/or outer tubular sleeve wall 112 varies. In some examples, the configuration of alignment protrusion 412 and alignment groove 414 relative to the interior surface and/or exterior surface of inner tubular cartridge wall 126, outer tubular cartridge wall 128, inner tubular sleeve wall 114, and/or outer tubular sleeve wall 112 vary.

Referring generally to FIGS. 1A, 1B, and 1C and particularly to, e.g., FIGS. 3 and 11-13, twist-lock pressure cap 150 comprises twist-lock retainers 234, fixed to twist-lock pressure cap 150 and extending from twist-lock pressure cap 150 perpendicular to first axis 118. Twist-lock retainers 234 are configured to releasably engage twist-lock slots 240 in outer tubular sleeve wall 112 of sleeve 110 when twist-lock pressure cap 150 is twisted into sleeve 110. The preceding subject matter of this paragraph characterizes example 24 of the present disclosure, wherein example 24 also includes the subject matter according to any one of examples 1 to 23, above.

Twist-lock retainers 234 enable twist-lock pressure cap 150 to be releasably locked to sleeve 110 and sealed with cartridge 124. With each one of twist-lock retainers 234 received within and releasably engaged with an associated one of twist-lock slots 240, in response to partially inserting twist-lock pressure cap 150 within annular sleeve end-opening 162 along first axis 118 and twisting twist-lock pressure cap 150 in a first direction (e.g., clockwise) relative to sleeve 110, twist-lock pressure cap 150 is releasably locked to sleeve 110. With each one of twist-lock retainers 234 disengaged and removed from the associated one of twist-lock slots 240, in response to twisting twist-lock pressure cap 150 in a second direction (e.g., counterclockwise) relative to sleeve 110 and withdrawing twist-lock pressure cap 150 within annular sleeve end-opening 162 along first axis 118, twist-lock pressure cap 150 is unlocked from sleeve 110.

Twist-lock retainers 234 insert within and lock with twist-lock slots 240 when twist-lock pressure cap 150 is twisted into sleeve 110 about first axis 118. Using twist-lock retainers 234 to releasably lock twist-lock pressure cap 150 in the closed position prevents disengagement between twist-lock pressure cap 150 and sleeve 110 and between twist-lock pressure cap 150 and cartridge 124, for example, upon communication of pressure to cartridge 124 to move annular plunger 148 along first axis 118 toward valve 140.

In some examples, each one of twist-lock retainers 234 includes retainer-post 238, coupled to twist-lock pressure cap 150 and extending perpendicular to first axis 118, and retainer-head 242, located at an end of retainer-post 238. In an example, retainer-post 238 is a cylindrical shaft having a circular cross-sectional shape and retainer-head 242 has a disk-like shape. In some examples, each one of twist-lock retainers 234 is a shoulder bolt coupled to twist-lock pressure cap 150. In some examples, each one of twist-lock slots 240 includes open first portion 164, disposed parallel with first axis 118; second portion 166, extending from open first portion 164 and disposed at an oblique angle relative to first axis 118; and closed third portion 300, extending from second portion 166 and disposed perpendicular with first axis 118. In some examples, with twist-lock pressure cap 150 twisted into sleeve 110, retainer-post 238 of each one of twist-lock retainers 234 is located within an associated one of twist-lock slots 240 and outer tubular sleeve wall 112 is located between twist-lock pressure cap 150 and retainer-head 242 of each one of twist-lock retainers 234. In some examples, retainer-head 242 and sleeve 110 interlock by via interference fit when retainer-post 238 of each one of twist-lock retainers 234 is twisted into the associated one of twist-lock slots 240.

Referring generally to FIGS. 1A, 1B, and 1C and particularly to, e.g., FIGS. 1A, 1B, AND 1C3, individual members of one pair of twist-lock retainers 234, adjacent to each other, and individual members of any other pair of twist-lock retainers 234, adjacent to each other, have equal angular separations, as observed from first axis 118. The preceding subject matter of this paragraph characterizes example 25 of the present disclosure, wherein example 25 also includes the subject matter according to example 24, above.

Equal angular separations, as observed from first axis 118, of twist-lock retainers 234 of one pair of twist-lock retainers 234, adjacent to each other, and twist-lock retainers 234 of any other pair of twist-lock retainers 234 enables equal distribution of force on twist-lock pressure cap 150 when pneumatic pressure is applied within cartridge 124 between twist-lock pressure cap 150 and annular plunger 148.

In some examples, each one of twist-lock retainers 234 is disposed at equally angular spaced apart location about twist-lock pressure cap 150 relative to adjacent ones of twist-lock retainers 234. In some examples, twist-lock pressure cap 150 includes two twist-lock retainers 234 that are equally spaced apart, three twist-lock retainers 234 that are equally spaced apart, etc.

Referring generally to FIGS. 1A, 1B, and 1C and particularly to, e.g., FIGS. 6-8 and 12, twist-lock pressure cap 150 further comprises sleeve-interface portion 250, configured to be at least partially received within sleeve 110 between inner tubular sleeve wall 114 and outer tubular sleeve wall 112. Twist-lock pressure cap 150 further comprises cartridge-interface portion 252, extending from sleeve-interface portion 250 and configured to be at least partially received within cartridge 124 between inner tubular cartridge wall 126 and outer tubular cartridge wall 128. The preceding subject matter of this paragraph characterizes example 26 of the present disclosure, wherein example 26 also includes the subject matter according to example 24 or 25, above.

Sleeve-interface portion 250 provides a coupling interface between twist-lock pressure cap 150 and sleeve 110. Cartridge-interface portion 252 provides sealing interface between twist-lock pressure cap 150 and cartridge 124 to hermetically couple twist-lock pressure cap 150 and cartridge 124.

In some examples, retainer-post 238 of each one of twist-lock retainers 234 is coupled to and extends radially outward from sleeve-interface portion 250. In some examples, retainer-head 242 is coupled to retainer-post 238 opposite sleeve-interface portion 250. In some examples, with twist-lock pressure cap 150 twisted into sleeve 110, retainer-post 238 is located within twist-lock slot 240 and outer tubular sleeve wall 112 is located between sleeve-interface portion 250 and retainer-head 242.

Referring generally to FIGS. 1A, 1B, and 1C and particularly to, e.g., FIGS. 8 and 12, twist-lock pressure cap 150 further comprises annular outer cap seal 236, coupled to cartridge-interface portion 252 and located between cartridge-interface portion 252 and outer tubular cartridge wall 128. Twist-lock pressure cap 150 also comprises annular inner cap seal 320, coupled to cartridge-interface portion 252 and located between cartridge-interface portion 252 and inner tubular cartridge wall 126. The preceding subject matter of this paragraph characterizes example 27 of the present disclosure, wherein example 27 also includes the subject matter according to example 26, above.

Annular outer cap seal 236 and annular inner cap seal 320 enable a hermetic seal to be formed between twist-lock pressure cap 150 and cartridge 124. Annular outer cap seal 236 is configured to form a seal between cartridge-interface portion 252 of twist-lock pressure cap 150 and outer tubular cartridge wall 128 of cartridge 124. Annular inner cap seal 320 is configured to form a seal between cartridge-interface portion 252 of twist-lock pressure cap 150 and inner tubular cartridge wall 126 of cartridge 124. The seal between twist-lock pressure cap 150 and cartridge 124, formed by annular outer cap seal 236 and annular inner cap seal 320, enables pressurization between twist-lock pressure cap 150 and annular plunger 148, which is used to move annular plunger 148 along first axis 118 toward valve 140 to urge brushable substance 102 from cartridge 124 into valve 140. The seal between twist-lock pressure cap 150 and cartridge 124, formed by annular outer cap seal 236 and annular inner cap seal 320, also forms an interference fit between cartridge-interface portion 252 and both of outer tubular cartridge wall 128 and inner tubular cartridge wall 126 suitable to assist in removal of cartridge 124 from within sleeve 110 through annular cartridge end-opening 170 along first axis 118, when twist-lock pressure cap 150 is removed. In some examples, each one of annular outer cap seal 236 and annular inner cap seal 320 is a gasket or an O-ring made of a pliable or compressible material, such as rubber silicone, and plastic polymers.

Referring generally to FIGS. 1A, 1B, and 1C and particularly to, e.g., FIGS. 7 and 12, twist-lock pressure cap 150 further comprises cap pressure input 246, configured to communicate pneumatic pressure within cartridge 124 to push annular plunger 148 along first axis 118 toward valve 140. The preceding subject matter of this paragraph characterizes example 28 of the present disclosure, wherein example 28 also includes the subject matter according to example 26 or 27, above.

Cap pressure input 246 enables communication of pneumatic pressure through sleeve-interface portion 250 and cartridge-interface portion 252 for application of a driving force to move annular plunger 148 along first axis 118 within cartridge 124, which in turn urges brushable substance 102 from cartridge 124 into valve 140.

In some examples, apparatus 100 also includes a pressure tube (not illustrated) to communicate pressure to twist-lock pressure cap 150. In some examples, the pressure tube communicates pressure to cap pressure input 246 to pressurize cartridge 124 and to control operation of annular plunger 148, such as linearly moving annular plunger 148 along first axis 118 toward valve 140. In some examples, cap pressure input 246 includes (or is) a pneumatic fitting.

Selective pneumatic operation of cap pressure input 246 of twist-lock pressure cap 150 enables precise application of pneumatic pressure to brushable substance 102 in cartridge 124 to precisely control the flow of brushable substance 102 out of cartridge 124 and into valve 140. Additionally, selective pneumatic operation of cap pressure input 246 enables the use of automated pneumatic controls to control the pneumatic operation of cap pressure input 246.

Referring generally to FIGS. 1A, 1B, and 1C and particularly to, e.g., FIGS. 14 and 15, annular plunger 148 comprises annular plunger body 282. Annular plunger 148 further comprises annular first inner seal 284, coupled with annular plunger body 282 and located between annular plunger body 282 and inner tubular cartridge wall 126. Annular plunger 148 additionally comprises annular first outer seal 286, coupled with annular plunger body 282 and located between annular plunger body 282 and outer tubular cartridge wall 128. Annular plunger 148 also comprises annular first seal retainer 288, coupled with annular plunger body 282. Annular plunger 148 further comprises annular second inner seal 362, coupled with annular plunger body 282 opposite annular first inner seal 284 and located between annular plunger body 282 and inner tubular cartridge wall 126. Annular plunger 148 also comprises annular second outer seal 364, coupled with annular plunger body 282 opposite annular first outer seal 286 and located between annular plunger body 282 and outer tubular cartridge wall 128. Annular plunger 148 additionally comprises annular second seal retainer 366, coupled with annular plunger body 282 opposite annular first seal retainer 288. Annular first inner seal 284 and annular first outer seal 286 are sandwiched between annular plunger body 282 and annular first seal retainer 288. Annular second inner seal 362 and annular second outer seal 364 are sandwiched between annular plunger body 282 and annular second seal retainer 366. The preceding subject matter of this paragraph characterizes example 29 of the present disclosure, wherein example 29 also includes the subject matter according to any one of examples 1 to 28, above.

A four-member seal of annular plunger 148 enables annular plunger 148 to react to pneumatic pressure applied within cartridge 124, between twist-lock pressure cap 150 and annular plunger 148, to move annular plunger 148 along first axis 118 toward valve 140. Annular first inner seal 284 and annular second inner seal 362 form an inner seal between annular plunger body 282 and inner tubular cartridge wall 126. Annular first outer seal 286 and annular second outer seal 364 form an outer seal between annular plunger body 282 and outer tubular cartridge wall 128. Annular plunger body 282 contains pressure between twist-lock pressure cap 150 and annular plunger 148. Annular first seal retainer 288 being coupled to annular plunger body 282 retains annular first inner seal 284 and annular first outer seal 286. Annular second seal retainer 366 being coupled to annular plunger body 282 retains annular second inner seal 362 and annular second outer seal 364.

Referring generally to FIGS. 1A, 1B, and 1C and particularly to, e.g., FIGS. 4, 5, 27, and 28, bracket 104 comprises first bracket portion 106 and second bracket portion 108, removably coupled to first bracket portion 106. Sleeve 110 is configured to be separated from bracket 104 along first axis 118 when second bracket portion 108 is removed from first bracket portion 106. The preceding subject matter of this paragraph characterizes example 30 of the present disclosure, wherein example 30 also includes the subject matter according to any one of examples 1 to 29, above.

Bracket 104 that has two portions enables removal of sleeve 110, and other components of apparatus 100 coupled to sleeve 110, without completely removing bracket 104 from interface bracket 224. In some examples, upon removal of second bracket portion 108 of bracket 104 from first bracket portion 106 of bracket 104, sleeve 110 is capable of being withdrawn from within first bracket portion 106 of bracket 104 along first axis 118.

In some examples, at least one of first bracket portion 106 and second bracket portion 108 of bracket 104 is removably coupled with interface bracket 224 such that first power-transmitting component 184 is capable of entering bracket 104 through bracket opening 426. In some examples, bracket 104 includes shoulders 424 that project inward from bracket wall 428. In some examples, bracket 104 is configured to capture and retain sleeve 110 between shoulders 424 upon second bracket portion 108 of bracket 104 being coupled to first bracket portion 106 of bracket 104 and to interface bracket 224. In some examples, a first one of shoulders 424 engages the first one of annular bearings 410 coupled to sleeve 110 and a second one of shoulders 424 engages the second one of annular bearings 410 coupled to sleeve 110.

Referring generally to FIGS. 1A, 1B, and 1C and particularly to, e.g., FIGS. 21-25, apparatus 100 further comprises valve-locking assembly 218, configured to releasably couple valve 140 with sleeve 110. The preceding subject matter of this paragraph characterizes example 31 of the present disclosure, wherein example 31 also includes the subject matter according to any one of examples 1 to 30, above.

Valve-locking assembly 218 enables quick, easy, and effective locking and unlocking of valve 140 to sleeve 110. Locking valve 140 to sleeve 110 retains valve 140 in fluid communication with cartridge 124. Unlocking valve 140 from sleeve 110 enables removal of valve 140, for example, for purposes of repair and/or replacement of valve 140 or other components of apparatus 100.

Referring generally to FIGS. 1A, 1B, and 1C and particularly to, e.g., FIGS. 16, 17, and 21-25, valve-locking assembly 218 comprises first bracket 244, coupled to sleeve 110, and second bracket 248, coupled to sleeve 110 and spaced away from first bracket 244. Valve 140 is configured to fit between first bracket 244 and second bracket 248 and is configured to be coupled to first bracket 244 and second bracket 248. The preceding subject matter of this paragraph characterizes example 32 of the present disclosure, wherein example 32 also includes the subject matter according to example 31, above.

First bracket 244 and second bracket 248 enable valve 140 to be releasably locked to valve-locking assembly 218 by facilitating valve 140 being securely retained between first bracket 244 and second bracket 248 with valve 140 in fluid communication with cartridge 124.

In some examples, first bracket 244 is coupled to sleeve second end 122 of sleeve 110 and projects from sleeve 110 along an axis parallel with first axis 118. In some examples, second bracket 248 is coupled to sleeve second end 122 of sleeve 110 and projects from sleeve 110 along an axis parallel with first axis 118. In some examples, first bracket 244 and second bracket 248 are laterally spaced apart to define an opening, configured to receive valve 140. In some examples, first bracket 244 and second bracket 248 are sufficiently, laterally spaced apart to create interference fit of valve 140 between first bracket 244 and second bracket 248. In some examples, with valve 140 positioned within the opening, formed between first bracket 244 and second bracket 248, valve-locking assembly 218 captures valve 140 between first bracket 244 and second bracket 248. Engagement of valve 140 between first bracket 244 and second bracket 248 appropriately orients valve 140 relative to cartridge 124 and positions valve 140 in fluid communication with cartridge outlet port 134.

Referring generally to FIGS. 1A, 1B, and 1C and particularly to, e.g., FIGS. 21-25, valve-locking assembly 218 further comprises locking pins 266, configured to be removably coupled with first bracket 244, valve 140, and second bracket 248. The preceding subject matter of this paragraph characterizes example 33 of the present disclosure, wherein example 33 also includes the subject matter according to example 32, above.

Locking pins 266 enable valve 140 to be removably coupled to first bracket 244 and second bracket 248 in fluid communication with cartridge 124. With valve 140 positioned between first bracket 244 and second bracket 248, removably coupling locking pins 266 with first bracket 244, valve 140, and second bracket 248 retains valve 140 between first bracket 244 and second bracket 248.

Referring generally to FIGS. 1A, 1B, and 1C and particularly to, e.g., FIGS. 21-25, locking pins 266 are configured to pass through first bracket 244 and valve 140 along axis perpendicular to first axis 118. Locking pins 266 are configured to be received by second bracket 248. The preceding subject matter of this paragraph characterizes example 34 of the present disclosure, wherein example 34 also includes the subject matter according to example 33, above.

Locking pins 266 being oriented perpendicular to first axis 118 fixes a position of valve 140 along first axis 118 relative to valve-locking assembly 218. With valve 140 positioned between first bracket 244 and second bracket 248, removably coupling locking pins 266 with first bracket 244, valve 140, and second bracket 248 prevents linear movement of valve 140 along first axis 118.

In some examples, first bracket 244 includes first bracket pass-through passages 446 that extend entirely through a body of first bracket 244 along an axis perpendicular to first axis 118. First bracket pass-through passages 446 are configured to receive locking pins 266 when locking pins 266 are coupled to first bracket 244. Similarly, in some examples, second bracket 248 includes second bracket pass-through passages 448 that extend entirely through a body of second bracket 248 along an axis perpendicular to first axis 118. Second bracket pass-through passages 448 are configured to receive locking pins 266 when locking pins 266 are coupled to second bracket 248. In some examples, valve 140 includes valve pass-through passages 444 that extend entirely through a body of valve 140 along an axis perpendicular to first axis 118. Valve pass-through passages 444 are configured to receive locking pins 266 when locking pins 266 are removably coupled with first bracket 244 and second bracket 248. With valve 140 positioned between first bracket 244 and second bracket 248, locking pins 266 extend through first bracket 244, through valve 140, and through second bracket 248 along the axis, perpendicular to first axis 118. Engagement of locking pins 266 with first bracket 244 and second bracket 248 fixes a linear position of locking pins 266 along first axis 118 relative to first bracket 244 and second bracket 248. Engagement of locking pins 266 with valve 140 fixes a linear position of valve 140 along first axis 118 relative to first bracket 244 and second bracket 248.

Referring generally to FIGS. 1A, 1B, and 1C and particularly to, e.g., FIGS. 21-25, locking pins 266 are configured to releasably engage second bracket 248. The preceding subject matter of this paragraph characterizes example 35 of the present disclosure, wherein example 35 also includes the subject matter according to example 34, above.

Locking pins 266 being releasably engaged, or locked, to second bracket 248 enables a reliable interlock between valve 140 and valve-locking assembly 218. Engaging locking pins 266 to second bracket 248 prevents inadvertent linear movement of locking pins 266 along the axis, perpendicular to first axis 118, relative to first bracket 244, valve 140, and second bracket 248.

In some examples, each one of locking pins 266 includes a detent having a projection (e.g., ball or pin) biased, via a biasing element (e.g., spring), into a position projecting outward from an end of a body of an associated one of locking pins 266. With valve 140 positioned between first bracket 244 and second bracket 248 and locking pins 266 coupled to first bracket 244, locking pins 266 extend through valve pass-through passages 444 of valve 140 and ends of locking pins 266 extend through second bracket pass-through passages 448 of second bracket 248 and protrude outwardly from second bracket 248. In an outwardly biased position, the detents of locking pins 266 prevent removal of locking pins 266 from second bracket pass-through passage 448.

Referring generally to FIGS. 1A, 1B, and 1C and particularly to, e.g., FIGS. 21-25, locking pins 266 are interconnected by pin-connector member 368. The preceding subject matter of this paragraph characterizes example 36 of the present disclosure, wherein example 36 also includes the subject matter according to example 35, above.

Pin-connector member 368 enables locking pins 266 to be simultaneously coupled to first bracket 244, valve 140, and second bracket 248.

Referring generally to FIGS. 1A, 1B, and 1C and particularly to, e.g., FIGS. 21-25, first bracket 244 comprises pin-support member 370, extending along another axis, perpendicular to first axis 118, and configured to support pin-connector member 368 when locking pins 266 are extended through first bracket 244 and valve 140 and are releasably engaged with second bracket 248. The preceding subject matter of this paragraph characterizes example 37 of the present disclosure, wherein example 37 also includes the subject matter according to example 36, above.

Pin-support member 370 enables pin-connector member 368 and locking pins 266 to be supported along an axis parallel with first axis 118 relative to sleeve 110 when locking pins 266 are removably coupled to first bracket 244, valve 140, and second bracket 248.

Referring generally to FIGS. 1A, 1B, and 1C and particularly to, e.g., FIGS. 4, 5, and 7, apparatus 100 further comprises vision system 372, located between pin-connector member 368 and sleeve 110. The preceding subject matter of this paragraph characterizes example 38 of the present disclosure, wherein example 38 also includes the subject matter according to example 37, above.

Vision system 372 enables visual inspection of brushable substance 102 dispensed on surface 154 to improve quality of an automated dispensing process. In some examples, vision system 372 includes one or more sensors (e.g., cameras), configured to capture pictures for analysis, inspection software, and a processing element that executes a pre-defined program defining the inspection operation.

Referring generally to FIGS. 1A, 1B, and 1C and particularly to, e.g., FIGS. 6, 8, and 16-18, valve 140 comprises first valve-body portion 260, comprising valve channel 280, and second valve-body portion 262, coupled to first valve-body portion 260. With valve 140 releasably locked to valve-locking assembly 218, first valve-body portion 260 is positioned between first bracket 244 and second bracket 248 and second valve-body portion 262 is positioned within inner tubular sleeve wall 114. The preceding subject matter of this paragraph characterizes example 39 of the present disclosure, wherein example 39 also includes the subject matter according to any one of examples 32 to 38, above.

When valve 140 is locked to valve-locking assembly 218, the configuration of valve 140 reduces the overall size of apparatus 100 by positioning second valve-body portion 262 of valve 140 within sleeve 110 and first valve-body portion 260 of valve 140 between first bracket 244 and second bracket 248 for coupling of locking pins 266.

Referring generally to FIGS. 1A, 1B, and 1C and particularly to, e.g., FIGS. 18-20, valve 140 further comprises valve passage 276, extending through valve 140 along axis parallel to first axis 118. Valve 140 also comprises valve-inlet port 142, located radially outward of valve passage 276 and configured to be communicatively coupled with cartridge 124. Valve 140 additionally comprises valve chamber 274, coaxial with valve passage 276. Valve 140 further comprises valve-outlet orifice 144, extending through valve 140 into valve chamber 274. Valve-outlet orifice 144 is configured to be communicatively coupled with brush-arm assembly 152. Valve chamber 274 is communicatively coupled with valve passage 276. Valve-inlet port 142 is communicatively coupled with valve passage 276 by valve channel 280, extending between valve-inlet port 142 and valve passage 276. The preceding subject matter of this paragraph characterizes example 40 of the present disclosure, wherein example 40 also includes the subject matter according to example 39, above.

Valve-inlet port 142, valve chamber 274, and valve-outlet orifice 144 define a flow path for brushable substance 102 through valve 140. Valve-inlet port 142 being formed in first valve-body portion 260 at a location radially outward of valve chamber 274 aligns and sealingly engages valve-inlet port 142 with cartridge outlet port 134 of cartridge 124. Valve-outlet orifice 144 being formed in first valve-body portion 260 communicatively couples valve 140 with brush-arm assembly 152. Valve passage 276 being formed in second valve-body portion 262 provides access for linear actuator 138 with valve chamber 274.

In some examples, valve 140 includes more than one valve-inlet port 142. Each valve-inlet port 142 is configured to be communicatively coupled with one cartridge outlet port 134 of cartridge 124. In some examples, valve-inlet port 142 also includes a gasket, configured to form a seal between valve-inlet port 142 and cartridge outlet port 134.

Referring generally to FIGS. 1A, 1B, and 1C and particularly to, e.g., FIGS. 18-20, valve 140 further comprises valve seat 380 between valve passage 276 and valve channel 280. Linear actuator 138 comprises barrel 292, removably coupled with second valve-body portion 262, and piston 294, movable along first axis 118 within barrel 292 between extended position and retracted position. Linear actuator 138 further comprises actuator rod 146, coupled to piston 294 and extending through valve passage 276, and first plug 296, coupled to actuator rod 146, opposite piston 294. With piston 294 in extended position, first plug 296 is entirely in valve chamber 274 and does not sealingly engage valve seat 380 between valve passage 276 and valve channel 280. With piston 294 in retracted position, first plug 296 sealingly engages valve seat 380 between valve passage 276 and valve channel 280. The preceding subject matter of this paragraph characterizes example 41 of the present disclosure, wherein example 41 also includes the subject matter according to example 40, above.

Linear actuator 138 enables precise control of the flow rate of brushable substance 102 out of valve 140 and into brush-arm assembly 152. Valve seat 380 provides a sealable interface between valve channel 280 and valve chamber 274 for selective sealing engagement by linear actuator 138 to segregate valve channel 280 from valve chamber 274 and block the flow path of brushable substance 102 from valve-inlet port 142 to valve-outlet orifice 144 through valve chamber 274. Valve channel 280 enables fluid coupling of valve-inlet port 142 with valve chamber 274. In some examples, valve-inlet port 142 has a flow direction parallel with first axis 118 and valve chamber 274 has a flow direction parallel with the flow direction of valve-inlet port 142. Linear actuator 138 enables flow of brushable substance 102 from valve-outlet orifice 144 by positioning first plug 296 in an open position, in which first plug 296 is positioned entirely within valve chamber 274 and is not sealingly engaged with valve seat 380, when piston 294 is moved to the extended position (FIG. 20). Linear actuator 138 restricts flow of brushable substance 102 from valve-outlet orifice 144 by positioning first plug 296 in a closed position, in which first plug 296 is positioned within valve seat 380 and is sealingly engaged with valve seat 380, when piston 294 is moved to the retracted position (FIG. 19).

Referring generally to FIGS. 1A, 1B, and 1C and particularly to, e.g., FIGS. 19 and 20, linear actuator 138 further comprises second plug 298, spaced away from first plug 296 along actuator rod 146 and positioned within valve passage 276. The preceding subject matter of this paragraph characterizes example 42 of the present disclosure, wherein example 42 also includes the subject matter according to example 41, above.

Second plug 298 enables restriction of flow of brushable substance 102 from valve chamber 274 into valve passage 276. In other words, second plug 298 being positioned within valve passage 276 prevents a backflow of brushable substance 102 from valve chamber 274 into valve passage 276 as brushable substance 102 flows through valve 140 and during actuation of linear actuator 138.

In some examples, actuator rod 146 also includes a first rod body, coupled to piston 294. In some examples, second plug 298 is coupled to the first rod body. In some examples, actuator rod 146 also includes a second rod body, coupled to second plug 298. In some examples, first plug 296 is coupled to the second rod body, opposite second plug 298.

Referring generally to FIGS. 1A, 1B, and 1C and particularly to, e.g., FIG. 20, linear actuator 138 further comprises first actuator pressure input 324, configured to communicate pneumatic pressure to move piston 294 in first direction into extended position and second actuator pressure input 326, configured to communicate pneumatic pressure to move piston 294 in second direction, opposite first direction, into retracted position. The preceding subject matter of this paragraph characterizes example 43 of the present disclosure, wherein example 43 also includes the subject matter according to example 41 or 42, above.

First actuator pressure input 324 and second actuator pressure input 326 enable double-action of linear actuator 138 and delivery of the pneumatic pressure driving force for movement of piston 294 relative to barrel 292.

In some examples, apparatus 100 also includes pressure tubes (not illustrated) to communicate pressure to and from linear actuator 138. In some examples, the pressure tubes communicate pressure to and from first actuator pressure input 324 and second actuator pressure input 326 to pressurize internal cylinder 450 of barrel 292 and application of pneumatic pressure to piston 294 to control operation of linear actuator 138, such as to move first plug 296 relative to valve 140 to control flow of brushable substance 102 from valve 140 to brush 176. In some examples, each one of first actuator pressure input 324 and second actuator pressure input 326 is a pneumatic fitting.

Selective pneumatic operation of first actuator pressure input 324 and second actuator pressure input 326 of linear actuator 138 enables precise application of pneumatic pressure to piston 294 to precisely control the flow of brushable substance 102 out of valve 140 and to brush 176. Additionally, selective pneumatic operation of first actuator pressure input 324 and second actuator pressure input 326 enables the use of automated pneumatic controls to control the pneumatic operation of first actuator pressure input 324 and second actuator pressure input 326.

Referring generally to FIGS. 1A, 1B, and 1C and particularly to, e.g., FIGS. 19 and 20, apparatus 100 further comprises first position sensor 328, configured to detect when piston 294 is in extended position, and second position sensor 330, configured to detect when piston 294 is in retracted position. Apparatus 100 also comprises positioning element 332 on piston 294. Positioning element 332 is configured to actuate first position sensor 328 when piston 294 is in extended position and is configured to actuate second position sensor 330 when piston 294 is in retracted position. The preceding subject matter of this paragraph characterizes example 44 of the present disclosure, wherein example 44 also includes the subject matter according to any one of examples 41 to 43, above.

First position sensor 328 and second position sensor 330 enable detection of whether first plug 296 is in the open position or the closed position based on the position of piston 294. Positioning element 332 enables actuation of first position sensor 328 when piston 294 is in the extended position to indicate valve 140 is open. Positioning element 332 also enables actuation of second position sensor 330 when piston 294 is in the retracted position to indicate valve 140 is closed.

Referring generally to FIGS. 1A, 1B, and 1C and particularly to, e.g., FIGS. 19 and 20, positioning element 332 comprises magnet 312, coupled to piston 294. First position sensor 328 comprises first magnetic sensor 334, proximate to one end of barrel 292. Second position sensor 330 comprises second magnetic sensor 336, proximate to another end of barrel 292. The preceding subject matter of this paragraph characterizes example 45 of the present disclosure, wherein example 45 also includes the subject matter according to example 44, above.

Magnet 312 enables non-contact actuation of first magnetic sensor 334 and second magnetic sensor 336 in response to movement of piston 294 relative to barrel 292.

Referring generally to FIGS. 1A, 1B, and 1C and particularly to, e.g., FIGS. 19 and 20, piston 294 comprises first annular piston portion 308, coupled to actuator rod 146, and second annular piston portion 310, coupled to actuator rod 146 and spaced away from first annular piston portion 308. Magnet 312 is an annular magnet, coupled to actuator rod 146 between first annular piston portion 308 and second annular piston portion 310. The preceding subject matter of this paragraph characterizes example 46 of the present disclosure, wherein example 46 also includes the subject matter according to example 45, above.

Magnet 312 being annular magnet enables positioning of first magnetic sensor 334 and second magnetic sensor 336 at any location around an exterior of barrel 292 relative to piston 294.

Referring generally to FIGS. 1A, 1B, and 1C and particularly to, e.g., FIG. 23, valve 140 further comprises first side 254 and second side 256, opposite first side 254. First bracket 244 is configured to engage first side 254 of valve 140. Second bracket 248 is configured to engage second side 256 of valve 140. The preceding subject matter of this paragraph characterizes example 47 of the present disclosure, wherein example 47 also includes the subject matter according to any one of examples 41 to 46, above.

Engagement of first side 254 of valve 140 with first bracket 244 of valve-locking assembly 218 and engagement of second side 256 of valve 140 with second bracket 248 of valve-locking assembly 218 enables precise locating of valve 140 and a reliable interlock between valve 140 and valve-locking assembly 218. Valve 140 being positioned between first bracket 244 and second bracket 248 with second valve-body portion 262 within sleeve 110 reduces the size of apparatus 100 and places valve 140 into direct fluid communication with cartridge 124. Direct communicative coupling of valve 140 with cartridge 124 reduces the amount of brushable substance 102 wasted due to a purging operation, for example, when cartridge 124 is replaced.

In some examples, first bracket 244 is configured to engage and mate with first side 254 of valve 140 and second bracket 248 is configured to engage and mate with second side 256 of valve 140. In some examples, locking pins 266 extend through first bracket 244, through valve pass-through passages 444 located in first valve-body portion 260 of valve 140, and through second bracket 248. In some examples, first side 254 of valve 140 and first bracket 244 are geometrically complementary to matingly engage valve 140 with first bracket 244. Similarly, in some examples, second side 256 of valve 140 and second bracket 248 are geometrically complementary to matingly engage valve 140 with second bracket 248.

Referring generally to FIGS. 1A, 1B, and 1C and particularly to, e.g., FIGS. 16, 17, and 22-25, valve 140 further comprises tab 258, extending outwardly from first side 254 of first valve-body portion 260 of valve 140. Second bracket 248 comprises bracket opening 302, configured to receive tab 258. The preceding subject matter of this paragraph characterizes example 48 of the present disclosure, wherein example 48 also includes the subject matter according to example 47, above.

Tab 258 enables valve 140 to be precisely and reliably positioned relative to cartridge 124 and into communicative engagement with cartridge 124. In other words, tab 258 align valve-inlet ports 142 with cartridge outlet ports 134 when valve 140 is coupled to valve-locking assembly 218.

In some examples, bracket opening 302 of second bracket 248 extends completely through the body of second bracket 248, which separates second bracket 248 into two portions. In some examples, each portion of second bracket 248 is coupled to sleeve second end 122 of sleeve 110. In some examples, each portion of second bracket 248 is configured to receive one of locking pins 266.

Referring generally to FIGS. 1A, 1B, and 1C and particularly to, e.g., FIGS. 16, 17, and 22-25, tab 258 comprises tab-recess 268, aligned with bracket opening 302 of second bracket 248 of valve-locking assembly 218. The preceding subject matter of this paragraph characterizes example 49 of the present disclosure, wherein example 49 also includes the subject matter according to example 48, above.

Tab-recess 268 enables routing of service lines and/or control lines (e.g., communication cables or wires and/or pressure tubes) from at least one of linear actuator 138, first position sensor 328, and/or second position sensor 330 to exit from a lower end of apparatus 100.

Referring generally to FIGS. 1A, 1B, and 1C and particularly to, e.g., FIGS. 17-201, second valve-body portion 262 further comprises first twist-lock interface 346, configured to releasably lock barrel 292 of linear actuator 138 to valve 140. The preceding subject matter of this paragraph characterizes example 50 of the present disclosure, wherein example 50 also includes the subject matter according to any one of examples 41 to 49, above.

First twist-lock interface 346 enables simple, easy, and effective coupling of linear actuator 138 to valve 140. First twist-lock interface 346 releasably locks linear actuator 138 to valve 140, with actuator rod 146 extending through valve passage 276 and into valve chamber 274, via a twisting action of linear actuator 138 relative to second valve-body portion 262 of valve 140.

In some examples, linear actuator 138 includes at least one twist-lock retainer 452 coupled to barrel 292 and extending along an axis parallel with first axis 118. In some examples, first twist-lock interface 346 of second valve-body portion 262 of valve 140 includes at least one twist-lock clamp 454. In some examples, twist-lock clamp 454 is cross-sectionally complementary to twist-lock retainer 452 and is configured to receive and releasably retain twist-lock retainer 452 upon insertion of twist-lock retainer 452 into twist-lock clamp 454 and twisting action of linear actuator 138 relative to valve 140. In some examples, twist-lock retainer 452 includes a shaft, projecting outward from barrel 292 of linear actuator 138, and a disk-like head, located on an end of the shaft. In some examples, twist-lock retainer 452 is a shoulder bolt, coupled to barrel 292 of linear actuator 138. First twist-lock interface 346 ensures linear actuator 138 is securely coupled to valve 140 with actuator rod 146 partially positioned within valve chamber 274.

Referring generally to FIGS. 1A, 1B, and 1C and particularly to, e.g., FIGS. 16-20, apparatus 100 further comprises pressure sensor 340, configured to be in communication with brushable substance 102 when brushable substance 102 is introduced into valve chamber 274. The preceding subject matter of this paragraph characterizes example 51 of the present disclosure, wherein example 51 also includes the subject matter according to any one of examples 40 to 50, above.

Pressure sensor 340 enables detection of pressure of brushable substance 102 within valve 140. In some examples, the pressure of brushable substance 102 within valve 140 that is detected by pressure sensor 340 is used to control the rate at which brushable substance 102 flows from cartridge 124 to valve 140. Additionally, in some examples, the pressure of brushable substance 102 within valve 140 that is detected by pressure sensor 340 is used to control the actuation of linear actuator 138 to regulate the rate at which brushable substance 102 flows from valve 140 to brush-arm assembly 152. In some examples, pressure sensor 340 is configured to be removably coupled to valve 140.

In some examples, valve 140 includes pressure sensor port 456 that is in communication with brushable substance 102 within valve 140. In some examples, pressure sensor port 456 is located in second valve-body portion 262 of valve 140 and extends from an exterior of valve 140 into communication with valve channel 280. In some examples, pressure sensor 340 is at least partially located within pressure sensor port 456 such that pressure sensor 340 is in communication with brushable substance 102, located within or flowing through, valve channel 280 of valve 140, for example, as brushable substance 102 is being introduced to valve chamber 274.

In some examples, apparatus 100 also includes pressure-sensor housing 344, configured to house pressure sensor 340 and to releasably couple pressure sensor 340 to valve 140 within pressure sensor port 456. Pressure-sensor housing 344 releasably locks pressure sensor 340 to valve 140 such that pressure sensor 340 is in communication with (e.g., is in contact with) brushable substance 102 located within valve 140, such as brushable substance 102 located within valve channel 280. In some examples, valve 140 also includes pressure-sensor receptacle 460 that is configured to receive and retain pressure-sensor housing 344. In some examples, pressure-sensor receptacle 460 is cross-sectionally complementary to pressure-sensor housing 344. In some examples, pressure-sensor receptacle 460 opens into pressure sensor port 456 such that pressure sensor 340 extends into valve 140 in communication with brushable substance 102 when pressure-sensor housing 344 is inserted within and removably coupled with pressure-sensor receptacle 460. In some examples, pressure-sensor housing 344 is threadingly coupled within pressure-sensor receptacle 460. Pressure-sensor housing 344 and pressure-sensor receptacle 460 ensure pressure sensor 340 is securely coupled to valve 140 in communication with brushable substance 102 within valve 140.

Referring generally to FIGS. 1A, 1B, and 1C, apparatus 100 further comprises pressure-signal conditioner 342, electrically coupled to pressure sensor 340. The preceding subject matter of this paragraph characterizes example 52 of the present disclosure, wherein example 52 also includes the subject matter according to example 51, above.

Pressure-signal conditioner 342 enables communication of pressure-related information from pressure sensor 340 to an electronic controller in a format usable by the electronic controller. In some examples, pressure-signal conditioner 342 provides data format conversion functionality on-board apparatus 100, rather than at the electronic controller.

Referring generally to FIGS. 1A, 1B, and 1C, apparatus 100 further comprises pressure source 360. Apparatus 100 also comprises controller 322, operatively coupled with pressure source 360 and with pressure sensor 340 to control, based on signals, obtained from pressure sensor 340, flow rate of brushable substance 102 through valve 140. The preceding subject matter of this paragraph characterizes example 53 of the present disclosure, wherein example 53 also includes the subject matter according to example 52, above.

Use of pressure sensor 340 to control the flow rate of brushable substance 102 through valve 140 enables precise and predictable flow of brushable substance.

In some examples, pressure source 360 is operatively coupled to cap pressure input 246 of twist-lock pressure cap 150 to communicate pressure to cartridge 124 and drive movement of annular plunger 148. Pressure source 360 is also operatively coupled to first actuator pressure input 324 and second actuator pressure input 326 of linear actuator 138 to communicate pressure to linear actuator 138 and drive movement of piston 294.

In some examples, controller 322 includes (or is) at least one electronic controller (e.g., a programmable processor) and at least one control valve that is pneumatically coupled to pressure source 360 and at least one of twist-lock pressure cap 150 and linear actuator 138. Controller 322 is configured to control application of pneumatic pressure from pressure source 360 to at least one of cap pressure input 246 of twist-lock pressure cap 150 and first actuator pressure input 324 and second actuator pressure input 326 of linear actuator 138. In some examples, the control valve is a two-way valve. In some examples, the control valve is an electromechanically operated solenoid valve.

Referring generally to FIGS. 1A, 1B, and 1C, apparatus 100 further comprises input/output connector 358, communicatively coupling pressure-signal conditioner 342 with controller 322. The preceding subject matter of this paragraph characterizes example 54 of the present disclosure, wherein example 54 also includes the subject matter according to example 53, above.

Input/output connector 358 enables electrical communication between controller 322 and pressure-signal conditioner 342. Input/output connector 358 provides a convenient and reliable electrical connection between controller 322 and pressure-signal conditioner 342.

Referring generally to FIGS. 1A, 1B, and 1C and particularly to, e.g., FIGS. 6, 7, 24, 25, and 30-33, apparatus 100 further comprises brush 176, configured to be communicatively coupled with valve 140. Brush-arm assembly 152 is configured to retain brush 176 and is capable of spinning brush 176 about third axis 382, parallel to first axis 118. The preceding subject matter of this paragraph characterizes example 55 of the present disclosure, wherein example 55 also includes the subject matter according to any one of examples 40 to 54, above.

Brush 176 enables dispensing of brushable substance 102 onto surface 154. Rotation of brush 176 about third axis 382 spreads, or applies, brushable substance 102 onto surface 154. When pressure is applied to brushable substance 102 in cartridge 124, selective operation of linear actuator 138 enables brushable substance 102 to flow from cartridge 124, through valve 140, to brush 176, at least when brush-arm assembly 152 spins (e.g., rotates) brush 176 about third axis 382.

Referring generally to FIGS. 1A, 1B, and 1C and particularly to, e.g., FIGS. 6, 7, 16, and 17, apparatus 100 further comprises third motor 386, operatively coupled to brush-arm assembly 152 and selectively operable to rotate brush 176 about third axis 382. The preceding subject matter of this paragraph characterizes example 56 of the present disclosure, wherein example 56 also includes the subject matter according to example 55, above.

Third motor 386 being operatively coupled with brush-arm assembly 152 enables third motor 386 to selectively rotate brush 176.

In some examples, third motor 386 includes an output shaft that is rotatable by third motor 386 to produce a rotary force or torque when third motor 386 is operated. In some examples, third motor 386 is any one of various rotational motors, such as electric motors, hydraulic motors, pneumatic motors, electromagnetic motors, and the like. In some examples, third motor 386 is coupled to valve-locking assembly 218 with the output shaft, operatively coupled to brush-arm assembly 152, to selectively rotate brush 176. In some examples, valve-locking assembly 218 also includes bracket plate 470, removably coupled to first bracket 244. In some examples, with bracket plate 470 coupled to first bracket 244, first bracket 244 and bracket plate 470, in combination, define motor receptacle 472, configured to receive and retain a portion of third motor 386.

Referring generally to FIGS. 1A, 1B, and 1C and particularly to, e.g., FIGS. 31-33, brush-arm assembly 152 comprises first drive component 384, rotatable about third axis 382. Third motor 386 is operatively coupled with first drive component 384 and selectively operable to rotate first drive component 384 about third axis 382. Brush 176 is coupleable with first drive component 384. The preceding subject matter of this paragraph characterizes example 57 of the present disclosure, wherein example 57 also includes the subject matter according to example 56, above.

Third motor 386 being operatively coupled with first drive component 384 and brush 176 being co-rotatably coupleable with first drive component 384 enables third motor 386 to selectively rotate brush 176. In some examples, third axis 382 is laterally spaced away from and parallel to an axis of rotation of third motor 386 and first axis 118. Configuring third axis 382 to be parallel to the axis of rotation of third motor 386 reduces complexity and improves reliability of the operative coupling between third motor 386 and first drive component 384. Configuring third axis 382 to be laterally spaced away from first axis 118 positions brush 176 laterally outward of first axis 118.

Referring generally to FIGS. 1A, 1B, and 1C and particularly to, e.g., FIG. 33, first drive component 384 comprises brush receptacle 388, configured to releasably retain brush 176. The preceding subject matter of this paragraph characterizes example 58 of the present disclosure, wherein example 58 also includes the subject matter according to example 57, above.

Brush receptacle 388 enables brush 176 to be quickly and easily retained by first drive component 384 and removed from first drive component 384.

Referring generally to FIGS. 1A, 1B, and 1C and particularly to, e.g., FIG. 33, brush 176 comprises engagement portion 390. Brush receptacle 388 is configured to form interference fit with engagement portion 390 of brush 176. The preceding subject matter of this paragraph characterizes example 59 of the present disclosure, wherein example 59 also includes the subject matter according to example 58, above.

Interference fit between brush receptacle 388 and engagement portion 390 of brush 176 promotes a secure retention of brush 176 by brush receptacle 388 and enables co-rotation of brush 176 and first drive component 384. Additionally, interference fit between brush receptacle 388 and engagement portion 390 of brush 176 enables brush receptacle 388 to retain brush 176 by simply inserting engagement portion 390 of brush 176 into brush receptacle 388 without the need for additional fasteners. In some examples, brush receptacle 388 includes a hex socket and engagement portion 390 of brush 176 includes a hex head, configured to fit within an opening of the hex socket of brush receptacle 388. In some examples, brush receptacle 388 also includes a gasket (e.g., an O-ring), configured to provide the interference fit between brush receptacle 388 and engagement portion 390 of brush 176.

Referring generally to FIGS. 1A, 1B, and 1C and particularly to, e.g., FIGS. 31-33, brush-arm assembly 152 further comprises second drive component 392, operatively coupled with third motor 386, and third power-transmitting component 394, operatively coupled with second drive component 392 and first drive component 384. Third motor 386 is selectively operable to rotate second drive component 392 about fourth axis 398 of third motor 386. The preceding subject matter of this paragraph characterizes example 60 of the present disclosure, wherein example 60 also includes the subject matter according to example 59, above.

Third motor 386 being operatively coupled with second drive component 392 and second drive component 392 being operatively coupled with first drive component 384 enables third motor 386 to selectively rotate first drive component 384. In other words, second drive component 392 and third power-transmitting component 394 transmit power from third motor 386 to first drive component 384, which rotates brush 176. In some examples, fourth axis 398 of third motor 386 is the axis of rotation of third motor 386.

Referring generally to FIGS. 1A, 1B, and 1C and particularly to, e.g., FIGS. 31-33, third power-transmitting component 394 comprises gear train 396. The preceding subject matter of this paragraph characterizes example 61 of the present disclosure, wherein example 61 also includes the subject matter according to example 60, above.

Gear train 396 provides an efficient and reliable mechanism to transmit power from third motor 386 to first drive component 384, such as when first drive component 384 is not co-axial with fourth axis 398 of third motor 386 (e.g., when third axis 382 of brush 176 is laterally offset from fourth axis 398 of third motor 386). Alternatively, in some examples, third power-transmitting component 394 is a belt or a chain Referring generally to FIGS. 1A, 1B, and 1C and particularly to, e.g., FIGS. 30-33, brush-arm assembly 152 further comprises union coupling 400, operatively coupling third motor 386 with second drive component 392. The preceding subject matter of this paragraph characterizes example 62 of the present disclosure, wherein example 62 also includes the subject matter according to example 60 or 61, above.

Union coupling 400 transmits power from third motor 386 to second drive component 392. In some examples, union coupling 400 is rotary union that is co-rotatably coupled to the output shaft of third motor 386, at one end of union coupling 400, and co-rotatably coupled to an input shaft of second drive component 392, at opposite end of union coupling 400.

Referring generally to FIGS. 1A, 1B, and 1C and particularly to, e.g., FIGS. 30-33, brush-arm assembly 152 further comprises drive-component housing 402, at least partially enclosing first drive component 384, second drive component 392, and third power-transmitting component 394. Drive-component housing 402 is coupled to one of first bracket 244 or second bracket 248. The preceding subject matter of this paragraph characterizes example 63 of the present disclosure, wherein example 63 also includes the subject matter according to any one of examples 60 to 62, above.

Drive-component housing 402 enables secure retention of first drive component 384, second drive component 392, and third power-transmitting component 394. Drive-component housing 402 protects first drive component 384, second drive component 392, and third power-transmitting component 394 from impacts and/or contaminants. In some examples, drive-component housing 402 includes bearings that enable low-friction rotation of first drive component 384, second drive component 392, and third power-transmitting component 394. In some examples, bearings are any one of various types of bearings, such as radial ball bearings.

Referring generally to FIGS. 1A, 1B, and 1C and particularly to, e.g., FIGS. 3, 24, 26, and 27, drive-component housing 402 is fixed relative to sleeve 110. Angular orientation of brush-arm assembly 152 is selectively adjustable about first axis 118 relative to bracket 104 responsive to rotation of sleeve 110. The preceding subject matter of this paragraph characterizes example 64 of the present disclosure, wherein example 64 also includes the subject matter according to example 63, above.

Drive-component housing 402 being fixed relative to sleeve 110 enables co-rotation of brush-arm assembly 152 and sleeve 110 about first axis 118 relative to bracket 104. Controlled selective rotary motion of sleeve 110 about first axis 118 relative to bracket 104 automatically and precisely rotates brush-arm assembly 152 about first axis 118. Selective adjustability of the angular orientation of drive-component housing 402 controls selective adjustment of an angular orientation of brush 176 relative to surface 154. In some examples, drive-component housing 402 of brush-arm assembly 152 is coupled to first bracket 244.

Referring generally to FIGS. 1A, 1B, and 1C and particularly to, e.g., FIGS. 3, 6, and 7, apparatus 100 further comprises brushable-substance delivery tube 404, communicatively coupling valve 140 with brush 176. The preceding subject matter of this paragraph characterizes example 65 of the present disclosure, wherein example 65 also includes the subject matter according to any one of examples 55 to 64, above.

Brushable-substance delivery tube 404 enables the delivery of brushable substance 102 from valve 140 to brush 176. Selective pressurization of cartridge 124 and selective operation of linear actuator 138 to open and close valve 140 controls the flow of brushable substance 102 from valve 140 to brush 176 through brushable-substance delivery tube 404, at least when brush 176 is releasably retained by brush-arm assembly 152 and brush-arm assembly 152 rotates brush 176. In some examples, brushable-substance delivery tube 404 also enables the delivery of brushable substance 102 from valve 140 to brush 176 along a path external to drive-component housing 402 of brush-arm assembly 152 to simplify efficient transmission of power from third motor 386 to first drive component 384.

Referring generally to FIGS. 1A, 1B, and 1C and particularly to, e.g., FIGS. 30 and 33, apparatus 100 further comprises cap 406, configured to be releasably coupled with brush-arm assembly 152. Cap 406 is also configured to direct brushable substance 102 from brushable-substance delivery tube 404 to brush 176 when brush 176 is releasably retained by brush-arm assembly 152 and when brush-arm assembly 152 rotates brush 176. The preceding subject matter of this paragraph characterizes example 66 of the present disclosure, wherein example 66 also includes the subject matter according to example 65, above.

Cap 406 enables brushable substance 102 to flow from brushable-substance delivery tube 404 to brush 176, for example, while brush 176 is rotating. In some examples, cap 406 enables leak-free delivery of brushable substance 102 from brushable-substance delivery tube 404 to brush 176, for example, while brush 176 is rotating.

Referring generally to FIGS. 1A, 1B, and 1C and particularly to, e.g., FIG. 33, cap 406 comprises cap channel 408, extending through cap 406. Cap channel 408 is circumferentially closed. Brushable substance 102 moves from brushable-substance delivery tube 404 through cap channel 408 of cap 406 to brush 176 when brush 176 is releasably retained by brush-arm assembly 152 and when brush-arm assembly 152 rotates brush 176. The preceding subject matter of this paragraph characterizes example 67 of the present disclosure, wherein example 67 also includes the subject matter according to example 66, above.

Cap channel 408 of cap 406, being circumferentially closed, enables containment of brushable substance 102 as brushable substance 102 moves from brushable-substance delivery tube 404 to brush 176. In some examples, brushable-substance delivery tube 404 is communicatively coupled to valve-outlet orifice 144 and to cap channel 408 of cap 406. In some examples, brush 176 includes a hollow shaft, communicatively coupled with cap channel 408. In some examples, cap 406 includes a cap receptacle, communicately coupled with cap channel 408 and configured to receive the hollow shaft of brush 176. In some examples, cap 406 also includes a gasket, configured to form a seal between the hollow shaft of brush 176 and cap 406. In some examples, the hollow shaft of brush 176 is rotatable relative to the cap receptacle of cap 406.

Referring generally to FIGS. 1A, 1B, 1C, and 2-8 and particularly to, e.g., FIGS. 34A and 34B, method 1000 of dispensing brushable substance 102 onto surface 154 is disclosed. Method 1000 comprises, (block 1002) with cartridge 124 positioned inside sleeve 110 between inner tubular sleeve wall 114 and outer tubular sleeve wall 112, circumscribing inner tubular sleeve wall 114, and also positioned between twist-lock pressure cap 150, hermetically coupled with cartridge 124, and valve 140, communicatively coupled with cartridge 124, linearly moving annular plunger 148, received between inner tubular cartridge wall 126 and outer tubular cartridge wall 128, circumscribing inner tubular cartridge wall 126, toward valve 140 along first axis 118 to urge brushable substance 102 from cartridge 124, through valve 140, and to brush 176 that is communicatively coupled to valve 140 and (block 1004) controlling flow of brushable substance 102 from valve 140 to brush 176. The preceding subject matter of this paragraph characterizes example 68 of the present disclosure.

Method 1000 provides for dispensing brushable substance 102, from cartridge 124, through brush-arm assembly 152, to surface 154 of a workpiece, for example, located in a confined space. The configuration of sleeve 110 and cartridge 124 reduces the size requirements for storage of brushable substance 102 and allows linear actuator 138 and a portion of valve 140 to be located within sleeve 110. Twist-lock pressure cap 150 enables pressurization of an internal volume located within cartridge 124, which drives annular plunger 148. Rotation of sleeve 110 controls an angular orientation of brush-arm assembly 152 relative to bracket 104 and surface 154. Valve 140 being communicatively coupled directly to cartridge 124 enables reduction of brushable substance 102 wasted, for example, during replacement of cartridge 124 and/or a purging operation.

Referring generally to FIGS. 1A, 1B, 1C, 4, 5, and 22 and particularly to, e.g., FIGS. 34A and 34B, method 1000 further comprises, (block 1006) with sleeve 110 coupled to bracket 104, selectively rotating sleeve 110 relative to bracket 104 about first axis 118 to controllably position of brush 176 relative to surface 154. The preceding subject matter of this paragraph characterizes example 69 of the present disclosure, wherein example 69 also includes the subject matter according to example 68, above.

Selectively rotating sleeve 110 relative to bracket 104 enables positioning of brush-arm assembly 152 relative to surface 154 for dispensing brushable substance 102.

Referring generally to FIGS. 1A, 1B, 1C, 6, 7, 24, 25, and 30-33 and particularly to, e.g., FIGS. 34A and 34B, method 1000 further comprises, (block 1008) with brush 176 releasably retained by brush-arm assembly 152, coupled with sleeve 110, rotating brush 176 about third axis 382, parallel to first axis 118. The preceding subject matter of this paragraph characterizes example 70 of the present disclosure, wherein example 70 also includes the subject matter according to example 69, above.

Rotating brush 176 spreads brushable substance 102 onto surface 154.

Referring generally to FIGS. 1A, 1B, 1C, 3-5, and 22 and particularly to, e.g., FIGS. 34A and 34B, method 1000 further comprises (block 1010) detecting when sleeve 110 is in predetermined rotational orientation relative to bracket 104 by actuating proximity sensor 190, located proximate to sleeve 110, with homing element 186, located on sleeve 110. The preceding subject matter of this paragraph characterizes example 71 of the present disclosure, wherein example 71 also includes the subject matter according to example 69 or 70, above.

Detecting the rotational orientation of sleeve 110 relative to bracket 104 enables actuation of proximity sensor 190 when sleeve 110 is rotated to the predetermined rotational orientation relative to bracket 104 to indicate sleeve 110 is in the home position. Detecting the rotational orientation of sleeve 110 also enables use of an incremental, rather than an absolute, position encoder, which would be unable to determine the rotational orientation of sleeve 110 relative to bracket 104 in the case of a power interruption.

Referring generally to FIGS. 1A, 1B, 1C, 3, and 4 and particularly to, e.g., FIGS. 34A and 34B, method 1000 further comprises, (block 1012) with bracket 104 coupled to robot interface 222 that is coupled to robot 116, selectively linearly moving bracket 104 relative to robot interface 222 along first axis 118. The preceding subject matter of this paragraph characterizes example 72 of the present disclosure, wherein example 72 also includes the subject matter according to any one of examples 69 to 71, above.

Linearly movement of bracket 104 relative to robot interface 222 enables linear movement of bracket 104 relative to robot 116 and linear movement of brush-arm assembly 152 relative to surface 154.

Referring generally to FIGS. 1A, 1B, 1C, 3, and 11-13 and particularly to, e.g., FIGS. 34A and 34B, method 1000 further comprises (block 1014) twist-locking twist-lock pressure cap 150 to sleeve 110. The preceding subject matter of this paragraph characterizes example 73 of the present disclosure, wherein example 73 also includes the subject matter according to any one of examples 69 to 72, above.

Releasably locking twist-lock pressure cap 150 to sleeve 110 hermetically couples twist-lock pressure cap 150 with cartridge 124 and enables the use of pneumatic pressure to move annular plunger 148 along first axis 118 within cartridge 124 toward valve 140, which urges brushable substance 102 from cartridge 124 into valve 140.

Referring generally to FIGS. 1A, 1B, 1C, 3, and 11-13 and particularly to, e.g., FIGS. 34A and 34B, according to method 1000, (block 1014) twist-locking twist-lock pressure cap 150 to sleeve 110 comprises (block 1016) releasably engaging twist-lock retainers 234 of twist-lock pressure cap 150 within twist-lock slots 240 in sleeve 110 when twist-lock pressure cap 150 is twisted into sleeve 110. The preceding subject matter of this paragraph characterizes example 74 of the present disclosure, wherein example 74 also includes the subject matter according to example 73, above.

Twist-locking of twist-lock retainers 234 within twist-lock slots 240 into locked position enables twist-lock pressure cap 150 to be releasably locked to sleeve 110 and seals twist-lock pressure cap 150 with cartridge 124. Removal of twist-lock pressure cap 150 from within sleeve 110 along first axis 118, while sealed with cartridge 124 permits removal of cartridge 124 from within sleeve 110 through annular sleeve end-opening 162.

Referring generally to FIGS. 1A, 1B, 1C, and 6-8 and particularly to, e.g., FIGS. 34A and 34B, method 1000 further comprises, (block 1018) with twist-lock pressure cap 150 twist-locked to sleeve 110, controlling flow rate of brushable substance 102 through valve 140. The preceding subject matter of this paragraph characterizes example 75 of the present disclosure, wherein example 75 also includes the subject matter according to example 73 or 74, above.

Pressure applied to annular plunger 148 enables annular plunger 148 to move along first axis 118 toward valve 140, which urges brushable substance 102 from cartridge 124 and into valve 140. Control of the pneumatic pressure communicated to annular plunger 148 controls the flow rate of brushable substance 102 through valve 140.

Referring generally to FIGS. 1A, 1B, 1C, 8, 19, and 20 and particularly to, e.g., FIGS. 34A and 34B, according to method 1000, (block 1018) controlling flow rate of brushable substance 102 through valve 140 is based, at least in part, on pressure of brushable substance 102, located within valve 140. The preceding subject matter of this paragraph characterizes example 76 of the present disclosure, wherein example 76 also includes the subject matter according to example 75, above.

Controlling flow rate of brushable substance 102 based on pressure of brushable substance 102 enables precise and predictable flow of brushable substance 102. Monitoring parameters of brushable substance 102, such as pressure of brushable substance 102 located within valve 140, as brushable substance 102 flows through valve 140 to brush 176, enables a consistent and/or desired amount of brushable substance 102 to be dispensed or applied onto surface 154 by brush 176. In an example, controller 322 is operatively coupled to pressure sensor 340 to process a pressure value of brushable substance 102 within valve 140. Controller 322 controls the pneumatic pressure applied to annular plunger 148 and controls a position of first plug 296 relative to valve 140 based on the processed values to control the flow rate of brushable substance 102 through valve 140.

Referring generally to FIGS. 1A, 1B, 1C, and 6-8 and particularly to, e.g., FIGS. 34A and 34B, method further comprises (block 1022) determining pressure of brushable substance 102, flowing through valve 140. Method 1000 also comprises, (block 1024) based on pressure of brushable substance 102, linearly moving annular plunger 148 along first axis 118 toward valve 140 to control flow rate of brushable substance 102 through valve 140. The preceding subject matter of this paragraph characterizes example 77 of the present disclosure, wherein example 77 also includes the subject matter according to example 76, above.

Controlling flow rate of brushable substance 102 based on pressure of brushable substance 102 enables precise and predictable flow of brushable substance 102. Monitoring pressure of brushable substance 102 located within valve 140, as brushable substance 102 flows through valve 140 and out from brush 176, enables a consistent and/or desired amount of brushable substance 102 to be dispensed or applied onto surface 154.

Referring generally to FIGS. 1A, 1B, 1C, 7, 8, 19, and 20 and particularly to, e.g., FIGS. 34A and 34B, according to method 1000, (block 1004) controlling flow of brushable substance 102 from valve 140 to brush 176 comprises (block 1026) actuating linear actuator 138, coupled to valve 140, to move first plug 296 of linear actuator 138 into one of open position, in which first plug 296 does not sealingly engage valve seat 380 of valve 140, or closed position, in which first plug 296 sealingly engages valve seat 380 of valve 140. The preceding subject matter of this paragraph characterizes example 78 of the present disclosure, wherein example 78 also includes the subject matter according to any one of examples 68 to 77, above.

Actuation of linear actuator 138 enables precise control of the flow of brushable substance 102 from valve 140 into brush 176 via brushable-substance delivery tube 404. In an example, controller 322 is operatively coupled to linear actuator 138 and controls the position of first plug 296 relative to valve seat 380 of valve 140 to control the flow rate of brushable substance 102 through valve 140.

Referring generally to FIGS. 1A, 1B, 1C, 16, 17, 19, and 20 and particularly to, e.g., FIGS. 34A and 34B, method 1000 further comprises (block 1028) detecting when piston 294 of linear actuator 138 is in extended position to indicate that first plug 296 is in open position. Method 1000 also comprises (block 1030) detecting when piston 294 of linear actuator 138 is in retracted position to indicate that first plug 296 is in closed position. The preceding subject matter of this paragraph characterizes example 79 of the present disclosure, wherein example 79 also includes the subject matter according to example 78, above.

Detecting when piston 294 is in the extended and retracted positions enables precise control of flow of brushable substance 102 from valve 140 to brush 176 by controlling the relative position of first plug 296 between the open and closed positions. Moving first plug 296 to the open position at which first plug 296 does not sealingly engage valve seat 380 enables flow of brushable substance 102 out of valve-outlet orifice 144 and into brushable-substance delivery tube 404 for delivery to brush 176. Moving first plug 296 into the closed position at which first plug 296 sealingly engages valve seat, prevents flow of brushable substance 102 out of valve-outlet orifice 144.

Referring generally to FIGS. 1A, 1B, 1C, 19, and 20 and particularly to, e.g., FIGS. 34A and 34B, according to method 1000, (block 1032) when first plug 296 is moved from open position to closed position, brushable substance 102 is drawn from valve chamber 274 of valve 140 back into valve passage 276 of valve 140. The preceding subject matter of this paragraph characterizes example 80 of the present disclosure, wherein example 80 also includes the subject matter according to example 78 or 79, above.

Movement of first plug 296 from the open position to the closed position pulls brushable substance 102 back into valve 140 to prevent excess amounts of brushable substance 102 from passing through valve-outlet orifice 144 and into brushable-substance delivery tube 404 during linear movement of first plug 296.

Referring generally to FIGS. 1A, 1B, 1C, 6, 8, 16-18, and 21-25 and particularly to, e.g., FIGS. 34A and 34B, method 1000 further comprises (block 1034) releasably locking valve 140 to valve-locking assembly 218, which is coupled to sleeve 110, so that valve-inlet port 142 of first valve-body portion 260 of valve 140 is communicatively coupled with cartridge outlet port 134 of cartridge 124 and second valve-body portion 262 of valve 140 is positioned within inner tubular sleeve wall 114. The preceding subject matter of this paragraph characterizes example 81 of the present disclosure, wherein example 81 also includes the subject matter according to any one of examples 68 to 80, above.

Positioning second valve-body portion 262 of valve 140 within inner tubular sleeve wall 114 of sleeve 110, when valve 140 is locked to valve-locking assembly 218 and valve-inlet port 142 is sealingly engaged with cartridge outlet port 134, reduces the overall size of apparatus 100.

Referring generally to FIGS. 1A, 1B, 1C, and 21-25 and particularly to, e.g., FIGS. 34A and 34B, according to method 1000, (block 1034) releasably locking valve 140 to valve-locking assembly 218 comprises (block 1036) positioning valve 140 between first bracket 244, coupled to sleeve 110, and second bracket 248, coupled to sleeve 110, and (block 1038) releasably locking valve 140 with first bracket 244 and second bracket 248. The preceding subject matter of this paragraph characterizes example 82 of the present disclosure, wherein example 82 also includes the subject matter according to example 81, above.

Positioning valve 140 between and releasably locking valve to first bracket 244 and second bracket 248 enables valve 140 to be releasably locked to valve-locking assembly 218 in fluid communication with cartridge 124.

Examples of the present disclosure may be described in the context of aircraft manufacturing and service method 1100 as shown in FIG. 35 and aircraft 1102 as shown in FIG. 36. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 36, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A method of dispensing a brushable substance onto a surface, the method comprising steps of:

with a cartridge positioned inside a sleeve between an inner tubular sleeve wall and an outer tubular sleeve wall, circumscribing the inner tubular sleeve wall, and also positioned between a push-lock pressure cap, hermetically coupled with the cartridge, and a valve, communicatively coupled with the cartridge, linearly moving an annular plunger, received between an inner tubular cartridge wall and an outer tubular cartridge wall, circumscribing the inner tubular cartridge wall, toward the valve along a first axis to urge the brushable substance from the cartridge, through the valve, and to a brush that is communicatively coupled to the valve; and controlling flow of the brushable substance from the valve to the brush.

2. The method according to claim 1, further comprising, with the sleeve coupled to a bracket, selectively rotating the sleeve relative to the bracket about the first axis to controllably position of the brush relative to the surface.

3. The method according to claim 2, further comprising, with the brush releasably retained by a brush-arm assembly, coupled with the sleeve, rotating the brush about a third axis, parallel to the first axis.

4. The method according to claim 2, further comprising detecting when the sleeve is in a predetermined rotational orientation relative to the bracket by actuating a proximity sensor, located proximate to the sleeve, with a homing element, located on the sleeve.

5. The method according to claim 2, further comprising, with the bracket coupled to a robot interface that is coupled to a robot, selectively linearly moving the bracket relative to the robot interface along the first axis.

6. The method according to claim 1, further comprising a step of releasably locking the push-lock pressure cap to the sleeve.

7. The method according to claim 6, wherein the step of releasably locking the push-lock pressure cap to the sleeve comprises a step of moving spring-loaded latches of the push-lock pressure cap relative to the sleeve into a locked position, in which the spring-loaded latches are engaged with the sleeve.

8. The method according to claim 7, wherein the step of moving the spring-loaded latches into the locked position comprises pushing a keeper of each one of the spring-loaded latches into a locking aperture in the sleeve with a latch spring, coupled to the keeper.

9. The method according to claim 8, further comprising a step of unlocking the push-lock pressure cap from the sleeve.

10. The method according to claim 9, wherein the step of unlocking the push-lock pressure cap from the sleeve comprises a step of moving the spring-loaded latches of the push-lock pressure cap relative to the sleeve into an unlocked position, in which the spring-loaded latches are disengaged from the sleeve.

11. The method according to claim 10, wherein the step of moving the spring-loaded latches into the unlocked position comprises pushing the keeper of each one of the spring-loaded latches out of the locking aperture, formed in the sleeve, by rotating a cam about the first axis.

12. The method according to claim 11, further comprising, with the push-lock pressure cap removed from the sleeve, at least partially ejecting the cartridge from the sleeve through an annular sleeve end-opening that separates the inner tubular sleeve wall and the outer tubular sleeve wall.

13. The method according to claim 7, further comprising, with the push-lock pressure cap releasably locked to the sleeve, a step of controlling a flow rate of the brushable substance through the valve.

14. The method according to claim 13, wherein the step of controlling the flow rate of the brushable substance through the valve is based, at least in part, on a pressure of the brushable substance, located within the valve.

15. The method according to claim 14, further comprising:

determining the pressure of the brushable substance, flowing through the valve; and based on the pressure of the brushable substance, linearly moving the annular plunger along the first axis toward the valve to control the flow rate of the brushable substance through the valve.

16. The method according to claim 1, wherein the step of controlling the flow of the brushable substance from the valve to the brush comprises actuating a linear actuator, coupled to the valve, to move a first plug of the linear actuator into one of an open position, in which the first plug does not sealingly engage a valve seat of the valve, or a closed position, in which the first plug sealingly engages the valve seat of the valve.

17. The method according to claim 16, further comprising:

detecting when a piston of the linear actuator is in an extended position to indicate that the first plug is in the open position; and detecting when the piston of the linear actuator is in a retracted position to indicate that the first plug is in the closed position.

18. The method according to claim 17, wherein when the first plug is moved from the open position to the closed position, the brushable substance is drawn from a second chamber portion of the valve back into a first chamber portion of the valve.

19. The method according to claim 1, further comprising a step of releasably locking the valve to a valve-locking assembly, which is coupled to the sleeve, so that a valve-inlet port of a first valve-body portion of the valve is communicatively coupled with a cartridge outlet port of the cartridge and a second valve-body portion of the valve is positioned within the inner tubular sleeve wall.

20. The method according to claim 19, wherein the step of releasably locking the valve to the valve-locking assembly comprises:

positioning the valve between a first bracket, coupled to the sleeve, and a second bracket, coupled to the sleeve; and releasably locking the valve with the first bracket and the second bracket.

* * * * *